US006987485B2

(12) United States Patent
Ito et al.

(10) Patent No.: US 6,987,485 B2
(45) Date of Patent: Jan. 17, 2006

(54) BUILT-IN ANTENNA FOR RADIO COMMUNICATION TERMINAL

(75) Inventors: Hideo Ito, Yokosuka (JP); Kiyoshi Egawa, Yokosuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 515 days.

(21) Appl. No.: 10/130,645

(22) PCT Filed: Aug. 30, 2001

(86) PCT No.: PCT/JP01/07453

§ 371 (c)(1),
(2), (4) Date: May 21, 2002

(87) PCT Pub. No.: WO02/19465

PCT Pub. Date: Mar. 7, 2002

(65) Prior Publication Data

US 2003/0078012 A1 Apr. 24, 2003

(30) Foreign Application Priority Data

Aug. 31, 2000 (JP) ..... 2000-262549

(51) Int. Cl.
*H01Q 1/24* (2006.01)

(52) U.S. Cl. ..... 343/702

(58) Field of Classification Search ..... 343/702, 343/895, 741, 866, 867, 868, 700 MS, 744, 343/726, 727, 730, 735, 740, 747, 793
See application file for complete search history.

(56) References Cited

U.S. PATENT DOCUMENTS

| | | | | |
|---|---|---|---|---|
| 5,565,881 | A * | 10/1996 | Phillips et al. | 343/859 |
| 6,046,703 | A | 4/2000 | Wang et al. | 343/795 |
| 6,255,998 | B1 * | 7/2001 | Podger | 343/867 |
| 6,271,796 | B1 * | 8/2001 | Itoh et al. | 343/702 |
| 6,362,793 | B1 * | 3/2002 | Sawamura et al. | 343/702 |
| 6,366,247 | B1 * | 4/2002 | Sawamura et al. | 343/702 |

FOREIGN PATENT DOCUMENTS

| | | |
|---|---|---|
| CN | 1230800 A | 10/1999 |
| EP | 0902498 A1 | 3/1999 |

(Continued)

OTHER PUBLICATIONS

Chinese Office Action dated Sep. 24, 2004 with English translation.

(Continued)

*Primary Examiner*—Shih-Chao Chen
*Assistant Examiner*—Minh Dieu A
(74) *Attorney, Agent, or Firm*—Stevens, Davis, Miller & Mosher, LLP

(57) ABSTRACT

A high gain built-in antenna for a radio communication terminal with less influence from the human body. This built-in antenna for a radio communication terminal includes bar-shaped second passive element 392 facing antenna elements making up dipole antenna 321. The distance between this second passive element 392 and the antenna elements making up dipole antenna 321 is appropriately set in such a way as to widen the band of the input impedance characteristic by changing mutual impedance between second passive element 392 and the antenna elements making up dipole antenna 321.

111 Claims, 46 Drawing Sheets

FOREIGN PATENT DOCUMENTS

| | | | |
|---|---|---|---|
| EP | 0933832 | A2 | 8/1999 |
| EP | 1075041 | A2 | 2/2001 |
| JP | 56000708 | | 1/1981 |
| JP | 56000711 | | 1/1981 |
| JP | 60240201 | | 11/1985 |
| JP | 61205004 | | 9/1986 |
| JP | 02056101 | | 2/1990 |
| JP | 06232625 | | 8/1994 |
| JP | 06260826 | | 9/1994 |
| JP | 07142921 | | 6/1995 |
| JP | 07226624 | | 8/1995 |
| JP | 09326632 | | 12/1997 |
| JP | 10041721 | | 2/1998 |
| JP | 11027041 | | 1/1999 |
| JP | 11154815 | | 6/1999 |
| JP | 11317609 | | 11/1999 |
| JP | 11330842 | | 11/1999 |
| JP | 2000031721 | | 1/2000 |
| JP | 2000134025 | | 5/2000 |
| WO | 9940647 | | 8/1999 |
| WO | 0035048 | | 6/2000 |
| WO | 0148860 | | 7/2001 |

OTHER PUBLICATIONS

Supplementary Partial European Search Report dated Dec. 13, 2002.

Patent Abstracts of Japan; vol. 012, No. 476 (E-693), Dec. 13, 1988, & JP 63 194424 A (Seiko Epson Corp), Aug. 11, 1988, abstract.

Patent Abstracts of Japan; vol. 1997, No. 04, Apr. 30, 1997 & JP 08 335819 A (Sawatani Kunio; Matsushita Electric Industrial Co., Ltd.), Dec. 17, 1996, abstract.

International Search Report dated Dec. 11, 2001.

Supplementary European Search Report dated Mar. 6, 2003.

Patent Abstracts of Japan; vol. 1998, No. 06, Apr. 30, 1998 & JP 10 051223 A (Matsushita Electric Industrial Co Ltd), Feb. 20, 1998, abstract.

* cited by examiner

BUILT-IN ANTENNA FOR RADIO COMMUNICATION TERMINAL

This application is a 371 of PCT/JP01/07453 Aug. 30, 2001.

TECHNICAL FIELD

The present invention relates to a built-in antenna used for a radio communication terminal.

BACKGROUND ART

In order to improve portability, miniaturization of radio communication terminals is being promoted in recent years. In line with this, miniaturization is also required for built-in antennas used for radio communication terminals. As a conventional built-in antenna that meets this requirement, a tabular reverse F-figured antenna is used. A built-in antenna used for a conventional radio communication terminal will be explained below.

FIG. 1 is a schematic view showing a configuration of a built-in antenna used for a conventional radio communication terminal. The elements shown in FIG. 1 are mounted in a package of a radio communication terminal, but an overall view of the radio communication terminal will be omitted for simplicity of explanation. As shown in FIG. 1, the conventional radio communication terminal is provided with base plate 1 and tabular reverse F-figured antenna 2. X, Y and Z denote their respective coordinate axes.

Furthermore, the above-described conventional built-in antenna is also used as a diversity antenna to handle variations in the radio wave reception field intensity through multi-paths. FIG. 2 is a schematic view showing a configuration of a diversity antenna used for the conventional radio communication terminal. As shown in FIG. 2, this configuration includes monopole antenna 3 as an external antenna in addition to above-described conventional tabular reverse F-figured antenna 2. Diversity reception is carried out using two antennas; tabular reverse F-figured antenna 2, which is an internal antenna, and monopole antenna 3, which is an external antenna, thereby providing stable communications.

However, in the case of the tabular reverse F-figured antenna used for the conventional radio communication terminal, tabular reverse F-figured antenna 2 operates as an exciter to excite base plate 1 rather than as an antenna. For this reason, an antenna current flows into base plate 1, and therefore the base plate becomes dominant as the antenna. As a result, tabular reverse F-figured antenna 2 used for the conventional radio communication terminal has a problem that gain is reduced due to the influence of the user's body of the above-described radio communication terminal.

Here, a specific example of the reception characteristic of tabular reverse F-figured antenna 2 used for the above-described conventional radio communication terminal will be explained with reference to FIG. 3A and FIG. 3B. FIG. 3A and FIG. 3B illustrate measured values of the reception characteristic of a tabular reverse F-figured antenna used for the conventional radio communication terminal. Here, the size of base plate 1 is assumed to be 120×36 mm and the frequency is assumed to be 2180 MHz.

First, FIG. 3A illustrates the reception characteristic of the horizontal plane (X-Y plane) in a free space of tabular reverse F-figured antenna 2 used for the conventional radio communication terminal. In this case, since base plate 1 operates as an antenna, tabular reverse F-figured antenna 2 is almost nondirectional as shown in FIG. 3A.

On the other hand, FIG. 3B illustrates the reception characteristic of the horizontal plane (X-Y plane) during a conversation of tabular reverse F-figured antenna 2 used for the conventional radio communication terminal. Here, suppose radio communication terminal is used in a condition as shown in FIG. 4. That is, radio communication terminal 4 provided with tabular reverse F-figured antenna 2 and monopole antenna 3 is used for a conversation by user 5 in the condition shown in FIG. 4.

As is apparent from FIG. 3B, the gain of tabular reverse F-figured antenna 2 is reduced during a conversation. It is obvious from a comparison between FIG. 3A and FIG. 3B that the reduction of gain of tabular reverse F-figured antenna 2 is influenced by the human body, for example, interruption of radio waves by the user's head or hands.

Then, a specific example of the radiation characteristic of tabular reverse F-figured antenna 2 used for the above-described conventional radio communication terminal will be explained with reference to FIG. 5A and FIG. 5B. FIG. 5A and FIG. 5B illustrate measured values of the radiation characteristic of the tabular reverse F-figured antenna used for the conventional radio communication terminal.

First, FIG. 5A illustrates a radiation characteristic of the horizontal plane (X-Y plane) in a free space of tabular reverse F-figured antenna 2 used for the conventional radio communication terminal. In this case, base plate 1 operates as an antenna, and therefore tabular reverse F-figured antenna 2 is almost nondirectional as shown in FIG. 5A.

On the other hand, FIG. 5B illustrates a radiation characteristic of the horizontal plane (X-Y plane) during a conversation of tabular reverse F-figured antenna 2 used for the conventional radio communication terminal. Here, suppose the radio communication terminal is used in a condition as shown in FIG. 4. As is apparent from FIG. 5B, the gain of tabular reverse F-figured antenna 2 during a conversation is reduced. It is obvious from a comparison between FIG. 5A and FIG. 5B that such a reduction of gain of tabular reverse F-figured antenna 2 is caused by the influence of the human body, for example, the influence of interception of radio waves by the user's head or hands.

As shown above, tabular reverse F-figured antenna 2 used for the above-described conventional radio communication terminal has a problem that gain is reduced by the influence of the human body.

Furthermore, with respect to a diversity antenna used for the above-described conventional radio communication terminal, operating tabular reverse F-figured antenna 2 also involves problems similar to those shown above.

DISCLOSURE OF INVENTION

It is an object of the present invention to provide a built-in antenna for a small-sized, high gain radio communication terminal with less influence of the human body.

A first subject of the present invention is to minimize an antenna current flowing into a radio equipment base plate and reduce the influence of the human body during a conversation by providing a dipole antenna for the radio communication terminal and supplying power to the dipole antenna through balanced/unbalanced conversion means having an impedance conversion function.

A second subject of the present invention is to allow the antenna to have directivity opposite to the direction of the human body during a conversation by providing a first passive element in parallel to the longitudinal direction of an antenna element making up the dipole antenna and appropriately adjusting the length in the longitudinal direction of the antenna element making up the dipole antenna, the length in the longitudinal direction of the first passive element and the distance between the antenna element making up the dipole antenna and the first passive element.

A third subject of the present invention is to widen the band of input impedance of the built-in antenna for a radio communication terminal by placing a second passive element facing the antenna element making up the dipole antenna and appropriately setting the distance between this second passive element and the antenna element making up the dipole antenna by changing mutual impedance between the second passive element and the dipole antenna.

BEST MODE FOR CARRYING OUT THE INVENTION

With reference now to the attached drawings, embodiments of the present invention will be explained in detail below.

(Embodiment 1)

Figure 6:
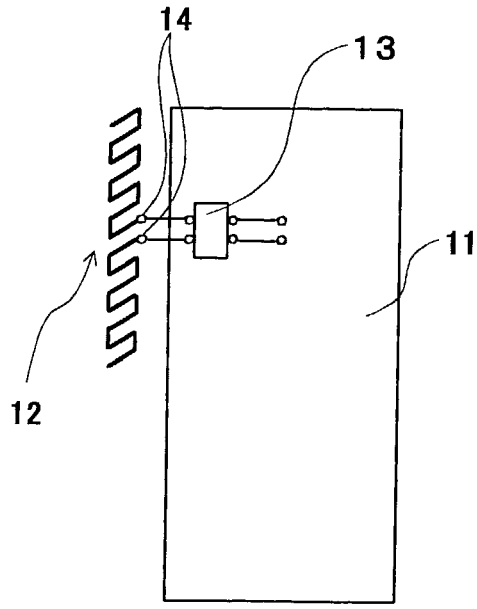
FIG. 6 is a schematic view showing a configuration of a built-in antenna for a radio communication terminal according to Embodiment 1 of the present invention.

FIG. 6 is a schematic view showing a configuration of a built-in antenna for a radio communication terminal according to Embodiment 1 of the present invention. The components shown in FIG. 6 are mounted in the package of the radio communication terminal, but an overall view of the radio communication terminal will be omitted for simplicity of explanation.

The built-in antenna for a radio communication terminal according to this embodiment is constructed of base plate 11, dipole antenna 12, balance-to-unbalance transformation circuit 13 and power supply terminals 14. The components will be explained below.

Base plate 11 is a tabular grounded conductor and attached in parallel to the plane (vertical plane) provided with operation buttons, a display and a speaker, etc. (not shown) in the radio communication terminal.

Dipole antenna 12 is constructed of two rectangular-wave-shaped (comb-shaped) antenna elements. This reduces the size of the dipole antenna. The two antenna elements making up dipole antenna 12 are placed in such a way that their respective centerlines in the longitudinal direction form one straight line.

Furthermore, dipole antenna 12 is attached in such a way that the longitudinal direction of the antenna elements is perpendicular to the upper surface (horizontal plane) of the radio communication terminal. As a result, dipole antenna 12 is provided in such a way that the longitudinal direction of the antenna elements is perpendicular to the horizontal plane. This allows dipole antenna 12 to mainly receive vertically polarized waves parallel to the longitudinal direction of this dipole antenna 12 in a free space. Furthermore, the human body acts as a reflector during a conversation, and therefore dipole antenna 12 has directivity opposite to the direction of the human body.

Balance-to-unbalance transformation circuit 13 is a conversion circuit having a 1-to-1 or n-to-1 (n: integer) impedance conversion ratio and attached to power supply terminals 14 of dipole antenna 12. That is, one terminal of balance-to-unbalance transformation circuit 13 is connected to a transmission/reception circuit (not shown) and the other terminal is attached to base plate 11. In this way, balance-to-unbalance transformation circuit 13 performs impedance conversion between dipole antenna 12 and the above-described transmission/reception circuit, and can thereby achieve impedance matching between the two appropriately. Furthermore, balance-to-unbalance transformation circuit 13 transforms an unbalanced signal of the above-described transmission/reception circuit to a balanced signal and then supplies to dipole antenna 12, and can thereby reduce the current that flows into base plate 11 to a minimum. This prevents the action of base plate 11 as an antenna and makes it possible to suppress a reduction of gain of dipole antenna 12 due to influence of the human body.

Then, an operation of the built-in antenna for a radio communication terminal in the above-described configuration will be explained. The unbalanced signal from the above-described transmission/reception circuit is transformed to a balanced signal by balance-to-unbalance transformation circuit 13 and then sent to dipole antenna 12. Dipole antenna 12 supplied power in this way sends mainly vertically polarized waves parallel to the longitudinal direction of this dipole antenna 12. On the other hand, during reception, vertically polarized waves parallel to the above-described longitudinal direction are received. Therefore, vertically polarized waves from all directions centered on dipole antenna 12 are received in a free space, whereas during a conversation the human body acts as a reflector as described above, and therefore of the above-described vertically polarized waves, vertically polarized waves from the direction opposite to the human body are mainly received.

The above-described signal (balanced signal) received by dipole antenna 12 is sent to the above-described transmission/reception circuit through balance-to-unbalance transformation circuit 13. Here, above-described balance-to-unbalance transformation circuit 13 reduces the current flowing into base plate 11 to a minimum, which prevents the antenna operation by base plate 11. This minimizes a reduction of gain due to influence of the human body.

Figure 7:
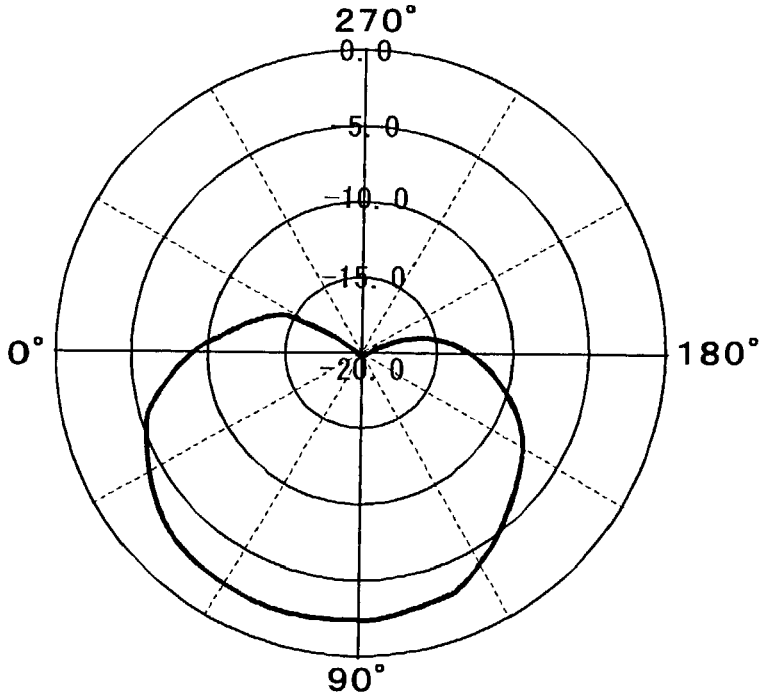
FIG. 7 illustrates measured values of a reception characteristic during a conversation of the built-in antenna for a radio communication terminal according to Embodiment 1.

Here, the reception characteristic of the built-in antenna for a radio communication terminal in the above-described configuration will be explained with reference to FIG. 7. FIG. 7 illustrates measured values of the reception characteristic during a conversation of the built-in antenna for a radio communication terminal according to this embodiment. Here, suppose the size of base plate 11 is 120×36 mm, the size of dipole antenna 12 is 63×5 mm, the distance from the human body to dipole antenna 12 is 5 mm and the frequency is 2180 MHz. Furthermore, the direction 270° viewed from the origin in FIG. 7 corresponds to the direction of the human body viewed from dipole antenna 12 in FIG. 6.

Figure 1:
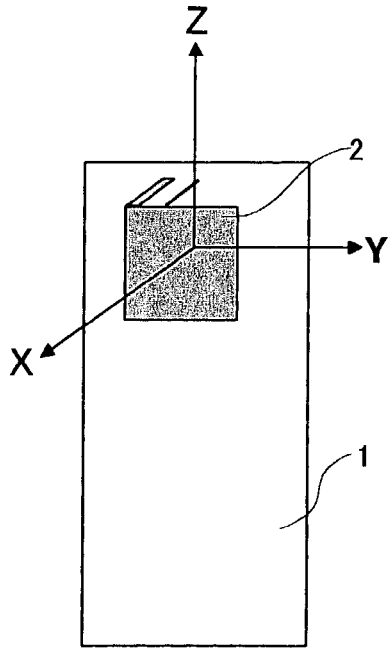
FIG. 1 is a schematic view showing a configuration of a built-in antenna used for a conventional radio communication terminal.
Figure 2:
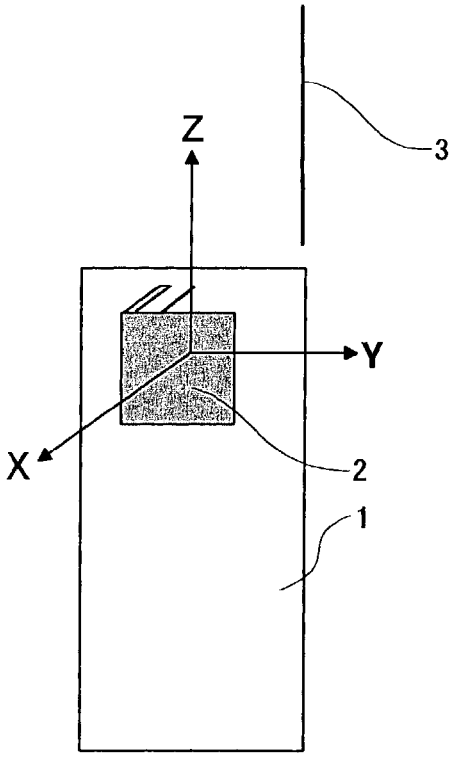
FIG. 2 is a schematic view showing a configuration of a diversity antenna used for a conventional radio communication terminal.
Figure 3A:
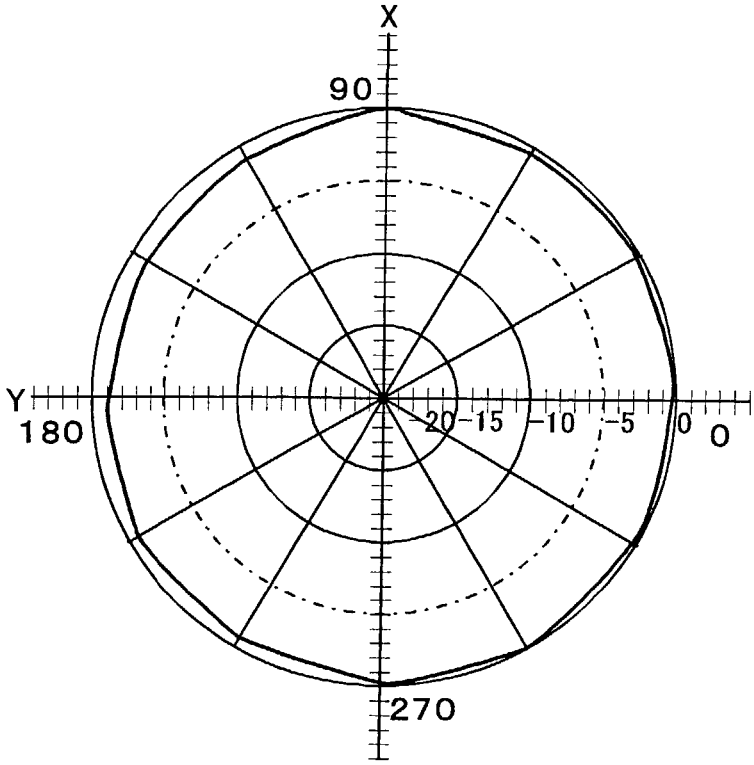
FIG. 3A illustrates a reception characteristic of a tabular reverse F-figured antenna in a free space used for the conventional radio communication terminal.
Figure 3B:
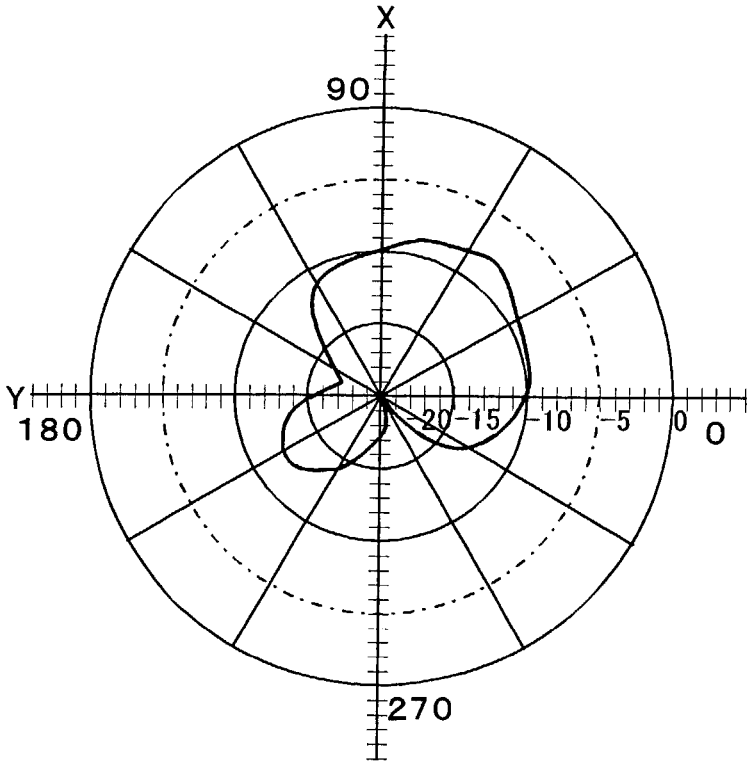
FIG. 3B illustrates a reception characteristic of a tabular reverse F-figured antenna during a conversation used for the conventional radio communication terminal.
Figure 4:
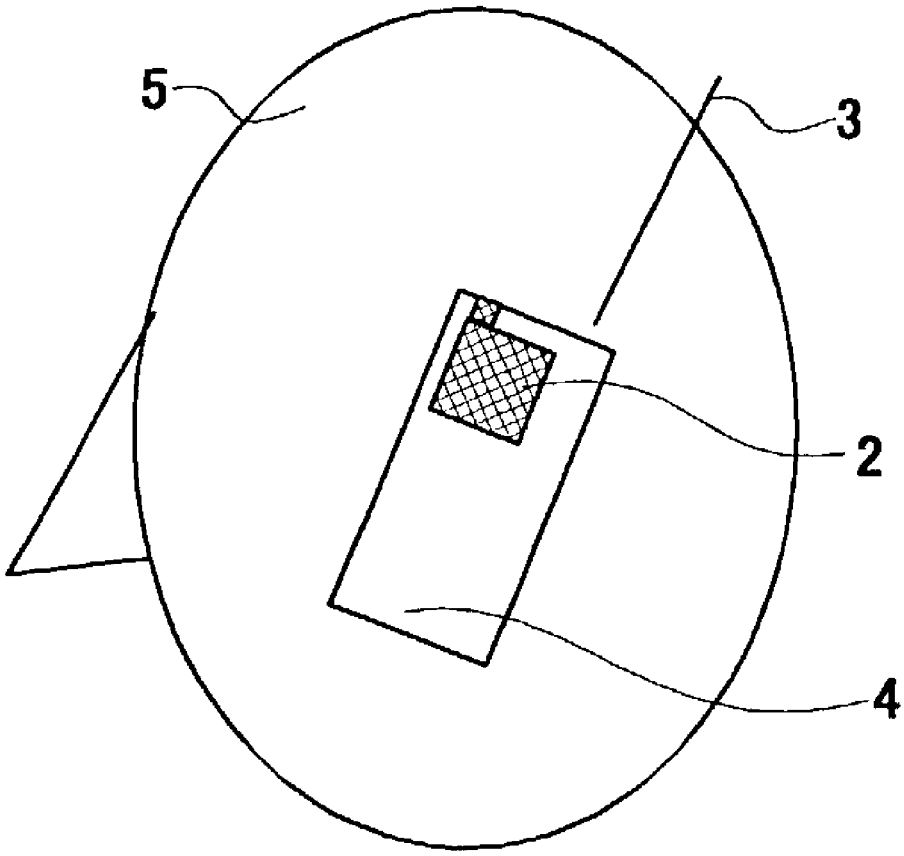
FIG. 4 is a schematic view showing the conventional radio communication terminal during a conversation.

As is apparent from FIG. 7, under the influence of the human body acting as a reflector, dipole antenna 12 has directivity opposite to the direction of the human body, and, for the above-described reason, not only prevents a split of directivity but also has a high gain characteristic compared to the conventional example shown in FIG. 3B.

Thus, according to this embodiment, balance-to-unbalance transformation circuit 13 transforms an unbalanced signal to a balanced signal and can thereby minimize the antenna current flowing into base plate 11, thus making it possible to suppress gain deterioration of dipole antenna 12 due to influence of the human body. Furthermore, constructing dipole antenna 12 with rectangular-wave-shaped antenna elements can reduce the size of the built-in antenna for a radio communication terminal. Therefore, this embodiment can provide a high gain, small-sized built-in antenna for a radio communication terminal less influence of the human body.

(Embodiment 2)

Embodiment 2 is a mode in which the method of mounting dipole antenna 12 in Embodiment 1 is changed. Since Embodiment 2 is the same as Embodiment 1 except the method of mounting the dipole antenna, detailed explanations thereof will be omitted. Hereafter, differences from Embodiment 1 of the built-in antenna for a radio communication terminal according to this embodiment will be explained using FIG. 8. Components similar to those in Embodiment 1 are assigned the same reference numerals and detailed explanations thereof will be omitted.

Figure 8:
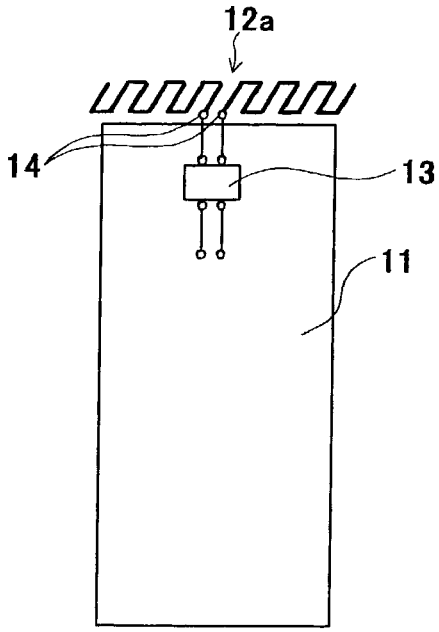
FIG. 8 is a schematic view showing a configuration of a built-in antenna for a radio communication terminal according to Embodiment 2 of the present invention.

FIG. 8 is a schematic view showing a configuration of the built-in antenna for a radio communication terminal according to Embodiment 2 of the present invention. As shown in this figure, the built-in antenna for a radio communication terminal according to Embodiment 2 is constructed of base plate 11, dipole antenna 12*a*, balance-to-unbalance transformation circuit 13 and power supply terminals 14.

Dipole antenna 12*a* is attached in such a way that the longitudinal direction of the antenna elements is parallel to the upper surface (horizontal plane) of the radio communication terminal. That is, this embodiment is different from Embodiment 1 in that the longitudinal direction of dipole antenna 12*a* is parallel to the upper surface (horizontal plane) of the radio communication terminal.

This allows dipole antenna 12*a* to suppress deterioration of gain and receive mainly horizontally polarized waves parallel to the longitudinal direction of this dipole antenna 12*a*. By the way, a signal sent from the other end of communication is a mixture of vertically polarized waves and horizontally polarized waves due to various factors such as reflection. Thus, when there are more horizontally polarized waves, the longitudinal direction of the antenna matches the polarization plane, which makes it possible to increase the reception gain.

According to this embodiment, dipole antenna 12*a* is mounted in such a way that the longitudinal direction of the antenna elements is parallel to the upper surface of the radio communication terminal, which makes it possible not only to suppress deterioration of gain caused by influence from the human body but also to mainly receive horizontally polarized waves. This makes it possible to prevent deterioration of gain due to mismatch between the longitudinal direction of the antenna and the polarization plane of the signal from the other end of communication and provide a high gain and small built-in antenna for a radio communication terminal with less influence from the human body.

(Embodiment 3)

Embodiment 3 is a mode in which the configuration and method of mounting of dipole antenna 12 in Embodiment 1 is changed. Since Embodiment 3 is the same as Embodiment 1 except for the configuration and method of mounting of the dipole antenna, detailed explanations thereof will be omitted. Differences of the built-in antenna for a radio communication terminal according to this embodiment from Embodiment 1 will be explained below using FIG. 9. The parts similar to those in Embodiment 1 are assigned the same reference numerals and detailed explanations thereof will be omitted.

Figure 9:
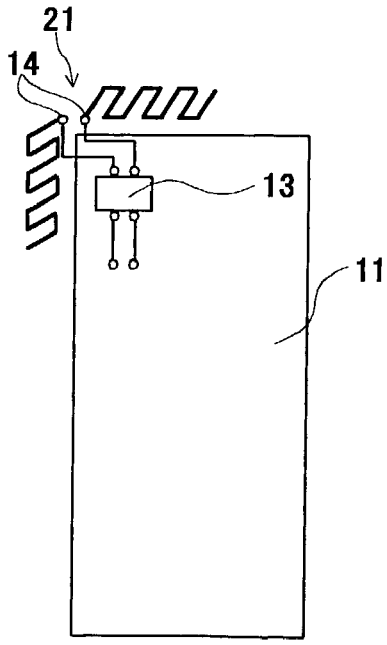
FIG. 9 is a schematic view showing a configuration of a built-in antenna for a radio communication terminal according to Embodiment 3 of the present invention.

FIG. 9 is a schematic diagram showing a configuration of the built-in antenna for a radio communication terminal according to Embodiment 3 of the present invention. As shown in this figure, the built-in antenna for a radio communication terminal according to Embodiment 3 is constructed of base plate 11, dipole antenna 21, balance-to-unbalance transformation circuit 13 and power supply terminals 14. The two antenna elements making up dipole antenna 21 are placed in such a way that the longitudinal directions are perpendicular to each other.

Dipole antenna 21 is mounted in such a way that the longitudinal direction of one antenna element is perpendicular to the upper surface (horizontal plane) of the radio communication terminal and the longitudinal direction of the other antenna element is parallel to the upper surface (horizontal plane) of the radio communication terminal.

Then, the operation of the built-in antenna for a radio communication terminal in the above configuration will be explained. An unbalanced signal from the transmission/reception circuit above is transformed to a balanced signal by balance-to-unbalance transformation circuit 13 and then sent to dipole antenna 21. The antenna element placed perpendicular to the upper surface (horizontal plane) of the radio communication terminal that makes up dipole antenna 21 supplied with power in this way mainly sends vertically polarized waves parallel to the longitudinal direction of this antenna element. Furthermore, during reception, vertically polarized waves parallel to the longitudinal direction above are received. On the other hand, the antenna element placed in parallel to the upper surface (horizontal plane) of the radio communication terminal that makes up dipole antenna 21 supplied with power in the same way mainly sends horizontally polarized waves parallel to the longitudinal direction of this antenna element. Furthermore, during reception, horizontally polarized waves parallel to the longitudinal direction above are received. Therefore, in a free space, vertically and horizontally polarized waves from all directions centered on dipole antenna 21 are received. During a conversation, since the human body acts as a reflector as described above, of the vertically polarized waves and horizontally polarized waves above, the vertically polarized waves and horizontally polarized waves opposite to the human body are mainly received.

This allows dipole antenna 21 to suppress deterioration of gain and receive both vertically polarized waves and horizontally polarized waves parallel to the longitudinal direction of the respective antenna elements. On the other hand, a signal sent from the other end of communication is a mixture of vertically polarized waves and horizontally polarized waves due to various factors such as reflection. Thus, even if there are more vertically polarized waves or more horizontally polarized waves, the longitudinal direction of either antenna element of the built-in antenna for a radio communication terminal according to this embodiment matches the polarization plane of the signal sent from the other end of communication, making it possible to increase reception gain.

According to this embodiment, balance-to-unbalance transformation circuit 13 can minimize the antenna current that flows into base plate 11 and can thereby suppress deterioration of gain of the dipole antenna 21 caused by influence from the human body. Furthermore, dipole antenna 21 is constructed of rectangular-wave-shaped antenna elements, making it possible to miniaturize the built-in antenna for a radio communication terminal and provide a high gain and small built-in antenna for a radio communication terminal with less influence from the human body.

(Embodiment 4)

Embodiment 4 is a mode in which the shape of the antenna elements making up dipole antenna 12 and the method of mounting dipole antenna 12 in Embodiment 1 are changed. Since Embodiment 4 is the same as Embodiment 1 except for the shape of the antenna elements and method of mounting the dipole antenna, detailed explanations thereof will be omitted. Differences of the built-in antenna for a radio communication terminal according to this embodiment from Embodiment 1 will be explained below using FIG. 10. The parts similar to those in Embodiment 1 are assigned the same reference numerals and detailed explanations thereof will be omitted.

Figure 10:
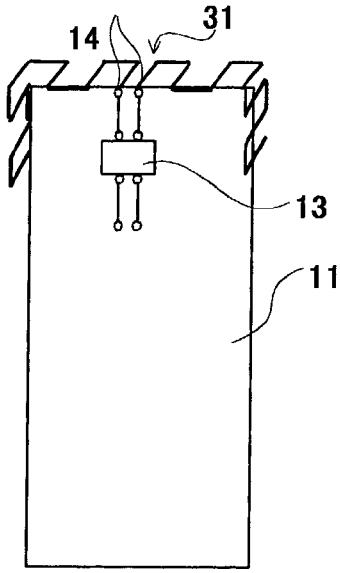
FIG. 10 is a schematic view showing a configuration of a built-in antenna for a radio communication terminal according to Embodiment 4 of the present invention.

FIG. 10 is a schematic diagram showing a configuration of the built-in antenna for a radio communication terminal according to Embodiment 4 of the present invention. As shown in this figure, the built-in antenna for a radio communication terminal according to Embodiment 4 is constructed of base plate 11, dipole antenna 31, balance-to-unbalance transformation circuit 13 and power supply terminals 14. The two antenna elements making up dipole antenna 31 are folded at a point close to the center and the folded planes are formed to be perpendicular to each other. In this case, of the planes perpendicular to each other of the antenna elements, the plane including power supply terminal 14 is called a "first rectangular-wave-shaped plane" and the other plane without power supply terminal 14 is called a "second rectangular-wave-shaped plane".

The antenna elements making up dipole antenna 31 in the above configuration are mounted in such a way that the longitudinal direction of the first rectangular-wave-shaped plane is parallel to the upper surface (horizontal plane) of the radio communication terminal apparatus and the longitudinal direction of the second rectangular-wave-shaped plane is perpendicular to the upper surface (horizontal plane) of the radio communication terminal apparatus.

That is, this embodiment is different from Embodiment 1 in that the longitudinal direction of the first rectangular-wave-shaped plane of dipole antenna 31 is parallel to the upper surface of the radio communication terminal apparatus and the longitudinal direction of the second rectangular-wave-shaped plane is perpendicular to the upper surface of the radio communication terminal apparatus. As a result, as in the case of Embodiment 3, during a conversation, dipole antenna 31 is provided in such a way that the longitudinal direction of part (first rectangular-wave-shaped plane) is parallel to the upper surface (horizontal plane) of the radio communication terminal and the longitudinal direction of the other part (second rectangular-wave-shaped plane above) is perpendicular to the upper surface (horizontal plane) of the radio communication terminal.

Thus, this embodiment configured as shown above can also attain effects similar to those of Embodiment 3.

Embodiment 5 to Embodiment 11 below are modes in which a diversity antenna is implemented using the built-in antennas for a radio communication terminal according to Embodiment 1 to Embodiment 4.

(Embodiment 5)

Embodiment 5 is a mode in which a diversity antenna is implemented using the built-in antenna for a radio communication terminal according to Embodiment 1. The diversity antenna for a radio communication terminal according to this embodiment will be explained below using FIG. 11. The components similar to those in Embodiment 1 are assigned the same reference numerals and detailed explanations thereof will be omitted.

Figure 11:
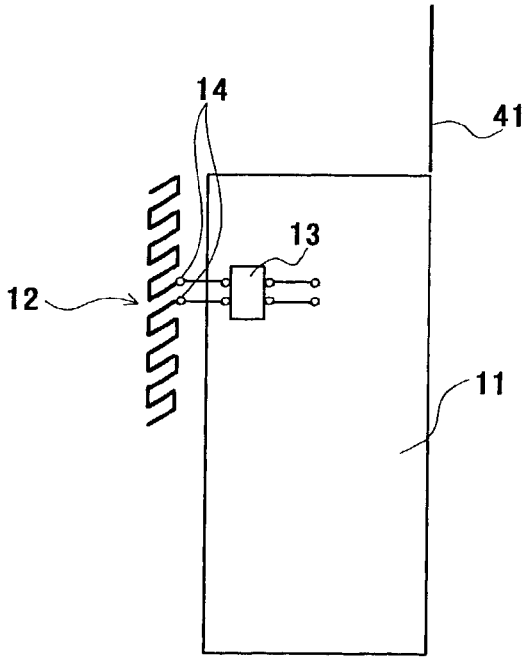
FIG. 11 is a schematic view showing a configuration of a diversity antenna for a radio communication terminal according to Embodiment 5 of the present invention.

FIG. 11 is a schematic diagram showing a configuration of the diversity antenna for a radio communication terminal according to Embodiment 5 of the present invention. In FIG. 11, monopole antenna 41 is added to the configuration of the built-in antenna for a radio communication terminal according to Embodiment 1.

Here, suppose one antenna making up the diversity antenna is dipole antenna 12 in Embodiment 1 and used for reception only. Also suppose the other antenna making up the diversity antenna is monopole antenna 41 and used for both transmission and reception.

In the diversity antenna for a radio communication terminal in the above configuration, only monopole antenna 41 operates during transmission and both dipole antenna 12 and monopole antenna 41 operate during reception to carry out diversity reception.

Thus, according to this embodiment, dipole antenna 12 in Embodiment 1 is used as the diversity antenna, which makes it possible to provide a high gain and small diversity antenna for a radio communication terminal with less influence from the human body as in the case of Embodiment 1.

(Embodiment 6)

Embodiment 6 is a mode in which the configuration of monopole antenna 41 in Embodiment 5 is changed. The diversity antenna for a radio communication terminal according to this embodiment will be explained using FIG. 12. The same components as those in Embodiment 5 are assigned the same reference numerals and detailed explanations thereof will be omitted.

Figure 12:
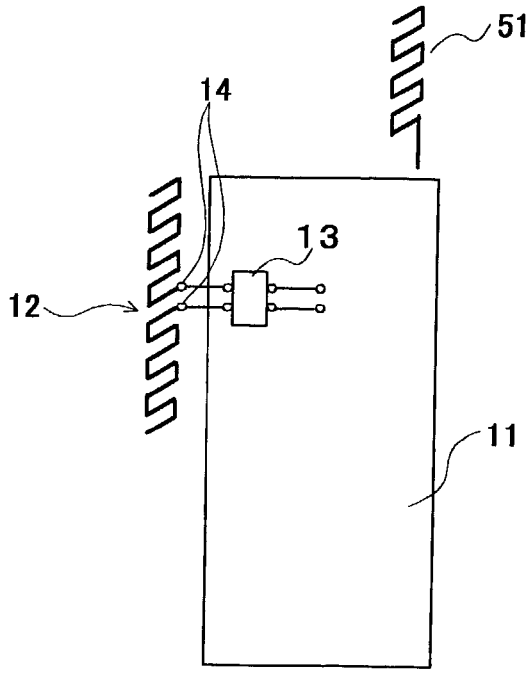
FIG. 12 is a schematic view showing a configuration of a diversity antenna for a radio communication terminal according to Embodiment 6 of the present invention.

FIG. 12 is a schematic diagram showing a configuration of the diversity antenna for a radio communication terminal according to Embodiment 6 of the present invention. As shown in FIG. 12, the diversity antenna for a radio communication terminal according to this embodiment is constructed of base plate 11, dipole antenna 12, balance-to-unbalance transformation circuit 13, power supply terminals 14 and monopole antenna 51. Monopole antenna 51 is constructed of a rectangular-wave-shaped antenna element.

In the diversity antenna for a radio communication terminal in the above configuration, only monopole antenna 51 operates during transmission and both dipole antenna 12 and monopole antenna 51 operate during reception to carry out diversity reception.

Thus, according to this embodiment, dipole antenna 12 in Embodiment 1 is used as the diversity antenna, which makes it possible to provide a high gain diversity antenna for a radio communication terminal with less influence from the human body. Furthermore, by providing rectangular-wave-shaped monopole antenna 51, it is possible to miniaturize the external antenna.

(Embodiment 7)

Embodiment 7 is a mode in which the configuration of monopole antenna 41 in Embodiment 5 is changed. The diversity antenna for a radio communication terminal according to this embodiment will be explained using FIG. 13. The components similar to those in Embodiment 5 are assigned the same reference numerals and detailed explanations thereof will be omitted.

Figure 13:
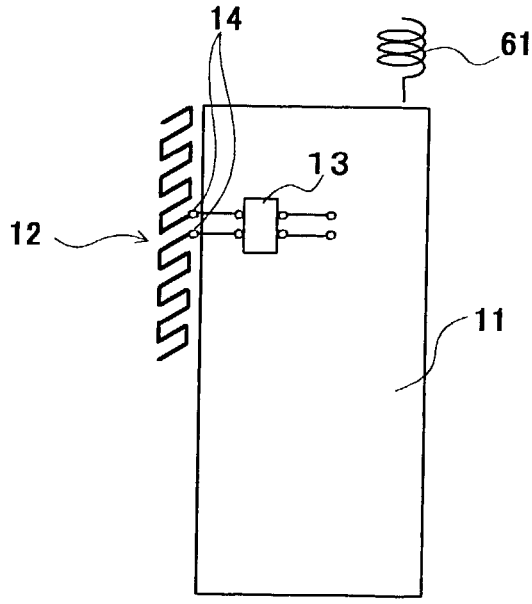
FIG. 13 is a schematic view showing a configuration of a diversity antenna for a radio communication terminal according to Embodiment 7 of the present invention.

FIG. 13 is a schematic diagram showing a configuration of the diversity antenna for a radio communication terminal according to Embodiment 7 of the present invention. As shown in this figure, the diversity antenna for a radio communication terminal according to Embodiment 7 is constructed of base plate 11, dipole antenna 12, balance-to-unbalance transformation circuit 13, power supply terminals 14 and monopole antenna 61. Monopole antenna 61 is constructed of a spiral-shaped antenna element.

In the diversity antenna for a radio communication terminal in the above configuration, only monopole antenna 61 operates during transmission and both dipole antenna 12 and monopole antenna 61 operate during reception to carry out diversity reception.

Thus, this embodiment configured as shown above can also attain effects similar to those in Embodiment 6.

(Embodiment 8)

Embodiment 8 is a mode in which a diversity antenna is implemented using the built-in antenna for a radio communication terminal in Embodiment 1. The diversity antenna for a radio communication terminal according to this embodiment will be explained using FIG. 14. The components similar to those in Embodiment 1 are assigned the same reference numerals and detailed explanations thereof will be omitted.

Figure 14:
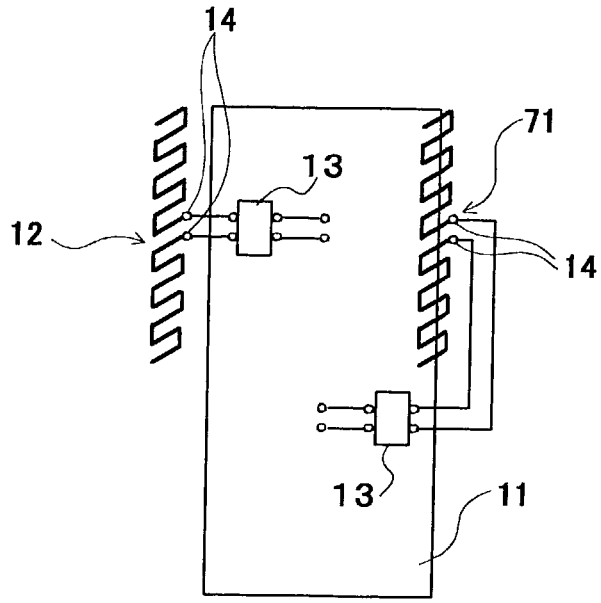
FIG. 14 is a schematic view showing a configuration of a diversity antenna for a radio communication terminal according to Embodiment 8 of the present invention.

FIG. 14 is a schematic diagram showing a configuration of the diversity antenna for a radio communication terminal according to Embodiment 8 of the present invention. As shown in this figure, this embodiment has a configuration of the built-in antenna for a radio communication terminal according to Embodiment 1 with another dipole antenna 71 added to one side of base plate 11. Dipole antenna 71 has a configuration similar to that of dipole antenna 12.

Here, suppose one antenna making up the diversity antenna is dipole antenna 12 in Embodiment 1 and used for reception only. Suppose the other antenna making up the diversity antenna is dipole antenna 71 and used for both transmission and reception.

In the diversity antenna for a radio communication terminal in the above configuration, only dipole antenna 71 operates during transmission and both dipole antenna 12 and dipole antenna 71 operate during reception to carry out diversity reception.

Thus, according to this embodiment, dipole antenna 12 in Embodiment 1 and dipole antenna 71, which is constructed in the same way as dipole antenna 12 are used as the diversity antenna, and it is therefore possible to provide a high gain diversity antenna for a radio communication terminal with less influence from the human body. Moreover, adopting rectangular-wave-shaped dipole antenna 71 in the same way as for dipole antenna 12 makes it possible to reduce the size of the diversity antenna.

(Embodiment 9)

Embodiment 9 is a mode in which the method of mounting dipole antenna 71 in Embodiment 8 is changed. Since Embodiment 9 is the same as Embodiment 8 except for the method of mounting the dipole antenna, detailed explanations thereof will be omitted. Differences of the built-in antenna for a radio communication terminal according to this embodiment from Embodiment 8 will be explained below using FIG. 15. The parts similar to those in Embodiment 8 are assigned the same reference numerals and detailed explanations thereof will be omitted.

Figure 15:
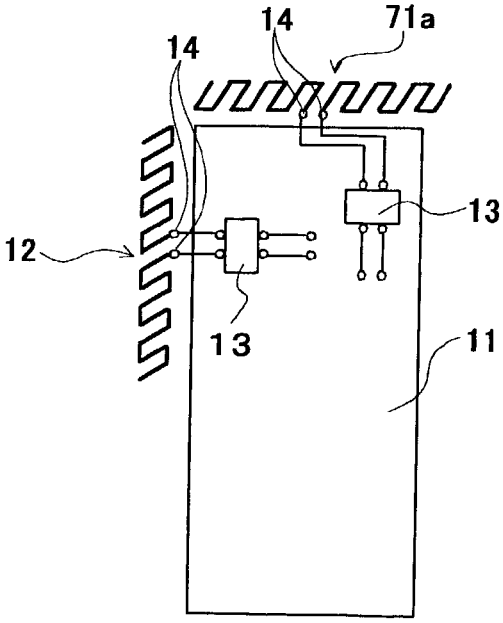
FIG. 15 is a schematic view showing a configuration of a built-in antenna for a radio communication terminal according to Embodiment 9 of the present invention.

FIG. 15 is a schematic diagram showing a configuration of the built-in antenna for a radio communication terminal according to Embodiment 9 of the present invention. As shown in this figure, additional dipole antenna 71*a* is mounted in such a way that the longitudinal direction thereof is parallel to the upper surface (horizontal plane) of the radio communication terminal. That is, this embodiment is different from Embodiment 8 in that the longitudinal direction of dipole antenna 71*a* is parallel to the upper surface (horizontal plane) of the radio communication terminal. As a result, dipole antenna 71*a* is provided in such a way that the longitudinal direction forms right angles with respect to the human body and at the same time is parallel to the horizontal plane during a conversation.

In the diversity antenna for a radio communication terminal in the above configuration, only dipole antenna 71*a* operates during transmission and both dipole antenna 12 and dipole antenna 71*a* operate during reception to carry out diversity reception.

Thus, dipole antenna 12 can suppress deterioration of gain and at the same time mainly receive vertically polarized waves parallel to the longitudinal direction of the antenna element. Furthermore, dipole antenna 71*a* can not only suppress deterioration of gain but also mainly receive horizontally polarized waves parallel to the longitudinal direction of the antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the longitudinal direction of either dipole antenna 12 or 71*a* matches the plane of polarization of the signal sent from the other end of communication, and therefore it is possible to increase the reception gain.

Thus, this embodiment uses dipole antenna 12 in Embodiment 1 and dipole antenna 71*a* configured in the same way as dipole antenna 12 as the diversity antenna, and can thereby provide a high gain diversity antenna for a radio communication terminal with less influence from the human body. Moreover, constructing rectangular-wave-shaped dipole antenna 71*a* in the same way as for dipole antenna 12 can reduce the size of the diversity antenna.

(Embodiment 10)

Figure 16:
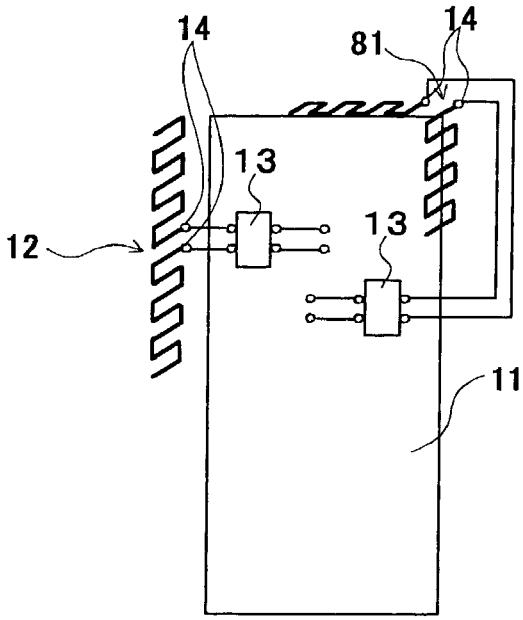
FIG. 16 a schematic view showing a configuration of a diversity antenna for a radio communication terminal according to Embodiment 10 of the present invention.

As shown in FIG. 16, Embodiment 10 is a mode in which dipole antenna 71 used for both transmission and reception in Embodiment 8 is changed to dipole antenna 81 constructed in the same way as dipole antenna 21 in Embodiment 3. Embodiment 10 is the same as Embodiment 8 except for the configuration and method of mounting of dipole antenna 81. The parts in FIG. 16 similar to those in Embodiment 8 are assigned the same reference numerals and detailed explanations thereof will be omitted.

FIG. 16 is a schematic diagram showing a configuration of the diversity antenna for a radio communication terminal according to Embodiment 10 of the present invention. As shown in this figure, dipole antenna 81 is mounted in such a way that the longitudinal direction of one antenna element is perpendicular to the upper surface (horizontal plane) of the radio communication terminal and the longitudinal direction of the other antenna element is parallel to the upper surface (horizontal plane) of the radio communication terminal.

In the diversity antenna for a radio communication terminal in the above configuration, only dipole antenna 81 operates during transmission and both dipole antenna 12 and dipole antenna 81 operate during reception to carry out diversity reception.

Thus, dipole antenna 81 can suppress deterioration of gain and at the same time mainly receive vertically polarized waves and horizontally polarized waves parallel to the longitudinal direction of the respective antenna elements. Furthermore, dipole antenna 12 can not only suppress deterioration of gain but also mainly receive vertically polarized waves parallel to the longitudinal direction of the antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the longitudinal direction of dipole antenna 12 or the longitudinal direction of either antenna element of dipole antenna 81 of the built-in antenna for a radio communication terminal according to this embodiment matches the plane of polarization of the signal sent from the other end of communication, and can thereby increase the reception gain.

Thus, this embodiment uses dipole antenna 12 in Embodiment 1 and dipole antenna 81 constructed in the same as dipole antenna 21 in Embodiment 3 as the diversity antenna, and can thereby provide a high gain diversity antenna for a radio communication terminal with less influence from the human body. Moreover, constructing rectangular-wave-shaped dipole antenna 81 as in the case of dipole antenna 12 can reduce the size of the diversity antenna.

(Embodiment 11)

Figure 17:
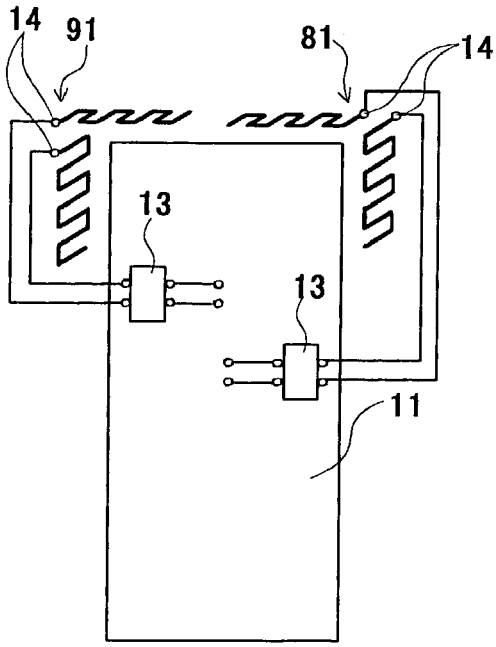
FIG. 17 a schematic view showing a configuration of a diversity antenna for a radio communication terminal according to Embodiment 11 of the present invention.

As shown in FIG. 17, Embodiment 11 is a mode in which dipole antenna 12 used only for reception in Embodiment 10 is changed to dipole antenna 91 constructed in the same as for dipole antenna 21 in Embodiment 3. Embodiment 11 is the same as Embodiment 10 except for the configuration and method of mounting of dipole antenna 91. The parts in FIG. 17 similar to those in Embodiment 10 are assigned the same reference numerals and detailed explanations thereof will be omitted.

FIG. 17 is a schematic diagram showing a configuration of the diversity antenna for a radio communication terminal according to Embodiment 11 of the present invention. As shown in this figure, both dipole antenna 81 and dipole antenna 91 are mounted in such a way that the longitudinal direction of one antenna element is perpendicular to the upper surface (horizontal plane) of the radio communication terminal and the longitudinal direction of the other antenna element is parallel to the upper surface (horizontal plane) of the radio communication terminal.

In the diversity antenna for a radio communication terminal in the above configuration, only dipole antenna 81 operates during transmission and both dipole antenna 81 and dipole antenna 91 operate during reception to carry out diversity reception.

Thus, dipole antenna 81 can suppress deterioration of gain and at the same time mainly receive vertically polarized waves and horizontally polarized waves parallel to the longitudinal direction of the respective antenna elements. Furthermore, dipole antenna 91 can not only suppress deterioration of gain but also mainly receive vertically polarized waves and horizontally polarized waves parallel to the longitudinal direction of the respective antenna elements. On the other hand, the signal sent from the other end of communication is often a mixture of vertically polarized waves and horizontally polarized waves due to various factors such as reflection. Thus, even if there are either more vertically polarized waves or more horizontally polarized waves, the longitudinal direction of either antenna element of dipole antenna 81 and 91 of the built-in antenna for a radio communication terminal according to this embodiment matches the plane of polarization of the signal sent from the other end of communication, and can thereby increase the reception gain.

Thus, this embodiment uses dipole antenna 81 and dipole antenna 91 constructed in the same way as dipole antenna 21 in Embodiment 3 as the diversity antenna, and can thereby provide a high gain diversity antenna for a radio communication terminal with less influence from the human body. Moreover, the use of rectangular-wave-shaped dipole antennas 81 and 91 can reduce the size of the diversity antenna.

(Embodiment 12)

Figure 18:
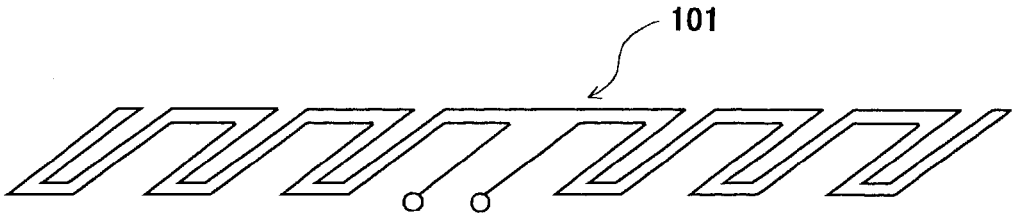
FIG. 18 is a schematic view showing a configuration of a folded-dipole antenna according to Embodiment 12 of the present invention.

FIG. 18 is a schematic diagram showing a configuration of folded-dipole antenna 101 according to Embodiment 12 of the present invention. As shown in this figure, folded-dipole antenna 101 according to Embodiment 12 is formed in such a way that two antenna elements of the rectangular-wave-shaped dipole antenna explained in Embodiment 1 to Embodiment 11 are placed in parallel and the ends of these two antenna elements placed in parallel are shorted.

The folded-dipole antenna 101 in the above configuration is applicable as a dipole antenna in each embodiment of the present Specification.

Thus, applying folded-dipole antenna 101 as the dipole antenna in each embodiment of the present Specification can attain effects similar to those in each embodiment of the present Specification and further step up impedance and perform impedance matching easily.

(Embodiment 13)

Figure 19:
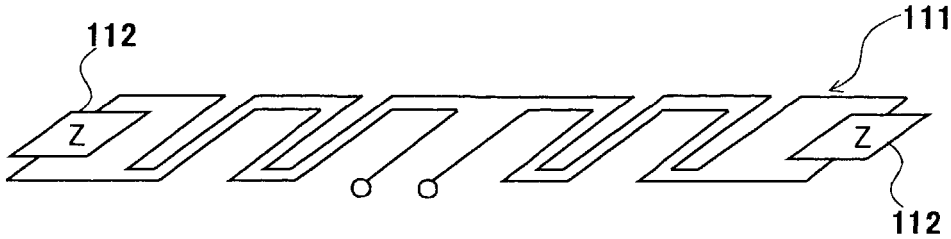
FIG. 19 is a schematic view showing a configuration of a folded-dipole antenna according to Embodiment 13 of the present invention.

Embodiment 13 is a mode in which the configuration of the folded-dipole antenna in Embodiment 12 is changed. Embodiment 13 is the same as Embodiment 12 except for the configuration of the dipole antenna. In FIG. 19, the parts similar to those in Embodiment 1 to Embodiment 11 are assigned the same reference numerals and detailed explanations thereof will be omitted.

FIG. 19 is a schematic diagram showing a configuration of folded-dipole antenna 11 in Embodiment 13 of the present invention. As shown in this figure, folded-dipole antenna 111 according to Embodiment 13 is formed in such a way that two rectangular-wave-shaped dipole antenna elements explained in Embodiment 1 to Embodiment 11 are placed in parallel and impedance elements 112 are attached to the ends of these two antenna elements placed in parallel.

Folded-dipole antenna 111 in the above configuration is applicable as a dipole antenna in each embodiment of the present Specification.

Thus, applying folded-dipole antenna 111 as the dipole antenna in each embodiment of the present Specification can attain effects similar to those in each embodiment of the present Specification, further step up impedance and perform impedance matching easily. Furthermore, using folded-dipole antenna 111 in the above configuration as the dipole antenna can further widen the band and reduce the size of the antenna.

(Embodiment 14)

Embodiment 14 is a mode in which the configuration of the dipole antenna in each embodiment of the present Specification is changed. Embodiment 14 is the same as Embodiment 12 except for the configuration and method of mounting of the dipole antenna.

Figure 20:
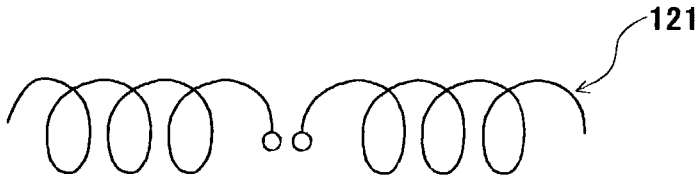
FIG. 20 is a schematic view showing a configuration of a dipole antenna according to Embodiment 14 of the present invention.

FIG. 20 is a schematic diagram showing a configuration of dipole antenna 121 used in Embodiment 14 of the present invention. As shown in this figure, dipole antenna 121 according to Embodiment 14 is constructed of two spiral-shaped antenna elements. The two spiral-shaped antenna elements making up dipole antenna 121 are placed in such a way that the respective centerlines in the longitudinal direction form one straight line.

Dipole antenna 121 in the above configuration is applicable as a dipole antenna in each embodiment of the present Specification.

Thus, this embodiment can further reduce the size of the antenna by constructing a dipole antenna with spiral-shaped antenna elements.

(Embodiment 15)

Embodiment 15 is a mode in which the configuration of the dipole antenna in each embodiment of the present Specification is changed. Embodiment 15 is the same as Embodiment 12 except for the configuration and the method of mounting the dipole antenna.

Figure 21:
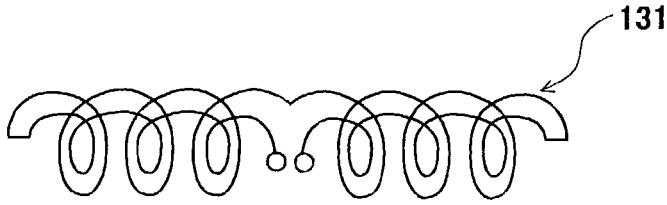
FIG. 21 is a schematic view showing a configuration of a folded-dipole antenna according to Embodiment 15 of the present invention.

FIG. 21 is a schematic diagram showing a configuration of folded-dipole antenna 131 in Embodiment 15 of the present invention. As shown in this figure, folded-dipole antenna 131 according to Embodiment 15 is formed in such a way that the two spiral-shaped dipole antenna elements described in Embodiment 14 are placed in parallel and the ends of these two antenna elements are shorted.

The folded-dipole antenna 131 in the above configuration is applicable as a dipole antenna in each embodiment of the present Specification.

Thus, by applying folded-dipole antenna 131 as the dipole antenna in each embodiment of the present Specification, this embodiment can achieve effects similar to those in each embodiment of the present Specification, step up impedance and perform impedance matching easily. Furthermore, adopting folded-dipole antenna 131 in the above configuration as the dipole antenna can further reduce the size of the antenna.

(Embodiment 16)

Embodiment 16 is a mode in which the configuration of the dipole antenna used in Embodiment 15 is changed. Embodiment 16 is the same as Embodiment 15 except for the configuration and method of mounting of the dipole antenna.

Figure 22:
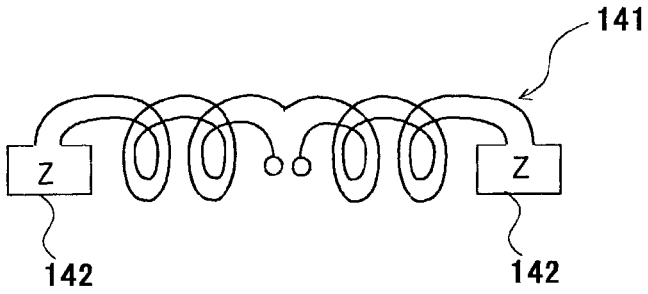
FIG. 22 is a schematic view showing a configuration of a folded-dipole antenna according to Embodiment 16 of the present invention.

FIG. 22 is a schematic diagram showing a configuration of folded-dipole antenna 141 used in Embodiment 16 of the present invention. As shown in this figure, folded-dipole antenna 141 according to Embodiment 16 is formed in such a way that the two spiral-shaped dipole antenna elements described in Embodiment 14 are placed in parallel and impedance elements 142 are attached to the ends of these two antenna elements placed in parallel.

The folded-dipole antenna 141 in the above configuration is applicable as a dipole antenna in each embodiment of the present Specification.

Thus, applying folded-dipole antenna 141 as the dipole antenna makes it possible to achieve effects similar to those in Embodiment 12, widen the band and reduce the size.

By the way, the folded-dipole has a self-balancing action, and therefore a configuration without balance-to-unbalance transformation circuit 13 can also be used in Embodiment 12 to Embodiment 16 (except Embodiment 14).

(Embodiment 17)

Embodiment 17 is a mode in which dipole antenna 12 in Embodiment 1 is placed patterned on circuit board 151.

Figure 23:
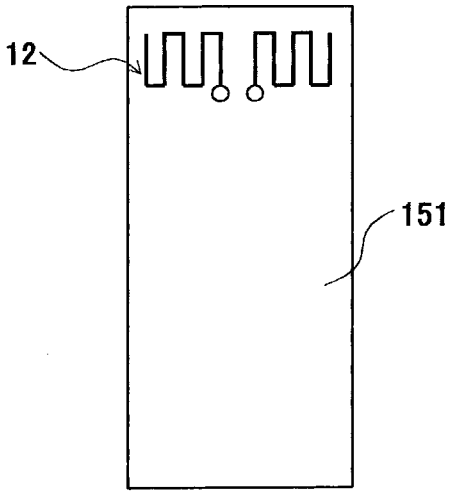
FIG. 23 is a schematic view showing a configuration of a dipole antenna placed on a circuit board according to Embodiment 17 of the present invention.

FIG. 23 is a schematic diagram showing a configuration of dipole antenna 12 placed on circuit board 151 of Embodiment 17 of the present invention. As shown in this figure, dipole antenna 12 is placed patterned on circuit board 151.

Thus, using dipole antenna 12 of Embodiment 1, this embodiment can achieve effects similar to those in Embodiment 1. Furthermore, placing dipole antenna 12 of Embodiment 1 patterned on circuit board 151 makes it possible to obtain a stable characteristic.

By the way, in addition to dipole antenna 12 of Embodiment 1, the dipole antenna of any one of the other embodiments of the present Specification can also be placed patterned on circuit board 151.

(Embodiment 18)

Embodiment 18 is a mode in which dipole antenna 12 in Embodiment 1 is patterned on package case 161.

Figure 24:
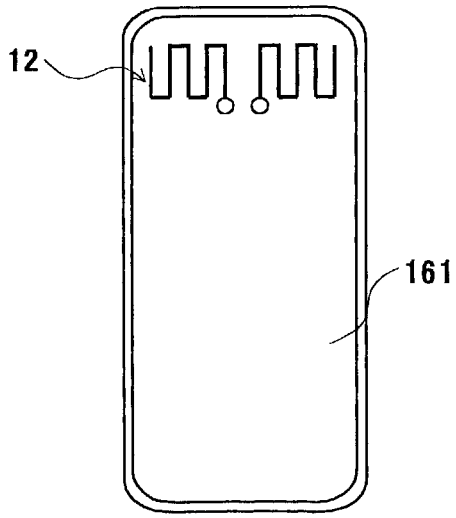
FIG. 24 is a schematic view showing a configuration of a dipole antenna placed on a package case according to Embodiment 18 of the present invention.

FIG. 24 is a schematic diagram showing a configuration of dipole antenna 12 placed on package case 161 in Embodiment 18 of the present invention. As shown in this figure, dipole antenna 12 is placed patterned on package case 161.

Thus, using dipole antenna 12 in Embodiment 1, this embodiment can achieve effects similar to those in Embodiment 1. Furthermore, placing dipole antenna 12 in Embodiment 1 patterned on package case 161 makes it possible to obtain a stable characteristic, save the space for installing the antenna and thereby reduce the size of the apparatus.

By the way, in addition to dipole antenna 12 of Embodiment 1, the dipole antenna of any one of the other embodiments of the present Specification can also be placed patterned on package case 161.

(Embodiment 19)

Embodiment 19 is a mode in which the configuration of dipole antenna 12 in Embodiment 1 is changed. Embodiment 19 is the same as Embodiment 1 except for the configuration of the dipole antenna and therefore detailed explanations thereof will be omitted. Differences of the built-in antenna for a radio communication terminal according to this embodiment from Embodiment 1 will be explained using FIG. 25. The parts similar to those in Embodiment 1 are assigned the same reference numerals and detailed explanations thereof will be omitted.

Figure 25:
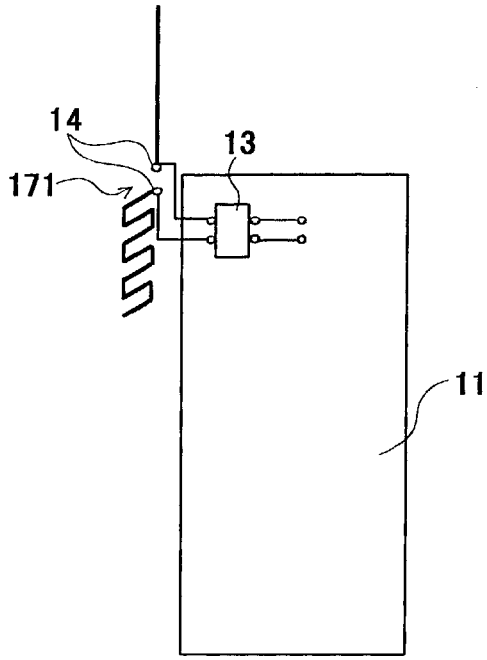
FIG. 25 is a schematic view showing a configuration of a built-in antenna for a radio communication terminal according to Embodiment 19 of the present invention.

FIG. 25 is a schematic diagram showing a configuration of the built-in antenna for a radio communication terminal according to Embodiment 19. As shown in this figure, the built-in antenna for a radio communication terminal according to Embodiment 19 is constructed of base plate 11, balance-to-unbalance transformation circuit 13, power supply terminals 14 and dipole antenna 171. One of the two antenna elements making up dipole antenna 171 is rectangular-wave-shaped and the other is bar-shaped. These two antenna elements are placed in such a way that their respective centerlines in the longitudinal direction form one straight line. The bar-shaped antenna element is placed outside a radio communication terminal, which is not shown.

Dipole antenna 171 is mounted in such a way that the longitudinal direction of the rectangular-wave-shaped antenna element is perpendicular to the upper surface (horizontal plane) of the radio communication terminal and the longitudinal direction of the bar-shaped antenna element is perpendicular to the upper surface (horizontal plane) of the radio communication terminal.

As shown above, dipole antenna 171 is mounted in such a way that both the axial direction of the bar-shaped antenna element and the longitudinal direction of the rectangular-wave-shaped antenna element are perpendicular to the upper surface (horizontal plane) of the radio communication terminal. This allows dipole antenna 171 to mainly receive vertically polarized waves parallel to the axial direction of the bar-shaped antenna element and the longitudinal direction of the rectangular-wave-shaped antenna element in a free space. During a conversation, the human body acts as a reflector, and therefore dipole antenna 171 has directivity opposite to the human body.

Then, the operation of the built-in antenna for a radio communication terminal in the above configuration will be explained. An unbalanced signal from the transmission/reception circuit above is transformed to a balanced signal by balance-to-unbalance transformation circuit 13 and sent to dipole antenna 171. Dipole antenna 171 supplied with power in this way mainly sends vertically polarized waves parallel to this longitudinal direction of this dipole antenna 171. During reception, vertically polarized waves parallel to the longitudinal direction above are received. Therefore, in a free space, vertically polarized waves are received from all directions centered on dipole antenna 171 and during a conversation, the human body acts as a reflector as described above, and therefore of the vertically polarized waves above, the vertically polarized waves from the direction opposite to the human body are mainly received.

In this way, dipole antenna 171 can not only suppress deterioration of gain but also mainly receive vertically polarized waves parallel to the longitudinal direction of this dipole antenna 171. On the other hand, the signal sent from the other end of communication is often a mixture of vertically polarized waves and horizontally polarized waves due to various factors such as reflection. Thus, when there are more vertically polarized waves, the longitudinal direction of dipole antenna 171 matches the plane of polarization of the signal sent from the other end of communication, and therefore the built-in antenna for a radio communication terminal according to this embodiment can thereby increase the reception gain.

The signal above (balanced signal) received from dipole antenna 171 is sent to the transmission/reception circuit via balance-to-unbalance transformation circuit 13. Here, the current that flows into base plate 11 is suppressed to a minimum by above-described balance-to-unbalance transformation circuit 13, and therefore the antenna operation by base plate 11 is prevented. This minimizes the reduction of gain caused by influence from the human body.

Thus, according to this embodiment, balance-to-unbalance transformation circuit 13 can minimize the antenna current that flows into base plate 11, and can thereby suppress deterioration of gain of dipole antenna 171 caused by influence from the human body. Furthermore, adopting a rectangular-wave shape for one of the antenna elements of dipole antenna 171 makes it possible to reduce the size of the built-in antenna for a radio communication terminal. Therefore, it is possible to provide a high gain and small built-in antenna for a radio communication terminal with less influence from the human body.

(Embodiment 20)

Embodiment 20 is a mode in which the configuration and method of mounting of dipole antenna 171 in Embodiment 19 are changed. Embodiment 20 is the same as Embodiment 19 except for the configuration and method of mounting of the dipole antenna, and therefore detailed explanations thereof will be omitted. Differences of the built-in antenna for a radio communication terminal according to this embodiment from Embodiment 19 will be explained using FIG. 26. The parts similar to those in Embodiment 19 are assigned the same reference numerals and detailed explanations thereof will be omitted.

Figure 26:
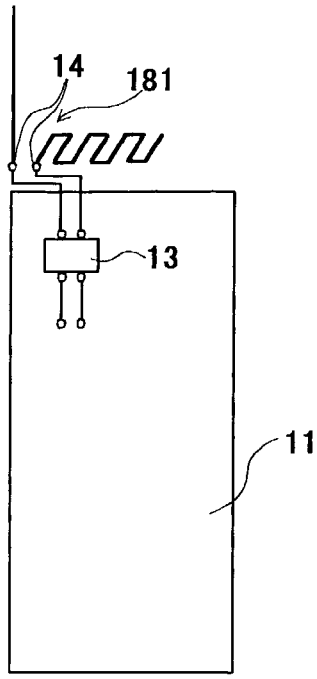
FIG. 26 is a schematic view showing a configuration of a built-in antenna for a radio communication terminal according to Embodiment 20 of the present invention.

FIG. 26 is a schematic diagram showing a configuration of the built-in antenna for a radio communication terminal according to Embodiment 20 of the present invention. As shown in this figure, the built-in antenna for a radio communication terminal according to Embodiment 20 is constructed of base plate 11, balance-to-unbalance transformation circuit 13, power supply terminals 14 and dipole antenna 181. The two antenna elements making up dipole antenna 181 are placed in such a way that the longitudinal direction of the rectangular-wave-shaped antenna element and the longitudinal direction (axial direction) of the bar-shaped antenna element intersect at right angles.

Dipole antenna 181 is mounted in such a way that the longitudinal direction of the rectangular-wave-shaped antenna element is parallel to the upper surface (horizontal plane) of the radio communication terminal and the axial direction of the bar-shaped antenna element is perpendicular to the upper surface (horizontal plane) of the radio communication terminal. That is, this embodiment differs from Embodiment 19 in that that the longitudinal direction of the rectangular-wave-shaped antenna element of the two antenna elements making up dipole antenna 181 is parallel to the upper surface (horizontal plane) of the radio communication terminal.

Then, the operation of the built-in antenna for a radio communication terminal in the above configuration will be explained. An unbalanced signal from the transmission/reception circuit above is transformed to a balanced signal by balance-to-unbalance transformation circuit 13 and sent to dipole antenna 181. The bar-shaped antennal element placed perpendicular to the upper surface (horizontal plane) of the radio communication terminal making up dipole antenna 181 supplied with power in this way mainly sends vertically polarized waves parallel to the axial direction of this bar-shaped antenna element. During reception, vertically polarized waves parallel to the axial direction above are received. On the other hand, the rectangular-wave-shaped antenna element placed in parallel to the upper surface (horizontal plane) of the radio communication terminal making up dipole antenna 181 supplied with power in the same way mainly sends horizontally polarized waves parallel to the longitudinal direction of this rectangular-wave-shaped antenna element. During reception, horizontally polarized waves parallel to the longitudinal direction above are received. Therefore, in a free space, vertically polarized waves and horizontally polarized waves are received from all directions centered on dipole antenna 181 and during a conversation, the human body acts as a reflector, and therefore of the vertically polarized waves and horizontally polarized waves above, the vertically polarized waves and horizontally polarized waves from the direction opposite to the human body are mainly received.

Thus, dipole antenna 181 can not only suppress deterioration of gain but also receive both vertically polarized waves and horizontally polarized waves parallel to the longitudinal direction of the respective antenna elements. On the other hand, the signal sent from the other end of communication is often a mixture of vertically polarized waves and horizontally polarized waves due to various factors such as reflection. Therefore, even if there are either more vertically polarized waves or more horizontally polarized waves, the longitudinal direction of either antenna element of dipole antenna 181 matches the plane of polarization of the signal sent from the other end of communication, and the built-in antenna for a radio communication terminal according to this embodiment can thereby increase the reception gain.

Thus, this embodiment can also achieve effects similar to those of Embodiment 19.

(Embodiment 21)

Embodiment 21 is a mode in which the configuration and method of mounting of dipole antenna 171 in Embodiment 19 are changed. Embodiment 21 is the same as Embodiment 19 except for the configuration and method of mounting of the dipole antenna, and therefore detailed explanations thereof will be omitted. Differences of the built-in antenna for a radio communication terminal according to this embodiment from Embodiment 19 will be explained using FIG. 27. The parts similar to those in Embodiment 19 are assigned the same reference numerals and detailed explanations thereof will be omitted.

Figure 27:
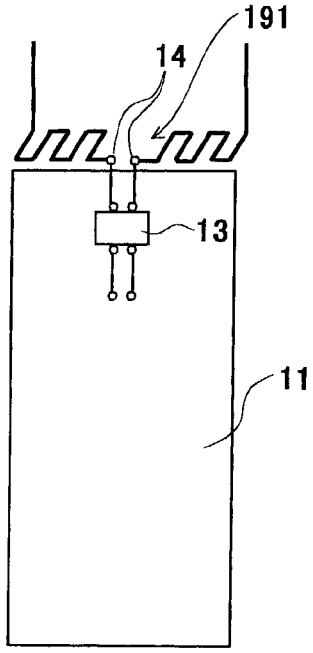
FIG. 27 is a schematic view showing a configuration of a built-in antenna for a radio communication terminal according to Embodiment 21 of the present invention.

FIG. 27 is a schematic diagram showing a configuration of the built-in antenna for a radio communication terminal according to Embodiment 21 of the present invention. As shown in this figure, the built-in antenna for a radio communication terminal according to Embodiment 21 is constructed of base plate 11, balance-to-unbalance transformation circuit 13, power supply terminals 14 and dipole antenna 191. The two antenna elements making up dipole antenna 191 are folded near the center and the part of the folded antenna element including power supply terminal 14 is rectangular-wave-shaped and the part of the folded antenna element not including power supply terminal 14 is bar-shaped and the antenna elements are placed in such a way that the centerlines in the longitudinal direction of the respective rectangular-wave-shaped parts of the antenna elements form one straight line. On the other hand, the bar-shaped parts of the antenna elements are placed outside the package of the radio communication terminal, which is not shown.

The folded rectangular-wave-shaped part of each antenna element making up dipole antenna 191 in the above configuration is mounted in such a way that the longitudinal direction thereof is parallel to the upper surface (horizontal surface) of the radio communication terminal. In this case, the bar-shaped part of each antenna element is placed perpendicular to the upper surface (horizontal surface) of the radio communication terminal.

Dipole antenna 191 is mounted in such a way that the longitudinal direction of the rectangular-wave-shaped part of each antenna element is parallel to the upper surface (horizontal surface) of the radio communication terminal. Mounting dipole antenna 191 in this way makes the axial direction of the bar-shaped part of each antenna element perpendicular to the upper surface (horizontal surface) of the radio communication terminal.

Then, the operation of the built-in antenna for a radio communication terminal in the above configuration will be explained. An unbalanced signal from the transmission/reception circuit above is transformed to a balanced signal by balance-to-unbalance transformation circuit 13 and then sent to dipole antenna 191. The bar-shaped part of the antenna element placed perpendicular to the upper surface (horizontal plane) of the radio communication terminal that makes up dipole antenna 191 supplied with power in this way mainly sends vertically polarized waves parallel to the axial direction of this bar-shaped part. Furthermore, during reception, vertically polarized waves parallel to the axial direction above are received. On the other hand, the rectangular-wave-shaped part of the antenna element placed in parallel to the upper surface (horizontal plane) of the radio communication terminal that makes up dipole antenna 191 supplied with power in the same way mainly sends horizontally polarized waves parallel to the longitudinal direction of this rectangular-wave-shaped part. Furthermore, during reception, horizontally polarized waves parallel to the longitudinal direction above are received. Thus, in a free space, vertically polarized waves and horizontally polarized waves from all directions centered on dipole antenna 191 are received, and during a conversation, since the human body acts as a reflector as described above, of the vertically polarized waves and horizontally polarized waves, the vertically polarized waves and horizontally polarized waves opposite to the human body are mainly received.

This allows dipole antenna 191 to suppress deterioration of gain and mainly receive horizontally polarized waves parallel to the longitudinal direction of the rectangular-wave-shaped part of each antenna element and vertically polarized waves parallel to the axial direction of the bar-shaped part of each antenna element. On the other hand, a signal sent from the other end of communication is a mixture of vertically polarized waves and horizontally polarized waves due to various factors such as reflection. Thus, even if there are either more vertically polarized waves or more horizontally polarized waves, the longitudinal direction of either part of each antenna element of dipole antenna 191 matches the polarization plane of the signal sent from the other end of communication, and the built-in antenna for a radio communication terminal according to this embodiment can thereby increase reception gain.

Thus, this embodiment can also achieve effects similar to those of Embodiment 20.

(Embodiment 22)

Embodiment 22 is a mode in which the configuration of the bar-shaped antenna element that makes up dipole antenna 171 in Embodiment 19 is changed. The antenna for a radio communication terminal according to this embodiment will be explained below using FIG. 28. The components similar to those in Embodiment 19 are assigned the same reference numerals and detailed explanations thereof will be omitted.

Figure 28:
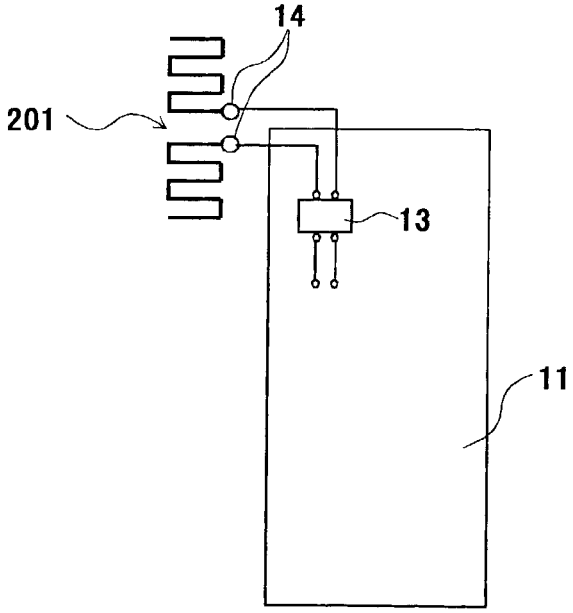
FIG. 28 is a schematic view showing the configuration of a diversity antenna for a radio communication terminal according to Embodiment 19 of the present invention.

FIG. 28 is a schematic diagram showing a configuration of the diversity antenna for a radio communication terminal according to Embodiment 22 of the present invention. As shown in FIG. 28, the antenna for a radio communication terminal according to Embodiment 22 is constructed of base plate 11, balance-to-unbalance transformation circuit 13 and dipole antenna 201. Dipole antenna 201 adopts a configuration in which the bar-shaped antenna element of the two antenna elements making up dipole antenna 171 in Embodiment 19 is rectangular-wave-shaped.

Then, the operation of the built-in antenna for a radio communication terminal in the above configuration will be explained. An unbalanced signal from the transmission/reception circuit above is transformed to a balanced signal by balance-to-unbalance transformation circuit 13 and then sent to dipole antenna 201. Dipole antenna 201 supplied with power in this way is placed in such a way that the longitudinal direction of this dipole antenna 201 is perpendicular to the upper surface (horizontal plane) of the radio communication terminal, and therefore mainly sends vertically polarized waves parallel to the longitudinal direction of this dipole antenna 201. Furthermore, during reception, vertically polarized waves parallel to the longitudinal direction above are received. Thus, in a free space, vertically polarized waves from all directions centered on dipole antenna 201 are received, and during a conversation, since the human body acts as a reflector as described above, of the vertically polarized waves above, the vertically polarized waves opposite to the human body are mainly received.

This allows dipole antenna 201 to suppress deterioration of gain and mainly receive vertically polarized waves parallel to the longitudinal direction of this dipole antenna 201. On the other hand, a signal sent from the other end of communication is a mixture of vertically polarized waves and horizontally polarized waves due to various factors such as reflection. Thus, when there are more vertically polarized waves, the longitudinal direction of dipole antenna 201 matches the polarization plane of the signal sent from the other end of communication, and the built-in antenna for a radio communication terminal according to this embodiment can thereby increase reception gain.

Thus, this embodiment can achieve effects similar to those of Embodiment 19 and at the same time reduce the size of the external antenna.

(Embodiment 23)

Embodiment 23 is a mode in which the configuration of the bar-shaped antenna element of the two antenna elements that make up dipole antenna 181 in Embodiment 20 is changed. The antenna for a radio communication terminal according to this embodiment will be explained below using FIG. 29. The components similar to those in Embodiment 20 are assigned the same reference numerals and detailed explanations thereof will be omitted.

Figure 29:
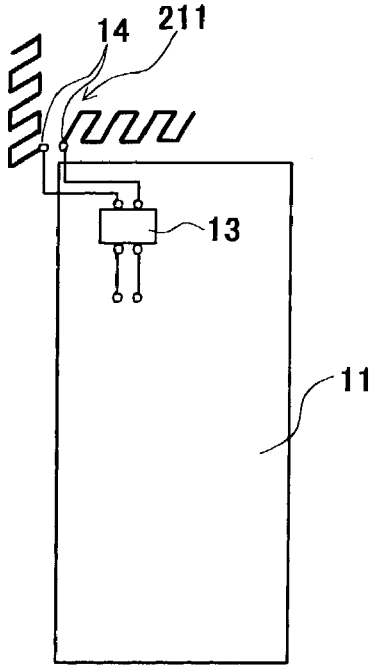
FIG. 29 is a schematic view showing a configuration of a built-in antenna for a radio communication terminal according to Embodiment 23 of the present invention.

FIG. 29 is a schematic diagram showing a configuration of the antenna for a radio communication terminal according to Embodiment 23 of the present invention. As shown in FIG. 29, the antenna for a radio communication terminal according to Embodiment 23 is constructed of base plate 11, balance-to-unbalance transformation circuit 13 and dipole antenna 211. Dipole antenna 211 adopts a configuration in which the bar-shaped antenna element of the two antenna elements making up dipole antenna 181 in Embodiment 20 is changed to a rectangular-wave-shaped antenna element.

Then, the operation of the built-in antenna for a radio communication terminal in the above configuration will be explained. An unbalanced signal from the transmission/reception circuit above is transformed to a balanced signal by balance-to-unbalance transformation circuit. 13 and then sent to dipole antenna 211. Dipole antenna 211 supplied with power in this way is placed in such a way that the longitudinal direction of one antenna element is perpendicular to the upper surface (horizontal plane) of the radio communication terminal and the longitudinal direction of the other antenna element is parallel to the upper surface (horizontal plane) of the radio communication terminal, and therefore sends vertically and horizontally polarized waves parallel to the longitudinal direction of each antenna element of this dipole antenna 211. Furthermore, during reception, vertically polarized waves and horizontally polarized waves parallel to the longitudinal direction above are received. Thus, in a free space, vertically polarized waves and horizontally polarized waves from all directions centered on dipole antenna 211 are received, and during a conversation, since the human body acts as a reflector as described above, of the vertically and horizontally polarized waves above, the vertically and horizontally polarized waves opposite to the human body are mainly received.

This allows dipole antenna 211 to suppress deterioration of gain and mainly receive vertically polarized waves and horizontally polarized waves parallel to the longitudinal direction of each antenna element of this dipole antenna 211. On the other hand, a signal sent from the other end of communication is a mixture of vertically polarized waves and horizontally polarized waves due to various factors such as reflection. Thus, even if there are either more vertically polarized waves or more horizontally polarized waves, the longitudinal of either antenna element of dipole antenna 211 matches the polarization plane of the signal sent from the other end of communication, and the built-in antenna for a radio communication terminal according to this embodiment can thereby increase reception gain.

Thus, this embodiment can achieve effects similar to those of Embodiment 20 and at the same time reduce the size of the external antenna.

(Embodiment 24)

Embodiment 24 is a mode in which the configuration of the bar-shaped part of each antenna element that makes up dipole antenna 191 in Embodiment 21 is changed. The antenna for a radio communication terminal according to this embodiment will be explained below using FIG. 30. The components similar to those in Embodiment 21 are assigned the same reference numerals and detailed explanations thereof will be omitted.

Figure 30:
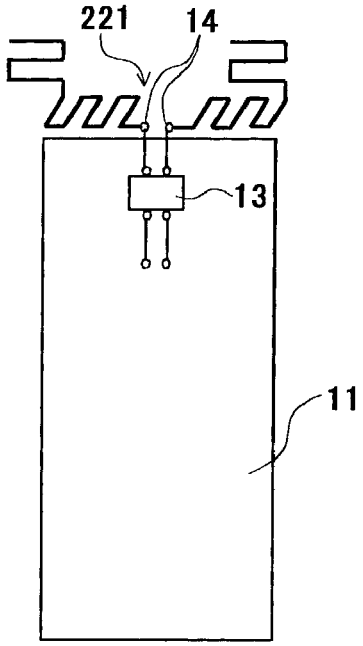
FIG. 30 is a schematic view showing a configuration of a built-in antenna for a radio communication terminal according to Embodiment 24 of the present invention.

FIG. 30 is a schematic diagram showing a configuration of the built-in antenna for a radio communication terminal according to Embodiment 24 of the present invention. As shown in FIG. 30, the antenna for a radio communication terminal according to Embodiment 24 is constructed of base plate 11, balance-to-unbalance transformation circuit 13, power supply terminals 14 and dipole antenna 221. Dipole antenna 221 adopts a configuration in which the bar-shaped part of each antenna element making up dipole antenna 191 in Embodiment 21 is changed to a rectangular-wave shape.

Then, the operation of the built-in antenna for a radio communication terminal in the above configuration will be explained. An unbalanced signal from the transmission/reception circuit above is transformed to a balanced signal by balance-to-unbalance transformation circuit 13 and then sent to dipole antenna 221. Of the antenna elements that make up dipole antenna 221 supplied with power in this way, the part placed perpendicular to the upper surface (horizontal plane) of the radio communication terminal mainly sends vertically polarized waves parallel to the longitudinal direction of this part. Furthermore, during reception, vertically polarized waves parallel to the longitudinal direction above are received. On the other hand, the part placed in parallel to the upper surface (horizontal plane) of the radio communication terminal of each antenna element that makes up dipole antenna 221 supplied with power in the same way mainly sends horizontally polarized waves parallel to the longitudinal direction of this part. Furthermore, during reception, horizontally polarized waves parallel to the longitudinal direction above are received. Thus, in a free space, vertically polarized waves and horizontally polarized waves are received from all directions centered on dipole antenna 221, and during a conversation, since the human body acts as a reflector as described above, of the vertically and horizontally polarized waves above, the vertically and horizontally polarized waves opposite to the human body are mainly received.

This allows dipole antenna 221 to suppress deterioration of gain and mainly receive vertically polarized waves and horizontally polarized waves parallel to the longitudinal direction of each part of each antenna element. On the other hand, a signal sent from the other end of communication is a mixture of vertically polarized waves and horizontally polarized waves due to various factors such as reflection. Thus, even if there are either more vertically polarized waves or more horizontally polarized waves, the longitudinal direction of either part of each antenna element of dipole antenna 221 matches the polarization plane of the signal sent from the other end of communication, and the built-in antenna for a radio communication terminal according to this embodiment can thereby increase reception gain.

Thus, this embodiment can achieve effects similar to those of Embodiment 21 and at the same time reduce the size of the external antenna.

Following Embodiments 25 to 38 are modes in which a diversity antenna is implemented using the built-in antenna for a radio communication terminal according to Embodiments 19 to 24.

(Embodiment 25)

Embodiment 25 is a mode in which a diversity antenna is implemented using the built-in antenna for a radio communication terminal according to Embodiment 19. The diversity antenna for a radio communication terminal according to this embodiment will be explained below using FIG. 31. The components similar to those in Embodiment 19 are assigned the same reference numerals and detailed explanations thereof will be omitted.

Figure 31:
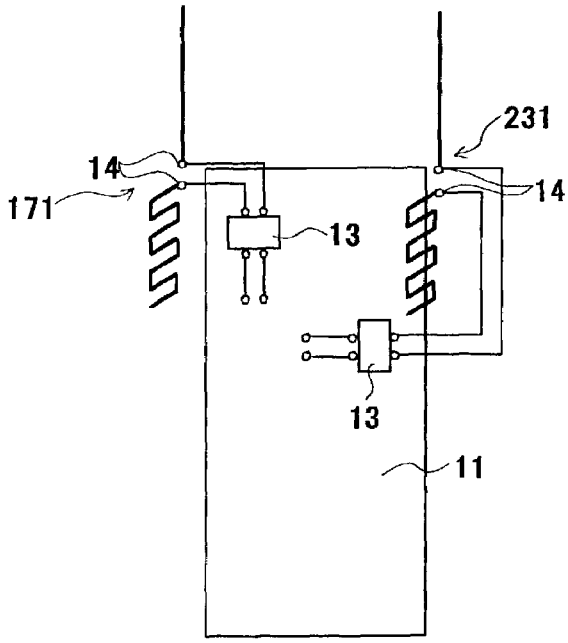
FIG. 31 is a schematic view showing a configuration of a diversity antenna for a radio communication terminal according to Embodiment 25 of the present invention.

FIG. 31 is a schematic diagram showing a configuration of the diversity antenna for a radio communication terminal according to Embodiment 25 of the present invention. As shown in FIG. 31, dipole antenna 231 is added to the configuration of the built-in antenna for a radio communication terminal according to Embodiment 19. Dipole antenna 231 has a configuration similar to that of dipole antenna 171 in Embodiment 19.

Here, suppose one antenna making up the diversity antenna is dipole antenna 171 in Embodiment 19 and used for reception only. Also suppose the other antenna making up the diversity antenna is dipole antenna 231 and used for both transmission and reception.

In the diversity antenna for a radio communication terminal in the above configuration, only dipole antenna 231 operates during transmission and both dipole antenna 171 and dipole antenna 231 operate during reception to carry out diversity reception.

Thus, according to this embodiment, dipole antenna 171 in Embodiment 19 and dipole antenna 231 constructed in the same way as dipole antenna 171 are used as the diversity antenna, which makes it possible to provide a high gain and small diversity antenna for a radio communication terminal with less influence from the human body as in the case of Embodiment 19.

(Embodiment 26)

Embodiment 26 is a mode in which a diversity antenna is implemented using the built-in antenna for a radio communication terminal in Embodiment 20. The diversity antenna for a radio communication terminal according to this embodiment will be explained below using FIG. 32. The components similar to those in Embodiment 20 are assigned the same reference numerals and detailed explanations thereof will be omitted.

Figure 32:
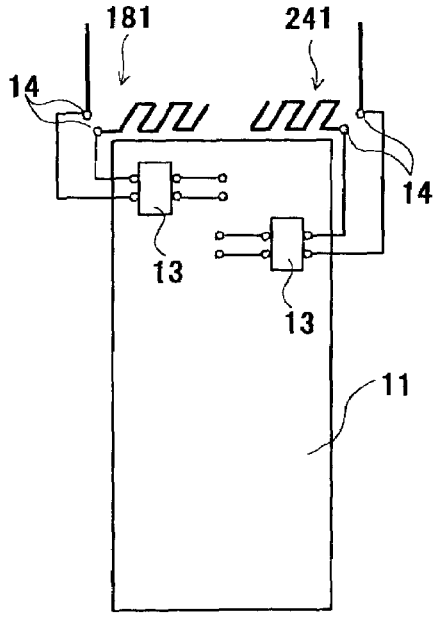
FIG. 32 is a schematic view showing a configuration of a diversity antenna for a radio communication terminal according to Embodiment 26 of the present invention.

FIG. 32 is a schematic diagram showing a configuration of the diversity antenna for a radio communication terminal according to Embodiment 26 of the present invention. In FIG. 32, dipole antenna dipole antenna 241 is added to the configuration of the built-in antenna for a radio communication terminal according to this Embodiment 20. Dipole antenna 241 has a configuration similar to that of dipole antenna 181 in Embodiment 20.

Here, suppose one antenna making up the diversity antenna is dipole antenna 181 in Embodiment 20 and used for reception only. Also suppose the other antenna making up the diversity antenna is dipole antenna 241 and used for both transmission and reception.

In the diversity antenna for a radio communication terminal in the above configuration, only dipole antenna 241 operates during transmission and both dipole antenna 181 and dipole antenna 241 operate during reception to carry out diversity reception.

Thus, according to this embodiment, dipole antenna 181 in Embodiment 20 and dipole antenna 241 constructed in the same way as dipole antenna 181 are used as the diversity antenna, which makes it possible to provide a high gain and small diversity antenna for a radio communication terminal with less influence from the human body as in the case of Embodiment 20.

(Embodiment 27)

Embodiment 27 is a mode in which a diversity antenna is implemented using the built-in antenna for a radio communication terminal in Embodiment 22. The diversity antenna for a radio communication terminal according to this embodiment will be explained below using FIG. 33. The components similar to those in Embodiment 22 are assigned the same reference numerals and detailed explanations thereof will be omitted.

Figure 33:
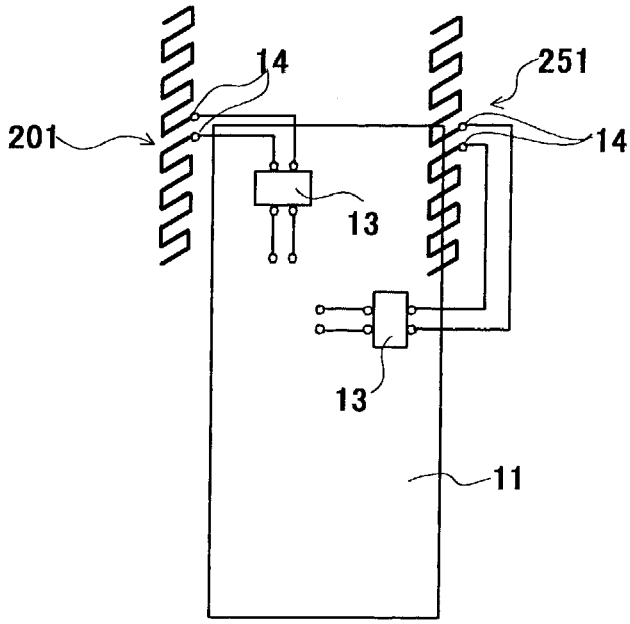
FIG. 33 is a schematic view showing a configuration of a diversity antenna for a radio communication terminal according to Embodiment 27 of the present invention.

FIG. 33 is a schematic diagram showing a configuration of the diversity antenna for a radio communication terminal according to Embodiment 27 of the present invention. In FIG. 33, dipole antenna 251 is further added to the configuration of the built-in antenna for a radio communication terminal according to this Embodiment 22. Dipole antenna 251 has a configuration similar to that of dipole antenna 201 in Embodiment 22.

Here, suppose one antenna making up the diversity antenna is dipole antenna 201 in Embodiment 22 and used for reception only. Also suppose the other antenna making up the diversity antenna is dipole antenna 251 and used for both transmission and reception.

In the diversity antenna for a radio communication terminal in the above configuration, only dipole antenna 251 operates during transmission and both dipole antenna 201 and dipole antenna 251 operate during reception to carry out diversity reception.

Thus, according to this embodiment, dipole antenna 201 in Embodiment 22 and dipole antenna 231 constructed in the same way as dipole antenna 201 are used as the diversity antenna, which makes it possible to provide a high gain and small diversity antenna for a radio communication terminal with less influence from the human body as in the case of Embodiment 22.

(Embodiment 28)

Embodiment 28 is a mode in which a diversity antenna is implemented using the built-in antenna for a radio communication terminal in Embodiment 23. The diversity antenna for a radio communication terminal according to this embodiment will be explained below using FIG. 34. The components similar to those in Embodiment 23 are assigned the same reference numerals and detailed explanations thereof will be omitted.

Figure 34:
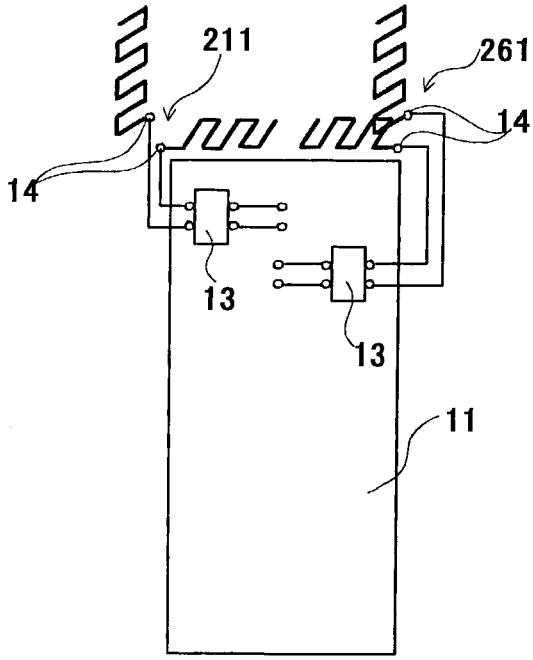
FIG. 34 is a schematic view showing a configuration of a diversity antenna for a radio communication terminal according to Embodiment 28 of the present invention.

FIG. 34 is a schematic diagram showing a configuration of the diversity antenna for a radio communication terminal according to Embodiment 28 of the present invention. In FIG. 34, dipole antenna 261 is further added to the configuration of the built-in antenna for a radio communication terminal according to Embodiment 23. Dipole antenna 261 has a configuration similar to that of dipole antenna 211 in Embodiment 23.

Here, suppose one antenna making up the diversity antenna is dipole antenna 211 in Embodiment 23 and used for reception only. Also suppose the other antenna making up the diversity antenna is dipole antenna 241 and used for both transmission and reception.

In the diversity antenna for a radio communication terminal in the above configuration, only dipole antenna 261 operates during transmission and both dipole antenna 211 and dipole antenna 261 operate during reception to carry out diversity reception.

Thus, according to this embodiment, dipole antenna 211 in Embodiment 23 and dipole antenna 261 constructed in the same way as dipole antenna 211 are used as the diversity antenna, which makes it possible to provide a high gain and small diversity antenna for a radio communication terminal with less influence from the human body as in the case of Embodiment 23.

(Embodiment 29)

Embodiment 29 is a mode in which a diversity antenna is implemented using the built-in antennas for a radio communication terminal in Embodiment 1 and Embodiment 19. The diversity antenna for a radio communication terminal according to this embodiment will be explained below using FIG. 35. The components similar to those in Embodiment 1 and Embodiment 19 are assigned the same reference numerals and detailed explanations thereof will be omitted.

Figure 35:
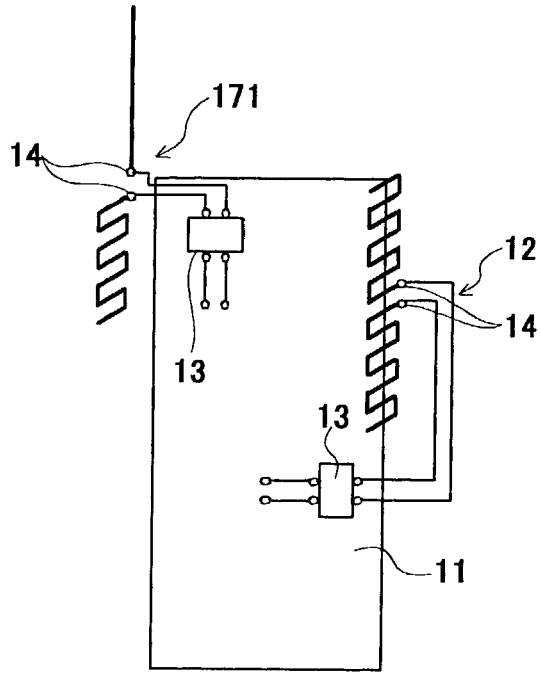
FIG. 35 is a schematic view showing a configuration of a diversity antenna for a radio communication terminal according to Embodiment 29 of the present invention.

FIG. 35 is a schematic diagram showing a configuration of the diversity antenna for a radio communication terminal according to Embodiment 29 of the present invention. In FIG. 35, dipole antenna 12 in Embodiment 1 is further added to the configuration of the built-in antenna for a radio communication terminal according to Embodiment 19.

Here, suppose one antenna making up the diversity antenna is dipole antenna 12 in Embodiment 1 and used for reception only. Also suppose the other antenna making up the diversity antenna is dipole antenna 171 in Embodiment 19 and used for both transmission and reception.

In the diversity antenna for a radio communication terminal in the above configuration, only dipole antenna 171 operates during transmission and both dipole antenna 171 and dipole antenna 12 operate during reception to carry out diversity reception.

Thus, according to this embodiment, dipole antenna 12 in Embodiment 1 and dipole antenna 171 in Embodiment 19 are used as the diversity antenna, which makes it possible to provide a high gain and small diversity antenna for a radio communication terminal with less influence from the human body as in the case of Embodiment 19.

(Embodiment 30)

Embodiment 30 is a mode in which a diversity antenna is implemented using the built-in antennas for a radio communication terminal in Embodiment 2 and Embodiment 19. The diversity antenna for a radio communication terminal according to this embodiment will be explained below using FIG. 36. The components similar to those in Embodiment 2 and Embodiment 19 are assigned the same reference numerals and detailed explanations thereof will be omitted.

Figure 36:
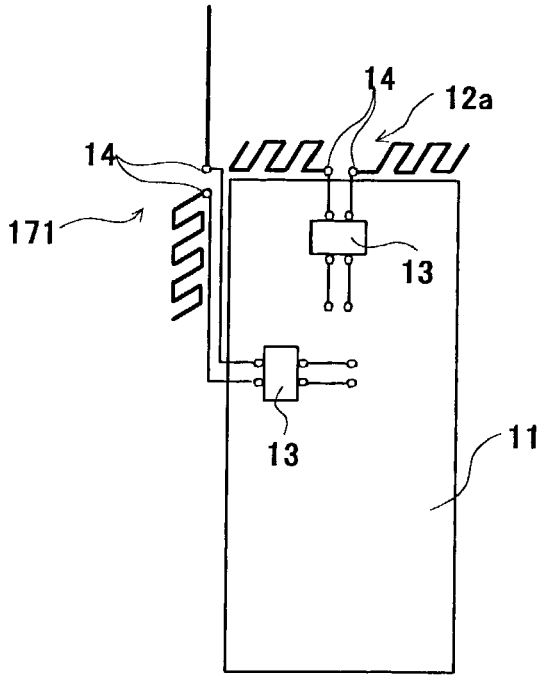
FIG. 36 is a schematic view showing a configuration of a diversity antenna for a radio communication terminal according to Embodiment 30 of the present invention.

FIG. 36 is a schematic diagram showing a configuration of the diversity antenna for a radio communication terminal according to Embodiment 30 of the present invention. In FIG. 36, dipole antenna 12*a* in Embodiment 2 is further added to the configuration of the built-in antenna for a radio communication terminal according to Embodiment 19.

Here, suppose one antenna making up the diversity antenna is dipole antenna 12*a* in Embodiment 2 and used for reception only. Also suppose the other antenna making up the diversity antenna is dipole antenna 171 in Embodiment 19 and used for both transmission and reception.

In the diversity antenna for a radio communication terminal in the above configuration, only dipole antenna 171 operates during transmission and both dipole antenna 171 and dipole antenna 12*a* operate during reception to carry out diversity reception.

Thus, according to this embodiment, dipole antenna 12*a* in Embodiment 2 and dipole antenna 171 in Embodiment 19 are used as the diversity antenna, which makes it possible to provide a high gain and small diversity antenna for a radio communication terminal with less influence from the human body as in the case of Embodiment 2 and Embodiment 19.

(Embodiment 31)

Embodiment 31 is a mode in which a diversity antenna is implemented using the built-in antennas for a radio communication terminal in Embodiment 3 and Embodiment 19. The diversity antenna for a radio communication terminal according to this embodiment will be explained below using FIG. 37. The components similar to those in Embodiment 3 and Embodiment 19 are assigned the same reference numerals and detailed explanations thereof will be omitted.

Figure 37:
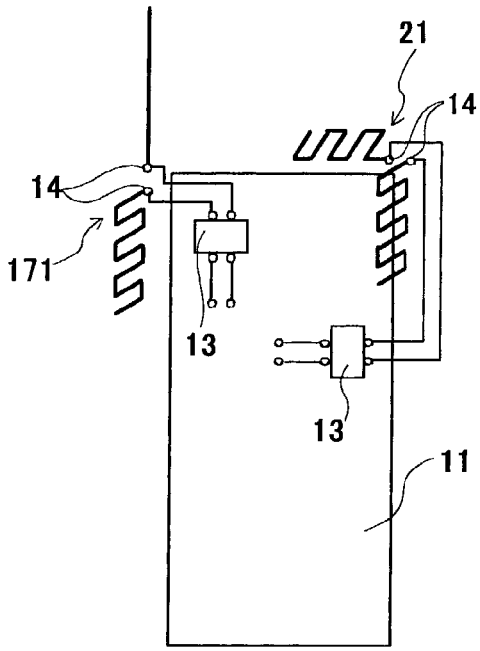
FIG. 37 is a schematic view showing a configuration of a diversity antenna for a radio communication terminal according to Embodiment 31 of the present invention.

FIG. 37 is a schematic diagram showing a configuration of the diversity antenna for a radio communication terminal according to Embodiment 31 of the present invention. In FIG. 37, dipole antenna 21 in Embodiment 3 is further added to the configuration of the built-in antenna for a radio communication terminal according to Embodiment 19.

Here, suppose one antenna making up the diversity antenna is dipole antenna 21 in Embodiment 3 and used for reception only. Also suppose the other antenna making up the diversity antenna is dipole antenna 171 in Embodiment 19 and used for both transmission and reception.

In the diversity antenna for a radio communication terminal in the above configuration, only dipole antenna 171 operates during transmission and both dipole antenna 171 and dipole antenna 21 operate during reception to carry out diversity reception.

Thus, according to this embodiment, dipole antenna 21 in Embodiment 3 and dipole antenna 171 in Embodiment 19 are used as the diversity antenna, which makes it possible to provide a high gain and small diversity antenna for a radio communication terminal with less influence from the human body as in the case of Embodiment 3 and Embodiment 19.

(Embodiment 32)

Embodiment 32 is a mode in which a diversity antenna is implemented using the built-in antennas for a radio communication terminal in Embodiment 1 and Embodiment 20. The diversity antenna for a radio communication terminal according to this embodiment will be explained below using FIG. 38. The components similar to those in Embodiment 1 and Embodiment 20 are assigned the same reference numerals and detailed explanations thereof will be omitted.

Figure 38:
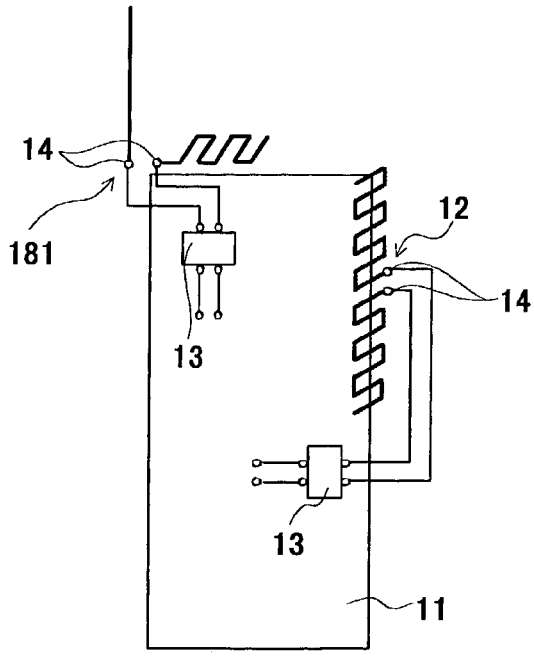
FIG. 38 is a schematic view showing a configuration of a diversity antenna for a radio communication terminal according to Embodiment 32 of the present invention.

FIG. 38 is a schematic diagram showing a configuration of the diversity antenna for a radio communication terminal according to Embodiment 32 of the present invention. In FIG. 38, dipole antenna 12 in Embodiment 1 is further added to the configuration of the built-in antenna for a radio communication terminal according to Embodiment 20.

Here, suppose one antenna making up the diversity antenna is dipole antenna 12 in Embodiment 1 and used for reception only. Also suppose the other antenna making up the diversity antenna is dipole antenna 181 in Embodiment 20 and used for both transmission and reception.

In the diversity antenna for a radio communication terminal in the above configuration, only dipole antenna 181 operates during transmission and both dipole antenna 181 and dipole antenna 12 operate during reception to carry out diversity reception.

Thus, according to this embodiment, dipole antenna 12 in Embodiment 1 and dipole antenna 181 in Embodiment 20 are used as the diversity antenna, which makes it possible to provide a high gain and small diversity antenna for a radio communication terminal with less influence from the human body as in the case of Embodiment 1 and Embodiment 20.

(Embodiment 33)

Embodiment 33 is a mode in which a diversity antenna is implemented using the built-in antennas for a radio communication terminal in Embodiment 3 and Embodiment 20. The diversity antenna for a radio communication terminal according to this embodiment will be explained below using FIG. 39. The components similar to those in Embodiment 3 and Embodiment 20 are assigned the same reference numerals and detailed explanations thereof will be omitted.

Figure 39:
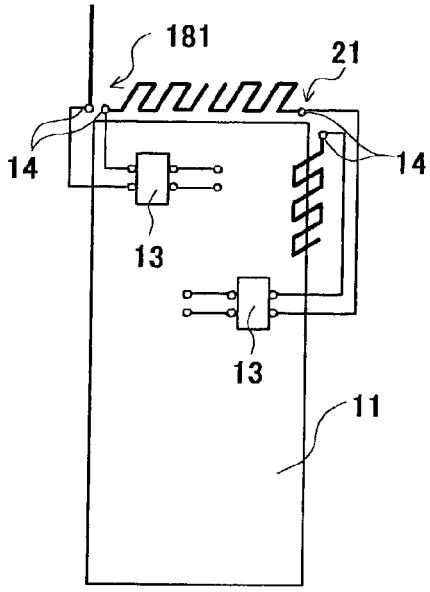
FIG. 39 is a schematic view showing a configuration of a diversity antenna for a radio communication terminal according to Embodiment 33 of the present invention.

FIG. 39 is a schematic diagram showing a configuration of the diversity antenna for a radio communication terminal according to Embodiment 33 of the present invention. In FIG. 39, dipole antenna 21 in Embodiment 3 is further added to the configuration of the built-in antenna for a radio communication terminal according to Embodiment 20.

Here, suppose one antenna making up the diversity antenna is dipole antenna 21 in Embodiment 3 and used for reception only. Also suppose the other antenna making up the diversity antenna is dipole antenna 181 in Embodiment 20 and used for both transmission and reception.

In the diversity antenna for a radio communication terminal in the above configuration, only dipole antenna 181 operates during transmission and both dipole antenna 181 and dipole antenna 21 operate during reception to carry out diversity reception.

Thus, according to this embodiment, dipole antenna 21 in Embodiment 3 and dipole antenna 181 in Embodiment 20 are used as the diversity antenna, which makes it possible to provide a high gain and small diversity antenna for a radio communication terminal with less influence from the human body as in the case of Embodiment 3 and Embodiment 20.

(Embodiment 34)

Embodiment 34 is a mode in which a diversity antenna is implemented using the built-in antennas for a radio communication terminal in Embodiment 1 and Embodiment 22. The diversity antenna for a radio communication terminal according to this embodiment will be explained below using FIG. 40. The components similar to those in Embodiment 1 and Embodiment 22 are assigned the same reference numerals and detailed explanations thereof will be omitted.

Figure 40:
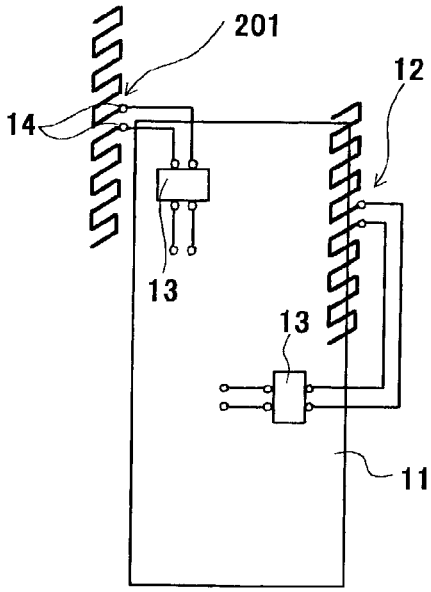
FIG. 40 is a schematic view showing a configuration of a diversity antenna for a radio communication terminal according to Embodiment 34 of the present invention.

FIG. 40 is a schematic diagram showing a configuration of the diversity antenna for a radio communication terminal according to Embodiment 34 of the present invention. In FIG. 40, dipole antenna 12 in Embodiment 1 is further added to the configuration of the built-in antennas for a radio communication terminal according to Embodiment 22.

Here, suppose one antenna making up the diversity antenna is dipole antenna 12 in Embodiment 1 and used for reception only. Also suppose the other antenna making up the diversity antenna is dipole antenna 201 in Embodiment 22 and used for both transmission and reception.

In the diversity antenna for a radio communication terminal in the above configuration, only dipole antenna 201 operates during transmission and both dipole antenna 201 and dipole antenna 12 operate during reception to carry out diversity reception.

Thus, according to this embodiment, dipole antenna 12 in Embodiment 1 and dipole antenna 201 in Embodiment 22 are used as the diversity antenna, which makes it possible to provide a high gain and small diversity antenna for a radio communication terminal with less influence from the human body as in the case of Embodiment 1 and Embodiment 22.

(Embodiment 35)

Embodiment 35 is a mode in which a diversity antenna is implemented using the built-in antennas for a radio communication terminal in Embodiment 2 and Embodiment 22. The diversity antenna for a radio communication terminal according to this embodiment will be explained below using FIG. 41. The components similar to those in Embodiment 2 and Embodiment 22 are assigned the same reference numerals and detailed explanations thereof will be omitted.

Figure 41:
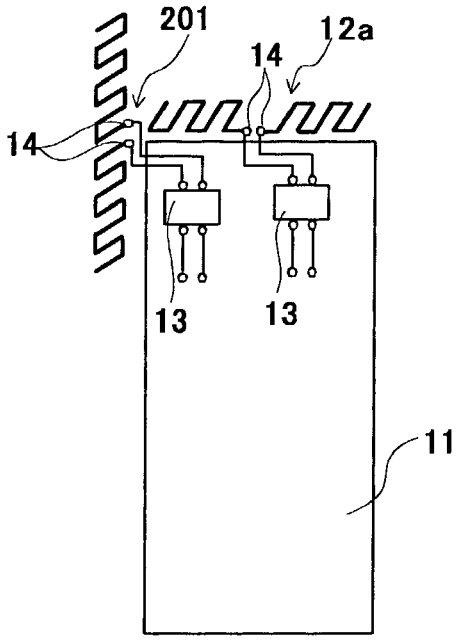
FIG. 41 is a schematic view showing a configuration of a diversity antenna for a radio communication terminal according to Embodiment 35 of the present invention.

FIG. 41 is a schematic diagram showing a configuration of the diversity antenna for a radio communication terminal according to Embodiment 35 of the present invention. In FIG. 41, dipole antenna 12*a* in Embodiment 2 is further added to the configuration of the built-in antenna for a radio communication terminal according to Embodiment 22.

Here, suppose one antenna making up the diversity antenna is dipole antenna 12*a* in Embodiment 2 and used for reception only. Also suppose the other antenna making up the diversity antenna is dipole antenna 201 in Embodiment 22 and used for both transmission and reception.

In the diversity antenna for a radio communication terminal in the above configuration, only dipole antenna 201 operates during transmission and both dipole antenna 201 and dipole antenna 12*a* operate during reception to carry out diversity reception.

Thus, according to this embodiment, dipole antenna 12*a* in Embodiment 2 and dipole antenna 201 in Embodiment 22 are used as the diversity antenna, which makes it possible to provide a high gain and small diversity antenna for a radio communication terminal with less influence from the human body as in the case of Embodiment 2 and Embodiment 22.

(Embodiment 36)

Embodiment 36 is a mode in which a diversity antenna is implemented using the built-in antennas for a radio communication terminal in Embodiment 3 and Embodiment 22. The diversity antenna for a radio communication terminal according to this embodiment will be explained below using FIG. 42. The components similar to those in Embodiment 3 and Embodiment 22 are assigned the same reference numerals and detailed explanations thereof will be omitted.

Figure 42:
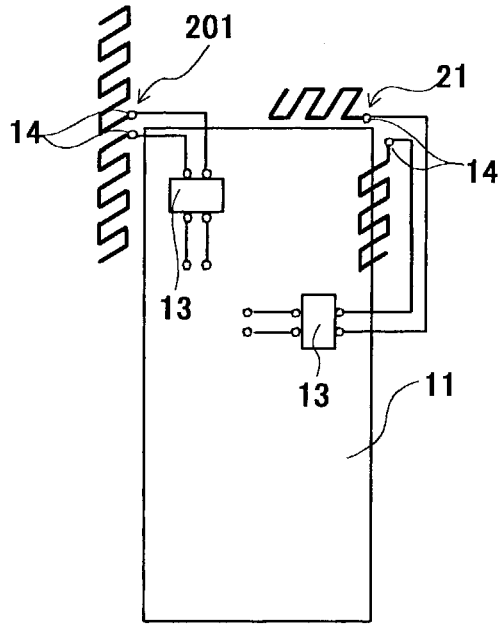
FIG. 42 is a schematic view showing a configuration of a diversity antenna for a radio communication terminal according to Embodiment 36 of the present invention.

FIG. 42 is a schematic diagram showing a configuration of the diversity antenna for a radio communication terminal according to Embodiment 36 of the present invention. In FIG. 42, dipole antenna 21 in Embodiment 3 is further added to the configuration of the built-in antenna for a radio communication terminal according to Embodiment 22.

Here, suppose one antenna making up the diversity antenna is dipole antenna 21 in Embodiment 3 and used for reception only. Also suppose the other antenna making up the diversity antenna is dipole antenna 201 in Embodiment 22 and used for both transmission and reception.

In the diversity antenna for a radio communication terminal in the above configuration, only dipole antenna 201 operates during transmission and both dipole antenna 201 and dipole antenna 21 operate during reception to carry out diversity reception.

Thus, according to this embodiment, dipole antenna 21 in Embodiment 3 and dipole antenna 201 in Embodiment 22 are used as the diversity antenna, which makes it possible to provide a high gain and small diversity antenna for a radio communication terminal with less influence from the human body as in the case of Embodiment 3 and Embodiment 22.

(Embodiment 37)

Embodiment 37 is a mode in which a diversity antenna is implemented using the built-in antennas for a radio communication terminal in Embodiment 1 and Embodiment 23. The diversity antenna for a radio communication terminal according to this embodiment will be explained below using FIG. 43. The components similar to those in Embodiment 1 and Embodiment 23 are assigned the same reference numerals and detailed explanations thereof will be omitted.

Figure 43:
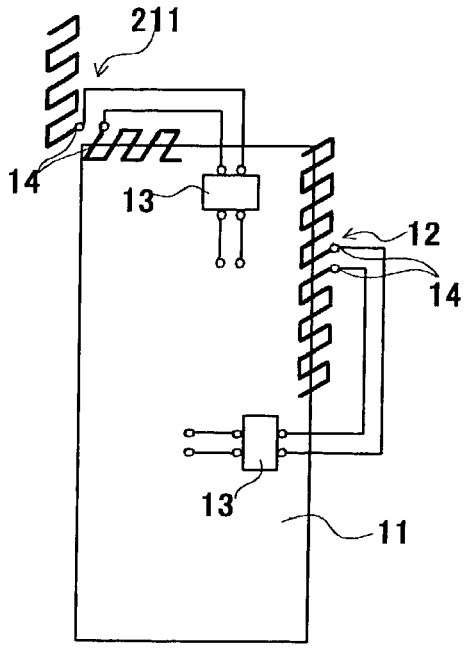
FIG. 43 is a schematic view showing a configuration of a diversity antenna for a radio communication terminal according to Embodiment 37 of the present invention.

FIG. 43 is a schematic diagram showing a configuration of the diversity antenna for a radio communication terminal according to Embodiment 37 of the present invention. In FIG. 43, dipole antenna 12 in Embodiment 1 is further added to the configuration of the built-in antenna for a radio communication terminal according to Embodiment 23.

Here, suppose one antenna making up the diversity antenna is dipole antenna 12 in Embodiment 1 and used for reception only. Also suppose the other antenna making up the diversity antenna is dipole antenna 211 in Embodiment 23 and used for both transmission and reception.

In the diversity antenna for a radio communication terminal in the above configuration, only dipole antenna 211 operates during transmission and both dipole antenna 211 and dipole antenna 12 operate during reception to carry out diversity reception.

Thus, according to this embodiment, dipole antenna 12 in Embodiment 1 and dipole antenna 211 in Embodiment 23 are used as the diversity antenna, which makes it possible to provide a high gain and small diversity antenna for a radio communication terminal with less influence from the human body as in the case of Embodiment 1 and Embodiment 23.

(Embodiment 38)

Embodiment 38 is a mode in which a diversity antenna is implemented using the built-in antennas for a radio communication terminal in Embodiment 3 and Embodiment 23. The diversity antenna for a radio communication terminal according to this embodiment will be explained below using FIG. 44. The components similar to those in Embodiment 3 and Embodiment 23 are assigned the same reference numerals and detailed explanations thereof will be omitted.

Figure 44:
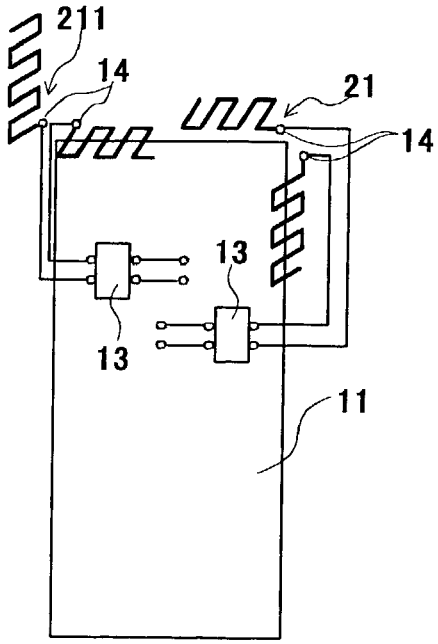
FIG. 44 is a schematic view showing a configuration of a diversity antenna for a radio communication terminal according to Embodiment 38 of the present invention.

FIG. 44 is a schematic diagram showing a configuration of the diversity antenna for a radio communication terminal according to Embodiment 38 of the present invention. In FIG. 44, dipole antenna 21 in Embodiment 3 is further added to the configuration of the built-in antenna for a radio communication terminal according to Embodiment 23.

Here, suppose one antenna making up the diversity antenna is dipole antenna 21 in Embodiment 3 and used for reception only. Also suppose the other antenna making up the diversity antenna is dipole antenna 211 in Embodiment 23 and used for both transmission and reception.

In the diversity antenna for a radio communication terminal in the above configuration, only dipole antenna 211 operates during transmission and both dipole antenna 211 and dipole antenna 21 operate during reception to carry out diversity reception.

Thus, according to this embodiment, dipole antenna 21 in Embodiment 3 and dipole antenna 211 in Embodiment 23 are used as the diversity antenna, which makes it possible to provide a high gain and small diversity antenna for a radio communication terminal with less influence from the human body as in the case of Embodiment 3 and Embodiment 23.

(Embodiment 39)

Embodiment 39 is a mode in which the configuration of dipole antenna 21 in Embodiment 3 is changed. Embodiment 39 is the same as Embodiment 3 except for the configuration of the dipole antenna, and therefore detailed explanations thereof will be omitted. Differences of the built-in antenna for a radio communication terminal according to this embodiment from Embodiment 3 will be explained below using FIG. 45. The parts similar to those in Embodiment 3 are assigned the same reference numerals and detailed explanations thereof will be omitted.

Figure 45:
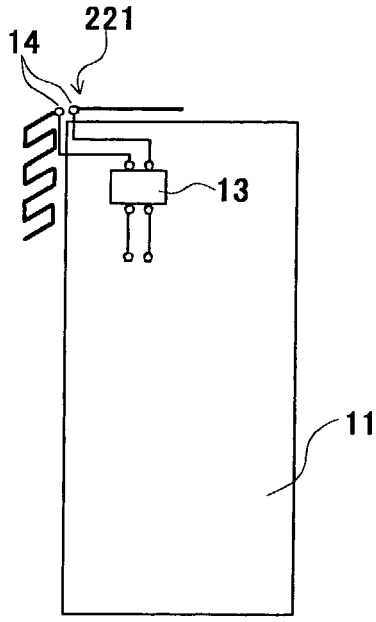
FIG. 45 is a schematic view showing a configuration of a built-in antenna for a radio communication terminal according to Embodiment 39 of the present invention.

FIG. 45 is a schematic diagram showing a configuration of the built-in antenna for a radio communication terminal according to Embodiment 39 of the present invention. As shown in this figure, the built-in antenna for a radio communication terminal according to Embodiment 39 is constructed of base plate 11, balance-to-unbalance transformation circuit 13 and dipole antenna 221. One of the two antenna elements making up dipole antenna 221 is rectangular-wave-shaped and the other is bar-shaped. These two antenna elements are placed in such a way that the longitudinal direction of the rectangular-wave-shaped antenna element intersects the axial direction of the bar-shaped antenna element at right angles.

Dipole antenna 221 is mounted in such a way that the longitudinal direction of the rectangular-wave-shaped antenna element is perpendicular to the upper surface (horizontal plane) of the radio communication terminal and the axial direction of the bar-shaped antenna element is parallel to the upper surface (horizontal plane) of the radio communication terminal.

As shown above, dipole antenna 221 is mounted in such a way that the longitudinal direction of the rectangular-wave-shaped antenna element is perpendicular to the upper surface (horizontal plane) of the radio communication terminal and the axial direction of the bar-shaped antenna element is parallel to the upper surface (horizontal plane) of the radio communication terminal. This allows dipole antenna 221 to receive vertically polarized waves parallel to the longitudinal direction of the rectangular-wave-shaped antenna element and horizontally polarized waves parallel to the axial direction of the bar-shaped antenna element in a free space. Furthermore, during a conversation, the human body acts as a reflector, and therefore dipole antenna 221 has directivity opposite to the human body.

Then, the operation of the built-in antenna for a radio communication terminal in the above configuration will be explained. An unbalanced signal from the transmission/reception circuit above is transformed to a balanced signal by balance-to-unbalance transformation circuit 13 and sent to dipole antenna 221. The rectangular-wave-shaped antenna element of dipole antenna 221 supplied with power in this way mainly sends vertically polarized waves parallel to the longitudinal direction of this rectangular-wave-shaped antenna element. Furthermore, during reception, the rectangular-wave-shaped antenna element of dipole antenna 221 receives vertically polarized waves parallel to the longitudinal direction above. On the other hand, the bar-shaped antenna element of dipole antenna 221 supplied with power in this way mainly sends horizontally polarized waves parallel to the axial direction of this bar-shaped antenna element. Furthermore, during reception, the bar-shaped antenna element of dipole antenna 221 receives horizontally polarized waves parallel to the axial direction above. Therefore, in a free space, vertically polarized waves and horizontally polarized waves are received from all directions centered on dipole antenna 221, and during a conversation, the human body acts as a reflector, and therefore of the vertically and horizontally polarized waves above, the vertically and horizontally polarized waves from the direction opposite to the human body are mainly received.

The signal above (balanced signal) received from dipole antenna 221 is sent to the transmission/reception circuit above via balance-to-unbalance transformation circuit 13. Here, the current that flows into base plate 11 is suppressed to a minimum by above-described balance-to-unbalance transformation circuit 13, and therefore the antenna operation by base plate 11 is prevented. This minimizes the reduction of gain caused by influence from the human body.

Thus, according to this embodiment, balance-to-unbalance transformation circuit 13 can minimize the antenna current that flows into base plate 11, and can thereby suppress deterioration of gain of dipole antenna 221 caused by influence from the human body. Furthermore, adopting a rectangular-wave shape for one of the antenna elements of dipole antenna 221 makes it possible to reduce the size of the built-in antenna for a radio communication terminal. Therefore, it is possible to provide a high gain and small built-in antenna for a radio communication terminal with less influence from the human body.

Furthermore, by mainly receiving vertically polarized waves using the rectangular-wave-shaped antenna element and mainly receiving horizontally polarized waves using the bar-shaped antenna element, it is possible to change the ratio of polarization of vertically polarized waves to horizontally polarized waves as appropriate and thereby receive waves at a ratio of polarization according to the purpose of use of the antenna.

(Embodiment 40)

Embodiment 40 is a mode in which the configuration of dipole antenna 221 in Embodiment 39 is changed. Embodiment 40 is the same as Embodiment 39 except for the configuration of the dipole antenna, and therefore detailed explanations thereof will be omitted. Differences of the built-in antenna for a radio communication terminal according to this embodiment from Embodiment 39 will be explained below using FIG. 46. The parts similar to those in Embodiment 39 are assigned the same reference numerals and detailed explanations thereof will be omitted.

Figure 46:
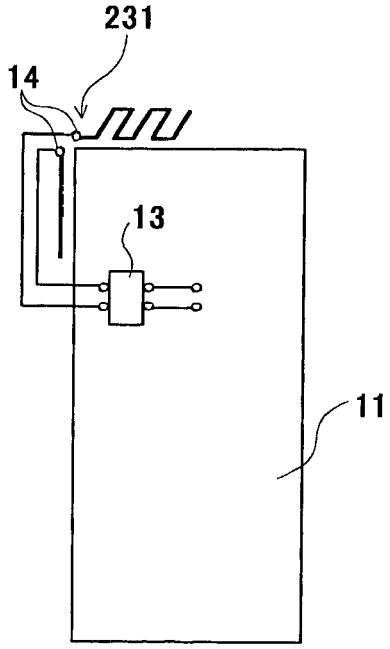
FIG. 46 is a schematic view showing a configuration of a built-in antenna for a radio communication terminal according to Embodiment 40 of the present invention.

FIG. 46 is a schematic diagram showing a configuration of the built-in antenna for a radio communication terminal according to Embodiment 40 of the present invention. As shown in this figure, the built-in antenna for a radio communication terminal according to Embodiment 40 is constructed of base plate 11, balance-to-unbalance transformation circuit 13 and dipole antenna 231. The two antenna elements making up dipole antenna 231 are placed in such a way that the longitudinal direction of the rectangular-wave-shaped antenna element intersects the axial direction of the bar-shaped antenna element at right angles.

Dipole antenna 231 is mounted in such a way that the longitudinal direction of the rectangular-wave-shaped antenna element is parallel to the upper surface (horizontal plane) of the radio communication terminal. On the other hand, the axial direction of the bar-shaped antenna element is perpendicular to the upper surface (horizontal plane) of the radio communication terminal. That is, this embodiment differs from Embodiment 39 in that the longitudinal direction of the rectangular-wave-shaped antenna element is parallel to the upper surface (horizontal plane) of the radio communication terminal and the axial direction of the bar-shaped antenna element is perpendicular to the upper surface (horizontal plane) of the radio communication terminal.

This allows dipole antenna 231 to receive horizontally polarized waves parallel to the longitudinal direction of the rectangular-wave-shaped antenna element and vertically polarized waves parallel to the axial direction of the bar-shaped antenna element in a free space. Furthermore, during a conversation, the human body acts as a reflector, and therefore dipole antenna 221 has directivity opposite to the human body.

Thus, this embodiment can also achieve effects similar to those of Embodiment 39. Furthermore, by mainly receiving vertically polarized waves using the bar-shaped antenna element and mainly receiving horizontally polarized waves using the rectangular-wave-shaped antenna element, it is possible to change the ratio of polarization of vertically polarized waves to horizontally polarized waves as appropriate and thereby receive waves at a ratio of polarization according to the purpose of use of the antenna.

(Embodiment 41)

Embodiment 41 is a mode in which the configuration of dipole antenna 31 in Embodiment 4 is changed. Embodiment 41 is the same as Embodiment 4 except for the configuration of the dipole antenna, and therefore detailed explanations thereof will be omitted. Differences of the built-in antenna for a radio communication terminal according to this embodiment from Embodiment 4 will be explained below using FIG. 47. The parts similar to those in Embodiment 4 are assigned the same reference numerals and detailed explanations thereof will be omitted.

Figure 47:
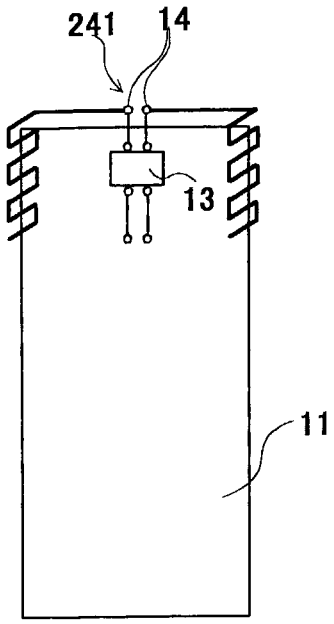
FIG. 47 is a schematic view showing a configuration of a built-in antenna for a radio communication terminal according to Embodiment 41 of the present invention.

FIG. 47 is a schematic diagram showing a configuration of the built-in antenna for a radio communication terminal according to Embodiment 41 of the present invention. As shown in this figure, the built-in antenna for a radio communication terminal according to Embodiment 41 is constructed of base plate 11, balance-to-unbalance transformation circuit 13, power supply terminals 14 and dipole antenna 241. The two antenna elements making up dipole antenna 241 are folded near the center and the parts of the folded antenna elements including power supply terminals 14 are bar-shaped and the other parts not including power supply terminals 14 are rectangular-wave-shaped. The two antenna elements are placed in such a way that their respective bar-shaped parts form a straight line.

Dipole antenna 241 is mounted in such a way that the longitudinal direction of the rectangular-wave-shaped part of each antenna element is perpendicular to the upper surface (horizontal plane) of the radio communication terminal and the axial direction of the bar-shaped part of each antenna element is parallel to the upper surface (horizontal plane) of the radio communication terminal.

This allows dipole antenna 241 to receive vertically polarized waves parallel to the longitudinal direction of the rectangular-wave-shaped part of each antenna element and horizontally polarized waves parallel to the axial direction of the bar-shaped part of each antenna element in a free space. Furthermore, during a conversation, the human body acts as a reflector, and therefore dipole antenna 241 has directivity opposite to the human body.

Then, the operation of the built-in antenna for a radio communication terminal in the above configuration will be explained. An unbalanced signal from the transmission/reception circuit above is transformed to a balanced signal by balance-to-unbalance transformation circuit 13 and sent to dipole antenna 241. The rectangular-wave-shaped part of each antenna element making up dipole antenna 241 supplied with power in this way mainly sends vertically polarized waves parallel to the longitudinal direction of this rectangular-wave-shaped part. Furthermore, during reception, dipole antenna 241 receives vertically polarized waves parallel to the longitudinal direction above. On the other hand, the bar-shaped part of each antenna element making up dipole antenna 241 supplied with power in this way mainly sends parallel polarized waves parallel to the axial direction of this bar-shaped part. Furthermore, during reception, horizontally polarized waves parallel to the axial direction above are received. In a free space, vertically polarized waves and horizontally polarized waves are received from all directions centered on dipole antenna 241 and during a conversation, the human body acts as a reflector, and therefore, of the above-described vertically polarized waves and horizontally polarized waves, vertically polarized waves and horizontally polarized waves from the direction opposite to the human body are mainly received.

The signal above (balanced signal) received from dipole antenna 241 is sent to the transmission/reception circuit above via balance-to-unbalance transformation circuit 13. Here, the current that flows into base plate 11 is suppressed to a minimum by above-described balance-to-unbalance transformation circuit 13, and therefore the antenna operation by base plate 11 is prevented. This minimizes the reduction of gain caused by influence from the human body.

Thus, this embodiment also achieves effects similar to those of Embodiment 39. Furthermore, by mainly receiving vertically polarized waves using the rectangular-wave-shaped part of each antenna element and mainly receiving horizontally polarized waves using the bar-shaped part of each antenna element, it is possible to change the ratio of polarization of vertically polarized waves to horizontally polarized waves as appropriate and thereby receive waves at a ratio of polarization according to the purpose of use of the antenna.

(Embodiment 42)

Embodiment 42 is a mode in which the configuration of dipole antenna 241 in Embodiment 41 is changed. Embodiment 42 is the same as Embodiment 41 except for the configuration of the dipole antenna, and therefore detailed explanations thereof will be omitted. Differences of the built-in antenna for a radio communication terminal according to this embodiment from Embodiment 41 will be explained below using FIG. 48. The parts similar to those in Embodiment 41 are assigned the same reference numerals and detailed explanations thereof will be omitted.

Figure 48:
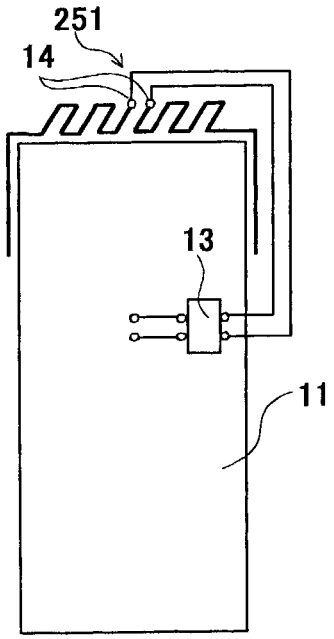
FIG. 48 is a schematic view showing a configuration of a built-in antenna for a radio communication terminal according to Embodiment 42 of the present invention.

FIG. 48 is a schematic diagram showing a configuration of the built-in antenna for a radio communication terminal according to Embodiment 42 of the present invention. As shown in this figure, the built-in antenna for a radio communication terminal according to Embodiment 42 is constructed of base plate 11, balance-to-unbalance transformation circuit 13, power supply terminals 14 and dipole antenna 251. The two antenna elements making up dipole antenna 251 are folded near the center and the parts of the folded antenna elements including the power supply terminals 14 are rectangular-wave-shaped and the other parts not including power supply terminals 14 are bar-shaped. The two antenna elements are placed in such a way that the centerlines in the longitudinal direction of the rectangular-wave-shaped parts form a straight line.

Dipole antenna 251 is mounted in such a way that the longitudinal direction of the rectangular-wave-shaped part of each antenna element is parallel to the upper surface (horizontal plane) of the radio communication terminal and the axial direction of the bar-shaped part of each antenna element is perpendicular to the upper surface (horizontal plane) of the radio communication terminal. That is, this embodiment differs from Embodiment 41 in that the longitudinal direction of the rectangular-wave-shaped part of each antenna element is parallel to the upper surface (horizontal plane) of the radio communication terminal and the axial direction of the bar-shaped part of each antenna element is perpendicular to the upper surface (horizontal plane) of the radio communication terminal.

This allows dipole antenna 251 to receive horizontally polarized waves parallel to the longitudinal direction of the rectangular-wave-shaped part of each antenna element and vertically polarized waves parallel to the axial direction of the bar-shaped part of each antenna element in a free space. Furthermore, during a conversation, the human body acts as a reflector, and therefore dipole antenna 251 has directivity opposite to the human body.

Thus, this embodiment also achieves effects similar to those of Embodiment 39. Furthermore, by mainly receiving vertically polarized waves using the bar-shaped part of each antenna element and mainly receiving horizontally polarized waves using the rectangular-wave-shaped part of each antenna element, it is possible to change the ratio of polarization of vertically polarized waves to horizontally polarized waves as appropriate and thereby receive waves at a ratio of polarization according to the purpose of use of the antenna.

(Embodiment 43)

Embodiment 43 is a mode in which the configuration of the dipole antenna used in each embodiment of the present Specification is changed.

Figure 49:
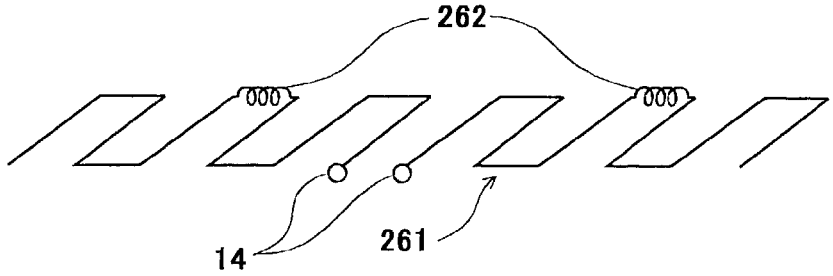
FIG. 49 is a schematic view showing a configuration of a folded-dipole antenna according to Embodiment 43 of the present invention.

FIG. 49 is a schematic diagram showing a configuration of dipole antenna 261 used in Embodiment 43 of the present invention. As shown in this figure, dipole antenna 261 according to Embodiment 43 is formed in such a way that inductance element 262 is inserted between the terminal of each rectangular-wave-shaped antenna element making up the dipole antenna and power supply terminal 14.

The dipole antenna 261 in the above configuration is applicable as the dipole antenna in each embodiment of the present Specification.

Thus, by applying dipole antenna 261 as the dipole antenna of each embodiment of the present Specification, this embodiment can attain effects similar to those in each embodiment of the present Specification and further step up impedance and perform impedance matching easily. Moreover, using dipole antenna 261 in the above configuration as the dipole antenna makes it possible to implement a double-frequency antenna.

(Embodiment 44)

Figure 50:
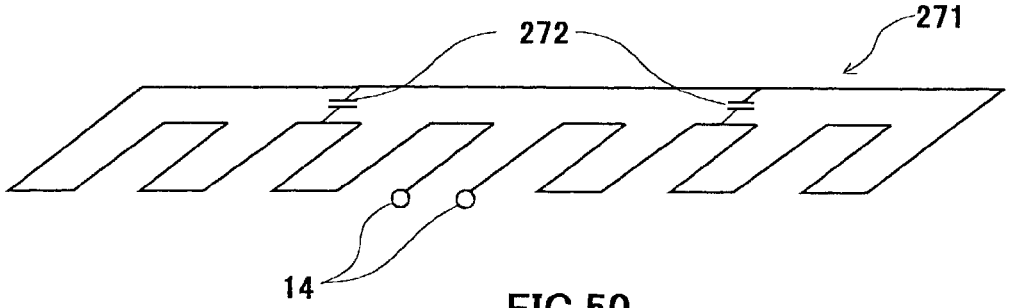
FIG. 50 is a schematic view showing a configuration of a folded-dipole antenna according to Embodiment 44 of the present invention.

Embodiment 44 is a mode in which the configuration of dipole antenna 101 in Embodiment 12 is changed. Embodiment 44 is the same as Embodiment 12 except for the configuration of the dipole antenna. In FIG. 50, the same components as those in the above-described embodiment are assigned the same reference numerals and explanations thereof will be omitted.

FIG. 50 is a schematic diagram showing a configuration of folded-dipole antenna 271 used in Embodiment 44 of the present invention. As shown in this figure, folded-dipole antenna 271 according to Embodiment 44 is formed in such away that two rectangular-wave-shaped antenna elements explained in the above-described embodiment are placed in parallel, these two rectangular-wave-shaped antenna elements placed in parallel are connected near the center using capacitance elements 272 and the ends of these two antenna elements are shorted.

The folded-dipole antenna 271 in the above configuration is applicable as the dipole antenna in each embodiment of the present Specification.

Thus, this embodiment can also obtain effects similar to those of Embodiment 12. Moreover, using dipole antenna 271 in the above configuration as the dipole antenna makes it possible to implement a double-frequency antenna.

(Embodiment 45)

Embodiment 45 is a mode in which the configuration of dipole antenna 121 in Embodiment 14 is changed. Embodiment 45 is the same as Embodiment 14 except for the configuration of the dipole antenna. The parts in FIG. 51 similar to those in the embodiment above are assigned the same reference numerals and detailed explanations thereof will be omitted.

Figure 51:
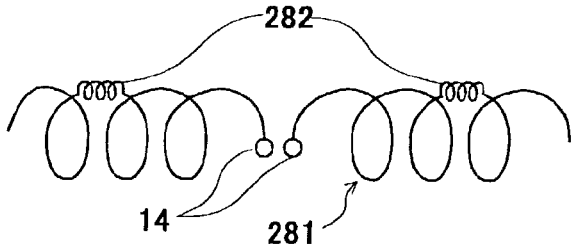
FIG. 51 is a schematic view showing a configuration of a folded-dipole antenna according to Embodiment 45 of the present invention.

FIG. 51 is a schematic diagram showing a configuration of dipole antenna 281 in Embodiment 45 of the present invention. As shown in this figure, the dipole antenna 281 according to Embodiment 45 is formed in such a way that inductance elements 282 are placed between the ends of the antenna elements making up spiral-shaped dipole antenna 121 explained in Embodiment 14 and power supply terminals 14.

Dipole antenna 281 in the above configuration is applicable as the dipole antenna in each embodiment of the present Specification.

Thus, this embodiment can also obtain effects similar to those of Embodiment 14. Moreover, using dipole antenna 281 in the above configuration as the dipole antenna makes it possible to implement a double-frequency antenna.

(Embodiment 46)

Embodiment 46 is a mode in which the configuration of dipole antenna 131 in Embodiment 15 is changed. Embodiment 46 is the same as Embodiment 15 except for the configuration of the dipole antenna. The parts in FIG. 52 similar to those in the embodiment above are assigned the same reference numerals and detailed explanations thereof will be omitted.

Figure 52:
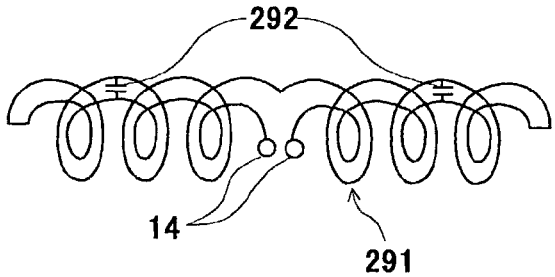
FIG. 52 is a schematic view showing a configuration of a folded-dipole antenna according to Embodiment 46 of the present invention.

FIG. 52 is a schematic diagram showing a configuration of folded-dipole antenna 291 in Embodiment 46 of the present invention. As shown in this figure, folded-dipole antenna 291 according to Embodiment 46 is formed in such a way that the two spiral-shaped antenna elements of dipole antenna 121 explained in Embodiment 14 are placed in parallel, these two antennal elements placed in parallel are connected by capacitances 292 near the center and the ends are shorted.

Folded-dipole antenna 291 in the above configuration is applicable as the antenna in each embodiment of the present Specification.

Thus, this embodiment can also obtain effects similar to those of Embodiment 15. Moreover, using dipole antenna 291 in the above configuration as the dipole antenna makes it possible to implement a double-frequency antenna.

(Embodiment 47)

Embodiment 47 is a mode in which the configuration of the dipole antenna in each embodiment of the present Specification is changed. Embodiment 47 is the same as each of the above-described embodiments except for the configuration of the dipole antenna. The parts in FIG. 53 similar to those in each of the above-described embodiments above are assigned the same reference numerals and detailed explanations thereof will be omitted.

Figure 53:
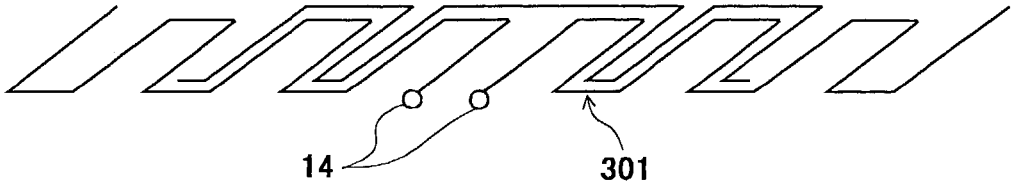
FIG. 53 is a schematic view showing a configuration of a folded-dipole antenna according to Embodiment 47 of the present invention.

FIG. 53 is a schematic diagram showing a configuration of dipole antenna 301 used in Embodiment 47 of the present invention. As shown in this figure, dipole antenna 301 according to Embodiment 47 is formed with a dipole antenna (for example, dipole antenna 12 in Embodiment 1) made up of two rectangular-wave-shaped antenna elements and another antenna element placed near the center of and in parallel to the above dipole antenna. In other words, dipole antenna 301 is formed in such a way that the above-described two rectangular-wave-shaped dipole antennas of different lengths are placed in parallel and the power supply terminals of the shorter one of the two dipole antennas placed in parallel are shorted.

Dipole antenna 301 in the above configuration is applicable as the dipole antenna in each embodiment of the present Specification.

Thus, this embodiment can also obtain effects similar to those of Embodiment 12. Moreover, using dipole antenna 301 in the above configuration as the dipole antenna makes it possible to implement a double-frequency antenna.

(Embodiment 48)

Embodiment 48 is a mode in which the configuration of the dipole antenna used in each embodiment of the present Specification is changed. Embodiment 48 is the same as each of the above-described embodiments except for the configuration of the dipole antenna. The parts in FIG. 54 similar to those in each of the above-described embodiments are assigned the same reference numerals and detailed explanations thereof will be omitted.

Figure 54:
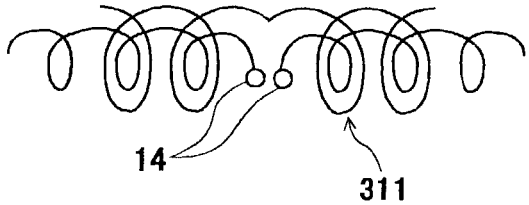
FIG. 54 is a schematic view showing a configuration of a folded-dipole antenna according to Embodiment 48 of the present invention.

FIG. 54 is a schematic diagram showing a configuration of dipole antenna 311 in Embodiment 48 of the present invention. As shown in this figure, dipole antenna 311 according to Embodiment 48 is formed with a dipole antenna made up of two spiral-shaped antenna elements (for example, dipole antenna 121 in Embodiment 14) and another spiral-shaped antenna element placed near the center of and in parallel to the above-described dipole antenna. In other words, this dipole antenna 311 is formed in such a way that the above-described two spiral-shaped dipole antennas of different lengths are placed in parallel and the power supply terminals of the shorter one of the two dipole antennas placed in parallel are shorted.

Dipole antenna 311 in the above configuration is applicable as the dipole antenna in each embodiment of the present Specification.

Thus, this embodiment can also obtain effects similar to those of Embodiment 14. Moreover, using dipole antenna 311 in the above configuration as the dipole antenna makes it possible to implement a double-frequency antenna.

By the way, folded-dipole antennas have a self-balancing action, and therefore a configuration without balance-to-unbalance transformation circuit 13 can also be used in Embodiment 44 and Embodiment 46.

The foregoing embodiments describe cases where antenna elements are rectangular-wave-shaped, but the present invention is not limited to this, and the antenna elements can also be bar-shaped depending on the transmission/reception frequency, the shape and size of the radio equipment that incorporates antennas.

(Embodiment 49)

Embodiment 49 is a mode in which the configuration of dipole antenna 12 in Embodiment 1 is changed and a first passive element is provided. Embodiment 49 is the same as Embodiment 1 except for the configuration of the dipole antenna and the first passive element. The parts in FIG. 55 similar to those in the embodiment above are assigned the same reference numerals and detailed explanations thereof will be omitted.

Figure 55:
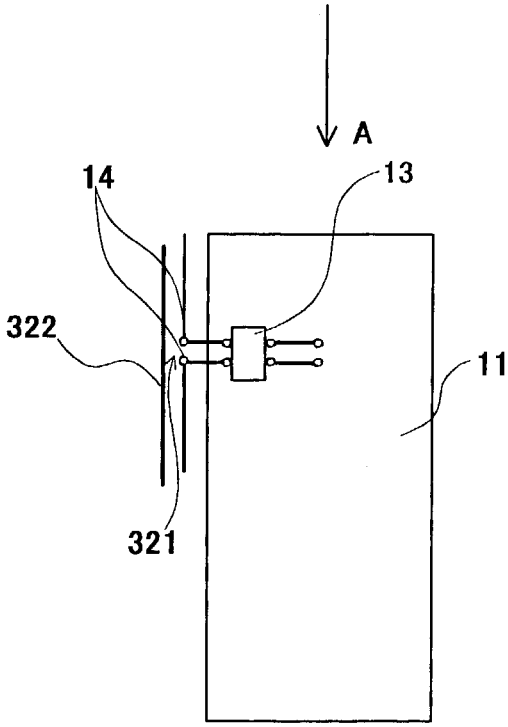
FIG. 55 is a schematic view showing a configuration of a built-in antenna for a radio communication terminal according to Embodiment 49 of the present invention.

FIG. 55 is a schematic diagram showing a configuration of a built-in antenna for a radio communication terminal according to Embodiment 49 of the present invention. As shown in this figure, the built-in antenna for a radio communication terminal according to Embodiment 49 is constructed of base plate 11, balance-to-unbalance transformation circuit 13, power supply terminals 14, dipole antenna 321 and first passive element 322. The built-in antenna for a radio communication terminal according to this embodiment is incorporated in a radio communication terminal.

Figure 56:
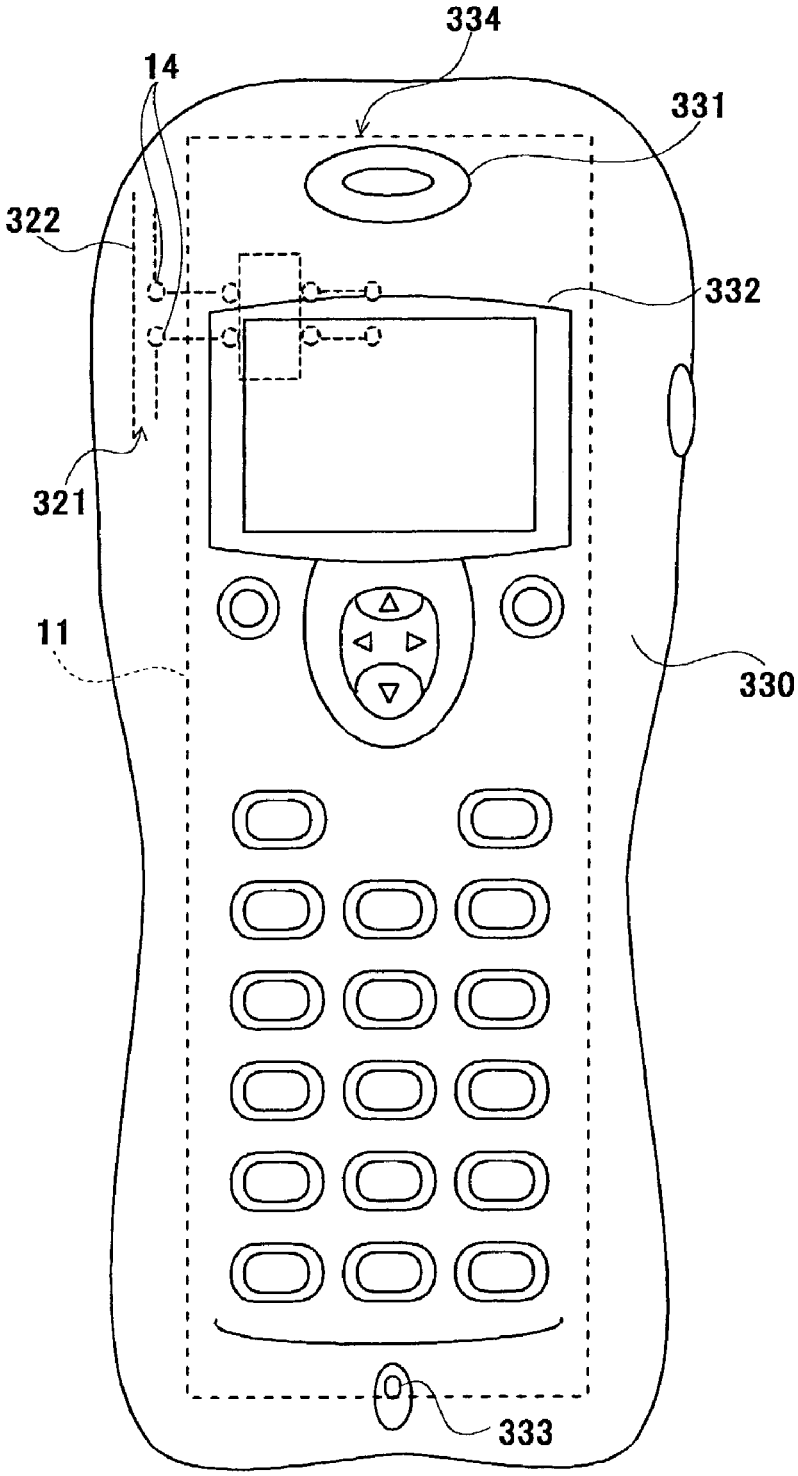
FIG. 56 is a front view showing an appearance of the radio communication terminal with the built-in antenna for a radio communication terminal according to Embodiment 49.

FIG. 56 is a front view showing the appearance of the radio communication terminal incorporating the built-in antenna for a radio communication terminal according to this embodiment. As shown in this figure, speaker 331 is provided at the top of the main plane of package 330. Below speaker 331 is display 332 that displays various kinds of information such as telephone numbers to be called and operation menu. At the bottom of the main plane of package 330 is microphone 333 to catch voice of the user. Furthermore, built-in antenna 334 for a radio communication terminal according to this embodiment is incorporated in package 330. This built-in antenna 334 for a radio communication terminal is installed in such a way that base plate 11 is placed in parallel to the main plane.

The components of the built-in antenna for a radio communication terminal according to this embodiment will be explained below with reference to FIG. 55.

Dipole antenna 321 is constructed of two bar-shaped antenna elements. The two antenna elements making up dipole antenna 321 are placed in such a way that their respective centerlines in the axial direction form one straight line.

Figure 57:
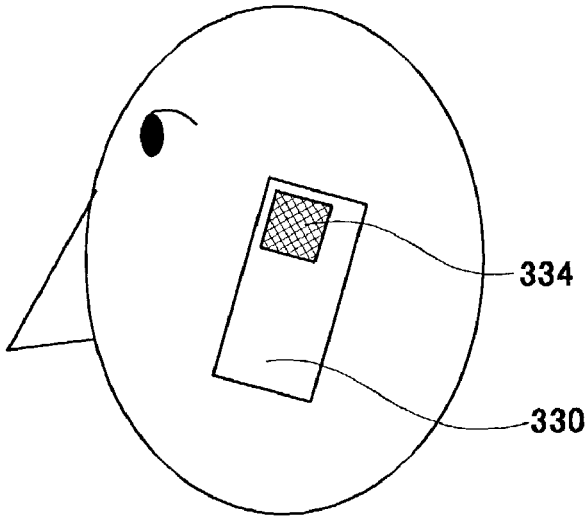
FIG. 57 is a schematic view of the radio communication terminal with the built-in antenna according to Embodiment 49 during a conversation.

Furthermore, dipole antenna 321 is mounted in such a way that the axial direction of the antenna elements is perpendicular to the upper surface (horizontal plane) of the radio communication terminal. Since the radio communication terminal is used in a state shown in FIG. 57, dipole antenna 321 is provided in such a way that the axial direction of the antenna elements is perpendicular to the horizontal plane. Thus, dipole antenna 321 mainly receives vertically polarized waves parallel to the axial direction of this dipole antenna 321 in a free space. Furthermore, since the human body acts as a reflector during a conversation, dipole antenna 321 has directivity opposite to the direction of the human body.

Figure 58:
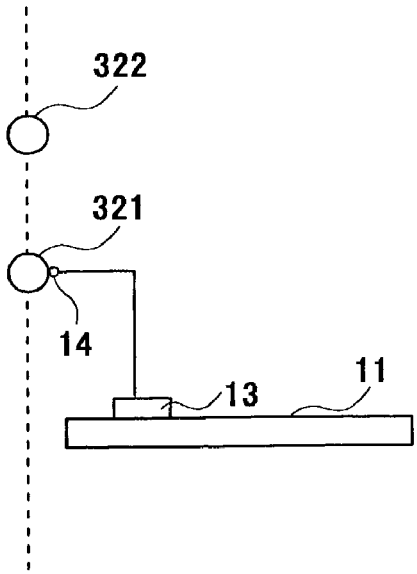
FIG. 58 is sectional view viewed from arrow A in FIG. 55 of the built-in antenna for a radio communication terminal according to Embodiment 49.

First passive element 322 is bar-shaped. First passive element 322 is parallel to the axial direction of the antenna elements making up dipole antenna 321 and the plane (reference plane) including the antenna elements making up dipole antenna 321 and this first passive element 322 intersects with the plane of base plate 11 at right angles. Since base plate 11 is provided in parallel to the main plane of package 330, the reference plane also intersects with the main plane of package 330 at right angles. FIG. 58 is a sectional view viewed from the direction of arrow A in FIG. 55 of the built-in antenna for a radio communication terminal according to this embodiment. As is apparent from this figure, first passive element 322 is placed in such a way that the plane (reference plane) formed by the antenna elements making up dipole antenna 321 and first passive element 322 intersects with the plane of base plate 11 at right angles. By placing dipole antenna 321 and first passive element 322 in this way, the plane (reference plane) formed by the antenna elements making up dipole antenna 321 and first passive element 322 also intersects with the main plane of package 330 shown in FIG. 56 at right angles.

Next, the operation of the built-in antenna for a radio communication terminal in the above configuration will be explained. An unbalanced signal from the transmission/reception circuit (not shown) above is transformed to a balanced signal by balance-to-unbalance transformation circuit 13 and then sent to dipole antenna 321. Dipole antenna 321 supplied with power in this way mainly sends vertically polarized waves, parallel to the axial direction of this dipole antenna 321.

A transmission signal sent from dipole antenna 321 has directivity along the reference plane and normal to the main plane of package 330 by changing factors such as the length of dipole antenna 321, length of first passive element 322 and distance between dipole antenna 321 and first passive element 322 as appropriate. The radio communication terminal is assumed to be used in a state shown in FIG. 57. In this case, since the main plane of package 330 faces the temporal region of the user's head, the transmission signal is transmitted in the direction opposite to the human body by adjusting the length of dipole antenna 321, length of first passive element 322 and distance between dipole antenna 321 and first passive element 322 as appropriate.

On the other hand, during reception, dipole antenna 321 receives vertically polarized waves parallel to the axial direction of dipole antenna 321. During a conversation, since directivity opposite to the human body is formed by adjusting the length of dipole antenna 321, length of first passive element 322 and distance between dipole antenna 321 and first passive element 322 as appropriate, of the vertically polarized waves above, the vertically polarized waves from the direction opposite to the human body are mainly received. Furthermore, since the human body acts as a reflector as described above, of the vertically polarized waves above, the vertically polarized waves opposite to the human body are mainly received.

The signals above (balanced signal) received by dipole antenna 321 are sent to the transmission/reception circuit above via balance-to-unbalance transformation circuit 13. Since balance-to-unbalance transformation circuit 13 above minimizes the current that flows into base plate 11, the antenna operation by base plate 11 is prevented. This suppresses deterioration of gain caused by influence from the human body to a minimum.

Thus, according to this embodiment, directivity opposite to the human body is formed for dipole antenna 321 by adjusting the length of dipole antenna 321, length of first passive element 322 and distance between dipole antenna 321 and first passive element 322 as appropriate, and therefore it is possible to suppress deterioration of gain by influence from the human body. Furthermore, as in the case of Embodiment 1 above, balance-to-unbalance transformation circuit 13 minimizes an antenna current that flows in to base plate 11 by transforming an unbalanced signal to a balanced signal as in the case of Embodiment 1 above, and therefore it is possible to prevent deterioration of gain of dipole antenna 321 caused by influence of the human body.

(Embodiment 50)

Embodiment 50 is a mode in which the method of mounting dipole antenna 321 and first passive element 322 in Embodiment 49 is changed. Since Embodiment 50 is the same as Embodiment 49 except for the method of mounting the dipole antenna and first passive element, detailed explanations thereof will be omitted. Differences of the built-in antenna for a radio communication terminal according to this embodiment from Embodiment 49 will be explained below using FIG. 59. The parts similar to those in Embodiment 49 are assigned the same reference numerals and detailed explanations thereof will be omitted.

Figure 59:
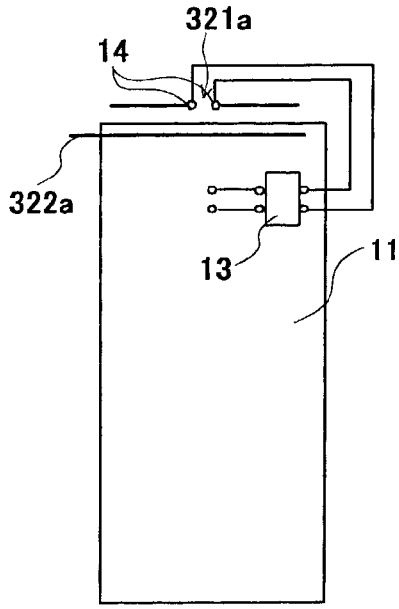
FIG. 59 is a schematic view showing a configuration of a built-in antenna for a radio communication terminal according to Embodiment 50 of the present invention.

FIG. 59 is a schematic diagram showing a configuration of the built-in antenna for a radio communication terminal according to Embodiment 50 of the present invention. As shown in this figure, the built-in antenna for a radio communication terminal according to Embodiment 50 is constructed of base plate 11, balance-to-unbalance transformation circuit 13, power supply terminals 14, dipole antenna 321*a* and first passive element 322*a*.

Dipole antenna 321*a* is mounted in such a way that the axial direction of the antenna elements is parallel to the upper surface (horizontal plane) of the radio communication terminal. That is, this embodiment is different from Embodiment 49 in that the axial direction of dipole antenna 321*a* is parallel to the upper surface (horizontal plane) of the radio communication terminal.

Thus, according to this embodiment, it is possible to suppress deterioration of gain caused by influence from the human body and also receive horizontally polarized waves parallel to the axial direction of dipole antenna 321*a* during reception. On the other hand, a signal sent from the other end of communication is a mixture of vertically polarized waves and horizontally polarized waves due to various factors such as reflection. Thus, when there are more horizontally polarized waves, the axial direction of the antenna matches the signal polarization plane, making it possible to increase the reception gain.

(Embodiment 51)

Embodiment 51 is a mode in which the configuration and method of mounting of dipole antenna 321 and first passive element 322 in Embodiment 49 are changed. Since Embodiment 51 is the same as Embodiment 49 except for the configuration and method of mounting of the dipole antenna and first passive element, detailed explanations thereof will be omitted. Differences of the built-in antenna for a radio communication terminal according to this embodiment from Embodiment 49 will be explained below using FIG. 60. The parts similar to those in Embodiment 49 are assigned the same reference numerals and detailed explanations thereof will be omitted.

Figure 60:
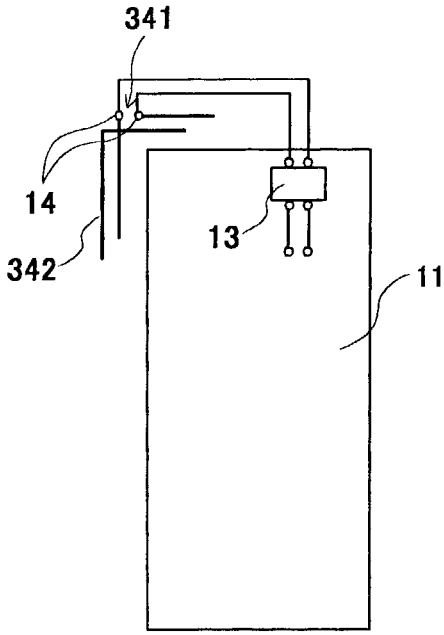
FIG. 60 is a schematic view showing a configuration of a built-in antenna for a radio communication terminal according to Embodiment 51 of the present invention.

FIG. 60 is a schematic diagram showing a configuration of the built-in antenna for a radio communication terminal according to Embodiment 51 of the present invention. As shown in this figure, the built-in antenna for a radio communication terminal according to Embodiment 51 is constructed of base plate 11, balance-to-unbalance transformation circuit 13, power supply terminals 14, dipole antenna 341 and first passive element 342. The two antenna elements making up dipole antenna 341 are placed perpendicular to each other. First passive element 342 is folded near the center and the folded sides are formed in such a way as to intersect with each other at right angles.

Dipole antenna 341 is mounted in such a way that one antenna element is perpendicular to the upper surface (horizontal plane) of the radio communication terminal and the other antenna element is parallel to the upper surface (horizontal plane) of the radio communication terminal. Furthermore, first passive element 342 is mounted in such a way that one of the folded rectilinear parts is perpendicular to the upper surface (horizontal plane) of the radio communication terminal and the other folded rectilinear part is parallel to the upper surface (horizontal plane) of the radio communication terminal.

Next, the operation of the built-in antenna for a radio communication terminal in the above configuration will be explained. An unbalanced signal from the transmission/reception circuit of the radio communication terminal is transformed to a balanced signal by balance-to-unbalance transformation circuit 13 and then sent to dipole antenna 341. The antenna element placed perpendicular to the upper surface (horizontal plane) of the radio communication terminal making up dipole antenna 341 supplied with power in this way mainly sends vertically polarized waves parallel to the axial direction of this antenna element. On the other hand, the antenna element placed in parallel to the upper surface (horizontal plane) of the radio communication terminal making up dipole antenna 341 sends horizontally polarized waves parallel to the axial direction of this antenna element.

A transmission signal sent from dipole antenna 341 has directivity along the reference plane and normal to the main plane of package 330 by changing the length of dipole antenna 341, length of first passive element 342 and distance between dipole antenna 341 and first passive element 342 as appropriate. The radio communication terminal is assumed to be used in a state shown in FIG. 57. In this case, since the main plane of package 330 faces the temporal region of the user's head, the transmission signal is transmitted in the direction opposite to the human body by adjusting the length of dipole antenna 341, length of first passive element 342 and distance between dipole antenna 341 and first passive element 342 as appropriate.

On the other hand, during reception, the antenna element making up dipole antenna 341 placed perpendicular to the upper surface (horizontal plane) of the radio communication terminal mainly receives vertically polarized waves parallel to the axial direction of this antenna element. On the other hand, the antenna element making up dipole antenna 341 placed in parallel to the upper surface (horizontal plane) of the radio communication terminal mainly receives horizontally polarized waves parallel to the axial direction of this antenna element. Furthermore, during a conversation, since directivity opposite to the human body is formed by adjusting the length of dipole antenna 341, length of first passive element 342 and distance between dipole antenna 341 and first passive element 342 as appropriate, of the vertically and horizontally polarized waves above, the vertically and horizontally polarized waves from the direction opposite to the human body are mainly received. Furthermore, since the human body acts as a reflector as described above, of the vertically and horizontally polarized waves, the vertically and horizontally polarized waves opposite to the human body are mainly received.

Thus, according to this embodiment, it is possible to suppress deterioration of gain caused by influence from the human body and receive both vertically polarized waves and horizontally polarized waves parallel to the axial direction of each antenna element of dipole antenna 341 during reception. On the other hand, a signal sent from the other end of communication is a mixture of vertically polarized waves and horizontally polarized waves due to various factors such as reflection. Thus, even if there are either more vertically polarized waves or more horizontally polarized waves, the axial direction of either of the antenna elements of dipole antenna 341 matches the polarization plane of the signal sent from the other end of communication, and therefore the built-in antenna for a radio communication terminal according to this embodiment can increase reception gain.

(Embodiment 52)

Embodiment 52 is a mode in which the configuration and method of mounting of dipole antenna 321 and first passive element 322 in Embodiment 49 are changed. Since Embodiment 52 is the same as Embodiment 49 except for the configuration and method of mounting of the dipole antenna and first passive element, detailed explanations thereof will be omitted. Differences of the built-in antenna for a radio communication terminal according to this embodiment from Embodiment 49 will be explained below using FIG. 61. The parts similar to those in Embodiment 49 are assigned the same reference numerals and detailed explanations thereof will be omitted.

Figure 61:
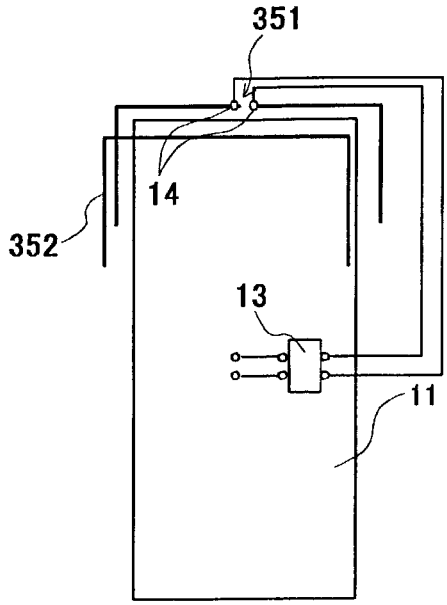
FIG. 61 is a schematic view showing a configuration of a built-in antenna for a radio communication terminal according to Embodiment 52 of the present invention.

FIG. 61 is a schematic diagram showing a configuration of the built-in antenna for a radio communication terminal according to Embodiment 52 of the present invention. As shown in this figure, the built-in antenna for a radio communication terminal according to Embodiment 52 is constructed of base plate 11, balance-to-unbalance transformation circuit 13, power supply terminals 14, dipole antenna 351 and first passive element 352. The two antenna elements making up dipole antenna 351 are folded near the center and the folded rectilinear parts are formed in such a way as to intersect with each other at right angles. First passive element 352 is folded at a point at a predetermined distance from one end and the folded adjacent rectilinear parts are formed in such a way as to intersect at right angles. Furthermore, first passive element 352 is also folded at a point at a predetermined distance from the other end and the folded adjacent rectilinear parts are formed in such a way as to intersect at right angles. At this time, the folded rectilinear parts including both ends of first passive element 352 are parallel to each other. The folded rectilinear part (central part) not including the both ends is formed to be longer than the width of base plate 11.

Each antenna element making up dipole antenna 351 in the above configuration is mounted in such a way that the folded rectilinear parts including power supply terminals 14 are parallel to the upper surface (horizontal plane) of the radio communication terminal and the folded rectilinear parts not including power supply terminals 14 are perpendicular to the upper surface (horizontal plane) of the radio communication terminal. Furthermore, first passive element 352 is mounted in such a way that the folded rectilinear parts including the ends are perpendicular to the upper surface (horizontal plane) of the radio communication terminal and the folded rectilinear part not including the ends is parallel to the upper surface (horizontal plane) of the radio communication terminal.

Next, the operation of the built-in antenna for a radio communication terminal in the above configuration will be explained. An unbalanced signal from the transmission/reception circuit above provided for the radio communication terminal is transformed to a balanced signal by balance-to-unbalance transformation circuit 13 and then sent to dipole antenna 351. The parts of the antenna elements making up dipole antenna 351 supplied with power in this way placed perpendicular to the upper surface (horizontal plane) of the radio communication terminal mainly send vertically polarized waves parallel to the axial direction of these parts. On the other hand, the parts of the antenna elements making up dipole antenna 351 placed in parallel to the upper surface (horizontal plane) of the radio communication terminal send horizontally polarized waves parallel to the axial direction of these parts.

A transmission signal sent from dipole antenna 351 has directivity along the reference plane and normal to the main plane of package 330 by adjusting the length of dipole antenna 351, length of first passive element 352 and distance between dipole antenna 351 and first passive element 352 as appropriate. The radio communication terminal is assumed to be used in a state shown in FIG. 57. In this case, since the main plane of package 330 faces the temporal region of the user is head, the transmission signal is transmitted in the direction opposite to the human body by adjusting the length of dipole antenna 351, length of first passive element 352 and distance between dipole antenna 351 and first passive element 352 as appropriate.

Figure 62:
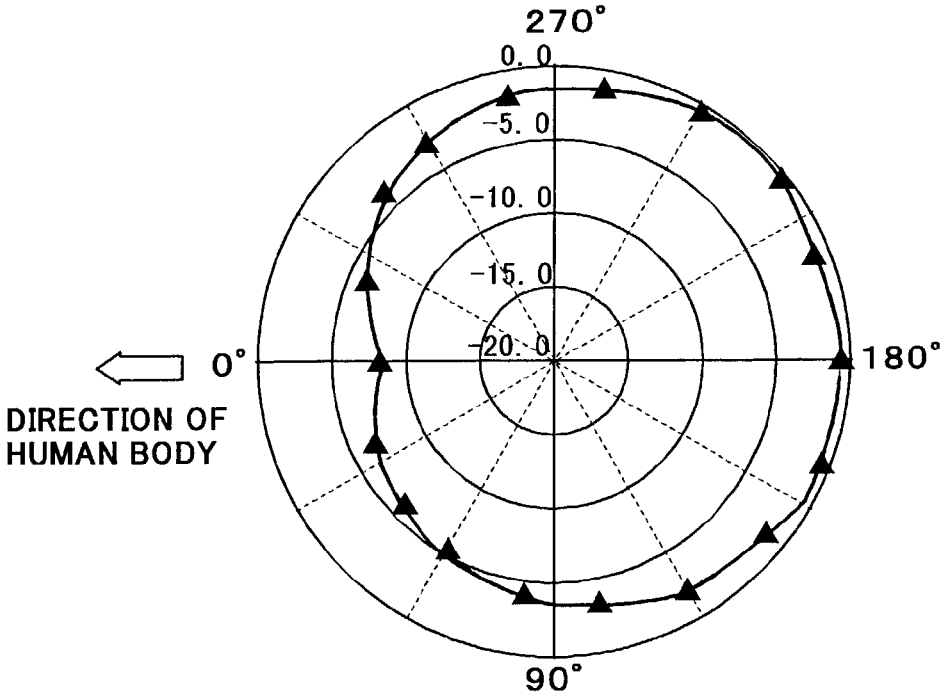
FIG. 62 illustrates measured values of a radiation characteristic in a free space of the built-in antenna for a radio communication terminal according to Embodiment 52.

Here, the radiation characteristic of the built-in antenna for a radio communication terminal in the above configuration in a free space will be explained with reference to FIG. 62. FIG. 62 illustrates actual measured values of the radiation characteristic of the built-in antenna for a radio communication terminal according to this embodiment in a free space. Here, suppose the size of base plate 11 is 27×114 mm, the length of the side of the antenna element making up dipole antenna 351 placed in parallel to the upper surface (horizontal plane) of the radio communication terminal apparatus is 33 mm, the length of the part of the antenna element making up dipole antenna 351 placed perpendicular to the upper surface (horizontal plane) of the radio communication terminal apparatus is 17 mm and the distance of dipole antenna 12 from the human body is 4 mm. In FIG. 62, the direction at 0° viewed from the origin corresponds to the direction of the human body viewed from dipole antenna 351 in FIG. 61. As is apparent from FIG. 62, by adjusting the length of dipole antenna 351, length of first passive element 352 and distance between dipole antenna 351 and first passive element 352 as appropriate, the built-in antenna for a radio communication terminal according to this embodiment has directivity opposite to the direction of the human body.

Figure 63:
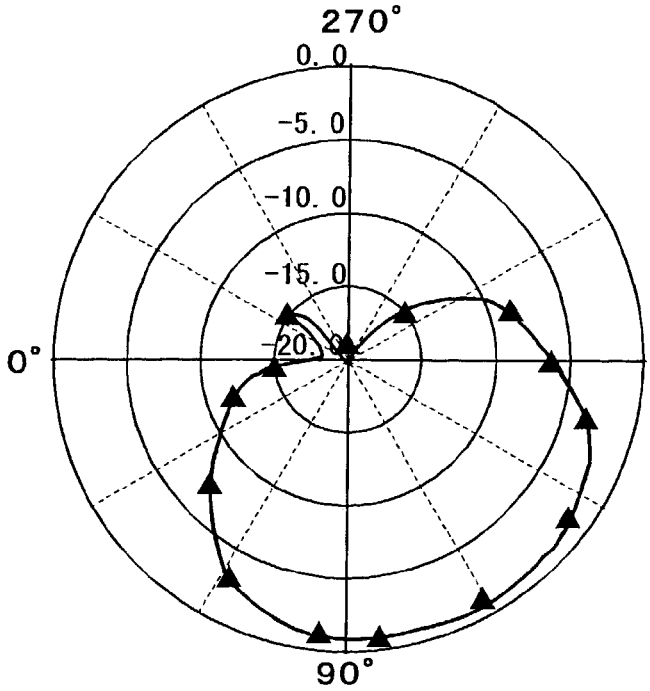
FIG. 63 illustrates measured values of a radiation characteristic during a conversation of the built-in antenna for a radio communication terminal according to Embodiment 52.

Then, the radiation characteristic of the built-in antenna for a radio communication terminal in the above configuration will be explained with reference to FIG. 63. FIG. 63 illustrates actual measured values of the radiation characteristic of the built-in antenna for a radio communication terminal according to this embodiment during a conversation. The sizes, etc. of the components as the measuring condition are the same as those when the radiation characteristic shown in FIG. 62 is measured. In FIG. 63, the direction at 0° viewed from the origin corresponds to the direction of the human body viewed from dipole antenna 351 in FIG. 61.

Figure 5A:
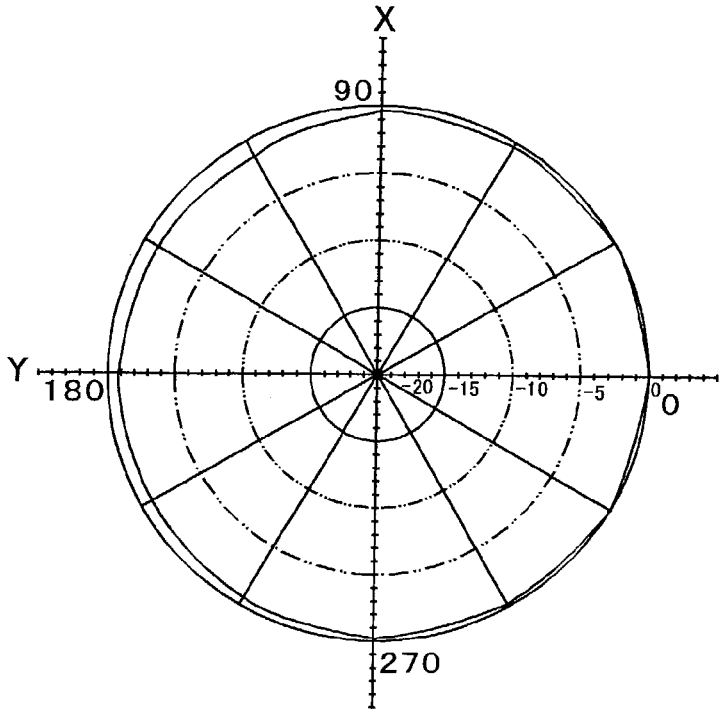
FIG. 5A illustrates a radiation characteristic in a free space of the tabular reverse F-figured antenna used for the conventional radio communication terminal.
Figure 5B:
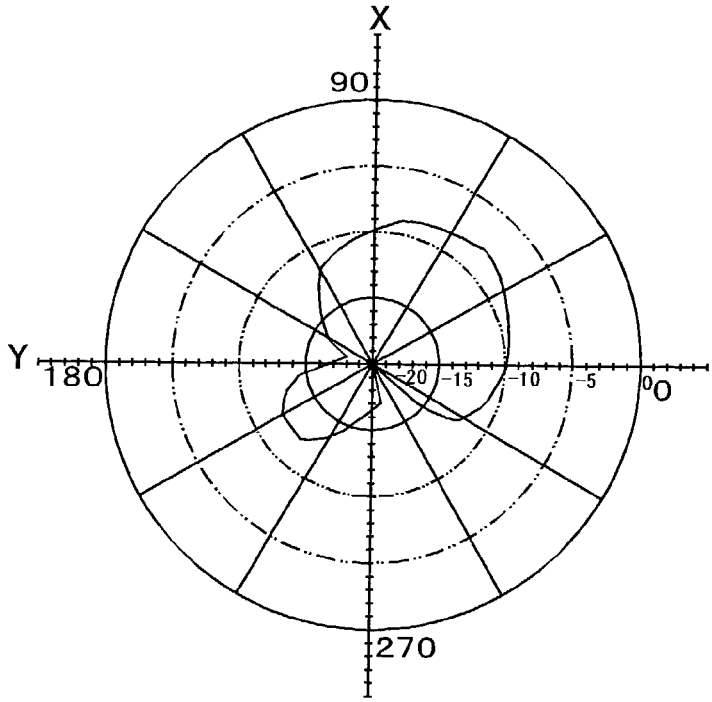
FIG. 5B illustrates a radiation characteristic during a conversation of the tabular reverse F-figured antenna used for the conventional radio communication terminal.

As is apparent from FIG. 63, by adjusting the length of dipole antenna 351, length of first passive element 352 and distance between dipole antenna 351 and first passive element 352 as appropriate, the built-in antenna for a radio communication terminal according to this embodiment has directivity opposite to the direction of the human body. This makes it possible to suppress deterioration of gain caused by influence from the human body during transmission and thereby achieve higher gain than the conventional example shown in FIG. 5B.

Thus, according to this embodiment, it is possible to suppress deterioration of gain caused by influence from the human body and receive both vertically polarized waves and horizontally polarized waves parallel to the axial direction of each part of each antenna element of dipole antenna 351 during reception. On the other hand, a signal sent from the other end of communication is a mixture of vertically polarized waves and horizontally polarized waves due to various factors such as reflection. Thus, even if there are either more vertically polarized waves or more horizontally polarized waves, the axial direction of either part of each antenna element of dipole antenna 351 matches the polarization plane of the signal sent from the other end of communication, and therefore the built-in antenna for a radio communication terminal according to this embodiment can increase reception gain.

Following Embodiment 53 to Embodiment 59 are modes in which a diversity antenna is implemented using the built-in antenna for a radio communication terminal in Embodiment 49 to Embodiment 52.

(Embodiment 53)

Embodiment 53 is a mode in which a diversity antenna is implemented using the built-in antenna for a radio communication terminal in Embodiment 49. The diversity antenna for a radio communication terminal according to this embodiment will be explained using FIG. 64. The parts similar to those in Embodiment 49 are assigned the same reference numerals and detailed explanations thereof will be omitted.

Figure 64:
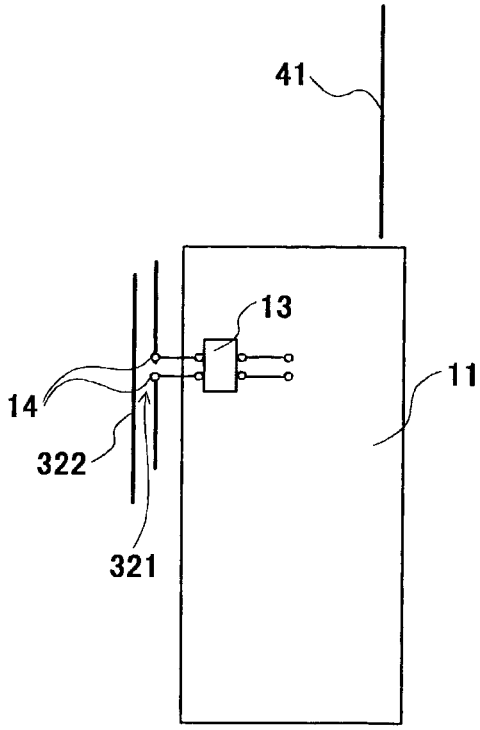
FIG. 64 is a schematic view showing a configuration of a diversity antenna for a radio communication terminal according to Embodiment 53 of the present invention.

FIG. 64 is a schematic diagram showing a configuration of the diversity antenna for a radio communication terminal according to Embodiment 53 of the present invention. In FIG. 64, monopole antenna 41 is further added to the configuration of the built-in antenna for a radio communication terminal according to Embodiment 49.

Here, suppose one antenna making up the diversity antenna is dipole antenna 321 in Embodiment 49 and used for reception only. Also suppose the other antenna making up the diversity antenna is monopole antenna 41 and used for both transmission and reception.

In the diversity antenna for a radio communication terminal in the above configuration, only monopole antenna 41 operates during transmission and both dipole antenna 321 and monopole antenna 41 operate during reception to carry out diversity reception.

Thus, according to this embodiment, dipole antenna 321 in Embodiment 49 is used as the diversity antenna, which makes it possible to provide a high gain diversity antenna for a radio communication terminal with less influence from the human body as in the case of Embodiment 49.

(Embodiment 54)

Embodiment 54 is a mode in which the configuration of monopole antenna 41 in Embodiment 53 is changed. The diversity antenna for a radio communication terminal according to this embodiment will be explained using FIG. 65. The components similar to those in Embodiment 53 are assigned the same reference numerals and detailed explanations thereof will be omitted.

Figure 65:
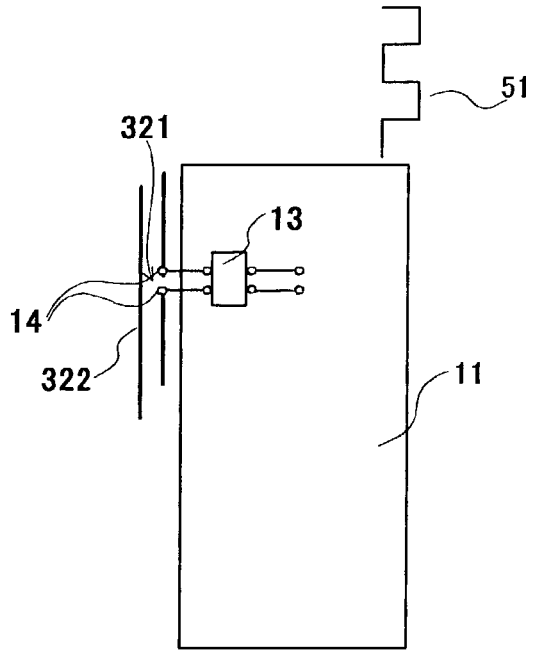
FIG. 65 is a schematic view showing a configuration of a diversity antenna for a radio communication terminal according to Embodiment 54 of the present invention.

FIG. 65 is a schematic diagram showing a configuration of the diversity antenna for a radio communication terminal according to Embodiment 54 of the present invention. As shown in this figure, the diversity antenna for a radio communication terminal according to Embodiment 54 is constructed of base plate 11, dipole antenna 321, balance-to-unbalance transformation circuit 13, power supply terminals 14 and monopole antenna 51. Monopole antenna 51 is constructed of a rectangular-wave-shaped antenna element.

In the diversity antenna for a radio communication terminal in the above configuration, only monopole antenna 51 operates during transmission and both dipole antenna 321 and monopole antenna 51 operate during reception to carry out diversity reception.

Thus, according to this embodiment, dipole antenna 321 in Embodiment 49 is used as the diversity antenna, which makes it possible to provide a high gain diversity antenna for a radio communication terminal with less influence from the human body as in the case of Embodiment 49.

(Embodiment 55)

Embodiment 55 is a mode in which the configuration of monopole antenna 41 in Embodiment 53 is changed. The diversity antenna for a radio communication terminal according to this embodiment will be explained using FIG. 66. The components similar to those in Embodiment 53 are assigned the same reference numerals and detailed explanations thereof will be omitted.

Figure 66:
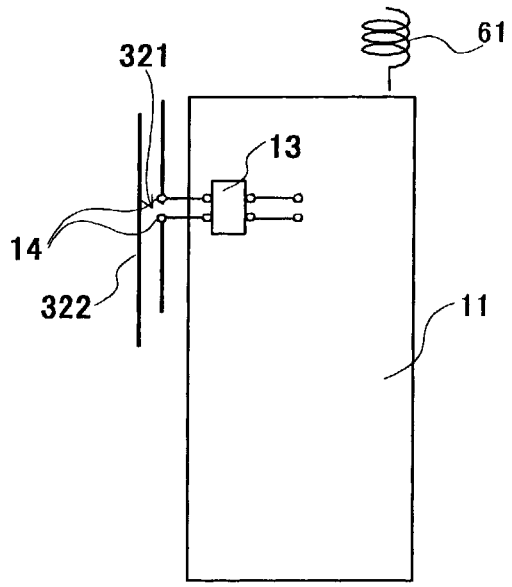
FIG. 66 is a schematic view showing a configuration of a diversity antenna for a radio communication terminal according to Embodiment 55 of the present invention.

FIG. 66 is a schematic diagram showing a configuration of the diversity antenna for a radio communication terminal according to Embodiment 55 of the present invention. As shown in this figure, the diversity antenna for a radio communication terminal according to Embodiment 55 is constructed of base plate 11, dipole antenna 321, balance-to-unbalance transformation circuit 13, power supply terminals 14 and monopole antenna 61. Monopole antenna 61 is constructed of a spiral-shaped antenna element.

In the diversity antenna for a radio communication terminal in the above configuration, only monopole antenna 61 operates during transmission and both dipole antenna 321 and monopole antenna 61 operate during reception to carry out diversity reception.

Thus, this embodiment configured as shown above can also attain effects similar to those in Embodiment 54.

(Embodiment 56)

Embodiment 56 is a mode in which a diversity antenna is implemented using the built-in antenna for a radio communication terminal in Embodiment 49. The diversity antenna for a radio communication terminal according to this embodiment will be explained using FIG. 67. The components similar to those in Embodiment 49 are assigned the same reference numerals and detailed explanations thereof will be omitted.

Figure 67:
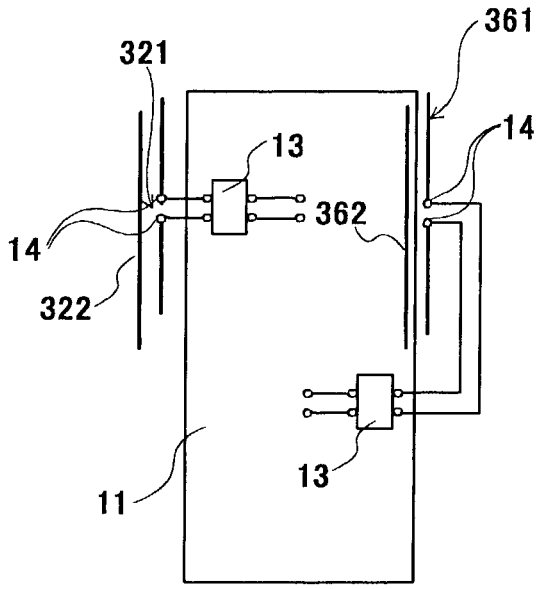
FIG. 67 is a schematic view showing a configuration of a diversity antenna for a radio communication terminal according to Embodiment 56 of the present invention.

FIG. 67 is a schematic diagram showing a configuration of the diversity antenna for a radio communication terminal according to Embodiment 56 of the present invention. As shown in this figure, another dipole antenna 361 and first passive element 362 are added to the side of base plate 11 in addition to the configuration of the built-in antenna for a radio communication terminal according to Embodiment 49. Dipole antenna 361 has a configuration similar to that of dipole antenna 321.

Here, suppose one antenna making up the diversity antenna is dipole antenna 321 in Embodiment 49 and used for reception only. Suppose the other antenna making up the diversity antenna is dipole antenna 361 and used for both transmission and reception.

In the diversity antenna for a radio communication terminal in the above configuration, only dipole antenna 361 operates during transmission and both dipole antenna 321 and dipole antenna 361 operate during reception to carry out diversity reception.

Thus, according to this embodiment, dipole antenna 321 in Embodiment 49 and dipole antenna 361 constructed in the same way as dipole antenna 321 are used as the diversity antenna, and it is therefore possible to provide a high gain diversity antenna for a radio communication terminal with less influence from the human body.

(Embodiment 57)

Embodiment 57 is a mode in which the method of mounting dipole antenna 361 and first passive element 362 in Embodiment 56 is changed. Since Embodiment 57 is the same as Embodiment 56 except for the method of mounting the dipole antenna and first passive element, detailed explanations thereof will be omitted. Differences of the built-in antenna for a radio communication terminal according to this embodiment from Embodiment 56 will be explained below using FIG. 68. The parts similar to those in Embodiment 56 are assigned the same reference numerals and detailed explanations thereof will be omitted.

Figure 68:
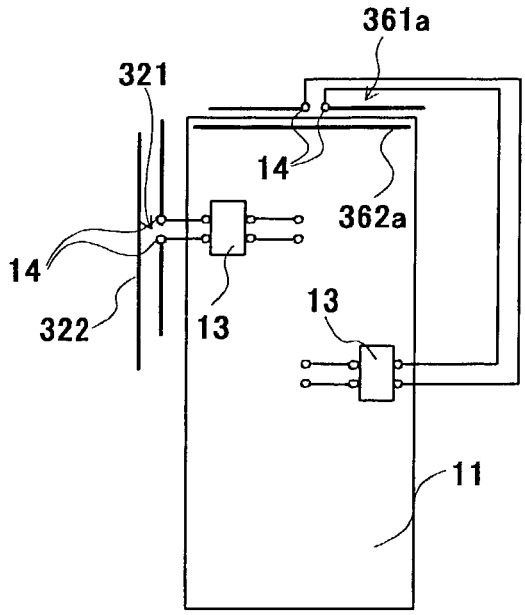
FIG. 68 is a schematic view showing a configuration of a diversity antenna for a radio communication terminal according to Embodiment 57 of the present invention.

FIG. 68 is a schematic diagram showing a configuration of the diversity antenna for a radio communication terminal according to Embodiment 57 of the present invention. As shown in this figure, additional dipole antenna 361*a* is mounted in such a way that its axial direction is parallel to the upper surface (horizontal plane) of the radio communication terminal. Furthermore, additional first passive element 362*a* is also mounted in such a way that its axial direction is parallel to the upper surface (horizontal plane) of the radio communication terminal. That is, this embodiment differs from Embodiment 56 in that the axial direction of dipole antenna 361*a* is parallel to the upper surface (horizontal plane) of the radio communication terminal and the axial direction of first passive element 362*a* is parallel to the upper surface (horizontal plane) of the radio communication terminal. As a result, dipole antenna 361*a* is provided in such a way that its axial direction is parallel to the horizontal plane during a conversation.

In the diversity antenna for a radio communication terminal in the above configuration, only dipole antenna 361*a* operates during transmission and both dipole antenna 321 and dipole antenna 361*a* operate during reception to carry out diversity reception.

Thus, dipole antenna 321 can suppress deterioration of gain and at the same time mainly receive vertically polarized waves parallel to the axial direction of the antenna element. Furthermore, dipole antenna 361*a* can not only suppress deterioration of gain but also mainly receive horizontally polarized waves parallel to the axial direction of the antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the axial direction of either dipole antenna 321 or 361*a* matches the plane of polarization of the signal sent from the other end of communication and, therefore the built-in antenna for a radio communication terminal according to this embodiment can increase the reception gain.

Thus, this embodiment uses dipole antenna 321 in Embodiment 49 and dipole antenna 361*a* constructed in the same as dipole antenna 321 as the diversity antenna, and can thereby provide a high gain diversity antenna for a radio communication terminal with less influence from the human body.

(Embodiment 58)

Figure 69:
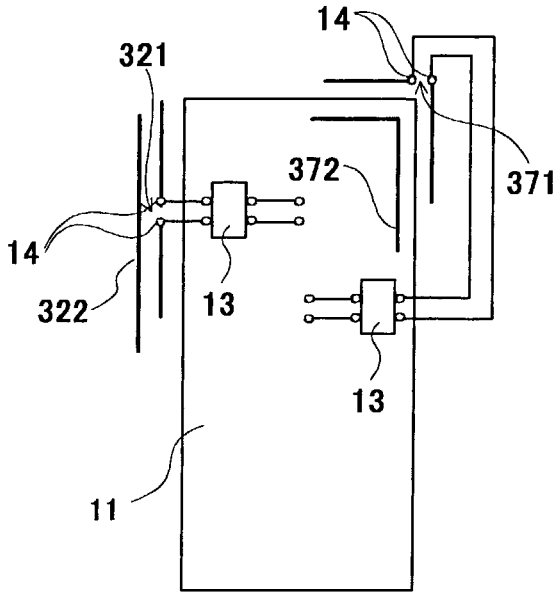
FIG. 69 is a schematic view showing a configuration of a diversity antenna for a radio communication terminal according to Embodiment 58 of the present invention.

As shown in FIG. 69, Embodiment 58 is a mode in which dipole antenna 361 used in Embodiment 56 for both transmission and reception is changed to dipole antenna 371 which is constructed in the same way as dipole antenna 341 in Embodiment 51 and first passive element 362 is changed to first passive element 372 constructed in the same way as first passive element 342 in Embodiment 51. Embodiment 58 is the same as Embodiment 56 except for the configurations and the method of mounting of dipole antenna 371 and first passive element 372. The same parts in FIG. 69 as those in Embodiment 56 are assigned the same reference numerals and detailed explanations thereof will be omitted.

FIG. 69 is a schematic diagram showing a configuration of the diversity antenna for a radio communication terminal according to Embodiment 58 of the present invention. As shown in this figure, dipole antenna 371 is mounted in such a way that the axial direction of one antenna element is perpendicular to the upper surface (horizontal plane) of the radio communication terminal and the axial direction of the other antenna element is parallel to the upper surface (horizontal plane) of the radio communication terminal.

In the diversity antenna for a radio communication terminal in the above configuration, only dipole antenna 371 operates during transmission and both dipole antenna 321 and dipole antenna 371 operate during reception to carry out diversity reception.

Thus, dipole antenna 371 can suppress deterioration of gain and at the same time mainly receive vertically polarized waves and horizontally polarized waves parallel to the axial direction of each antenna element. Furthermore, dipole antenna 321 can not only suppress deterioration of gain but also mainly receive vertically polarized waves parallel to the axial direction of the antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the axial direction of either antenna element of dipole antenna 321 or 371 matches the plane of polarization of the signal sent from the other end of communication, and therefore the built-in antenna for a radio communication terminal according to this embodiment can increase the reception gain.

Thus, this embodiment uses dipole antenna 321 in Embodiment 49 and dipole antenna 371 constructed in the same way as dipole antenna 341 in Embodiment 51 as the diversity antenna, and can thereby provide a high gain diversity antenna for a radio communication terminal with less influence from the human body.

(Embodiment 59)

Figure 70:
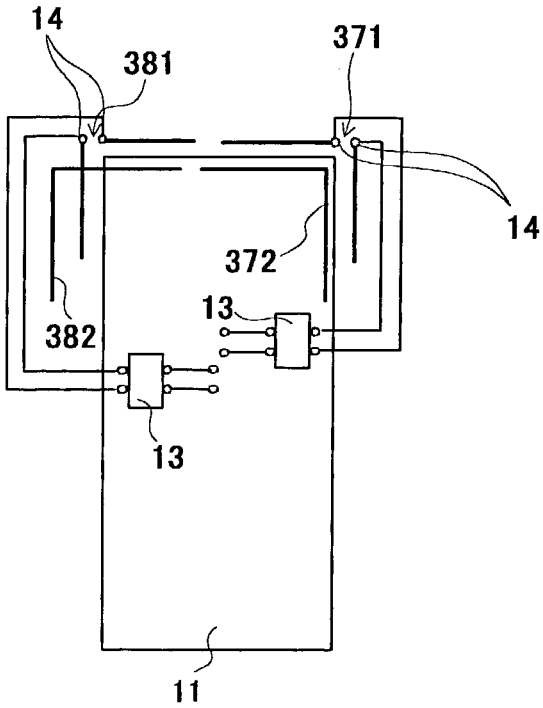
FIG. 70 is a schematic view showing a configuration of a diversity antenna for a radio communication terminal according to Embodiment 59 of the present invention.

As shown in FIG. 70, Embodiment 59 is a mode in which dipole antenna 321 in Embodiment 58 used for reception only is changed to dipole antenna 381 constructed in the same way as dipole antenna 341 in Embodiment 51 and first passive element 322 is changed to first passive element 382 constructed in the same way as first passive element 342 in Embodiment 51. Embodiment 59 is the same as Embodiment 58 except for the configurations and the method of mounting of dipole antenna 381 and first passive element 382. The same parts in FIG. 70 as those in Embodiment 58 are assigned the same reference numerals and detailed explanations thereof will be omitted.

FIG. 70 is a schematic diagram showing a configuration of the diversity antenna for a radio communication terminal according to Embodiment 59 of the present invention. As shown in this figure, both dipole antenna 371 and dipole antenna 381 are mounted in such a way that the axial direction of one antenna element is perpendicular to the upper surface (horizontal plane) of the radio communication terminal and the axial direction of the other antenna element is parallel to the upper surface (horizontal plane) of the radio communication terminal.

In the diversity antenna for a radio communication terminal in the above configuration, only dipole antenna 371 operates during transmission and both dipole antenna 371 and dipole antenna 381 operate during reception to carry out diversity reception.

Thus, dipole antenna 371 can suppress deterioration of gain and at the same time mainly receive vertically polarized waves and horizontally polarized waves parallel to the axial direction of each antenna element. Furthermore, dipole antenna 381 can not only suppress deterioration of gain but also mainly receive vertically polarized waves and horizontally polarized waves parallel to the axial direction of each antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the axial direction of either antenna element of dipole antenna 371 or 381 matches the plane of polarization of the signal sent from the other end of communication, and therefore the built-in antenna for a radio communication terminal according to this embodiment can increase the reception gain.

Thus, this embodiment uses dipole antenna 371 constructed in the same way as dipole antenna 341 in Embodiment 51 and dipole antenna 381 as the diversity antenna, and can thereby provide a high gain diversity antenna for a radio communication terminal with less influence from the human body.

Following Embodiment 60 to Embodiment 82 will describe the case where the frequency band of a built-in antenna for a radio communication terminal is widened by providing a second passive element in addition to the configuration in Embodiment 49 to Embodiment 59.

(Embodiment 60)

Figure 71:
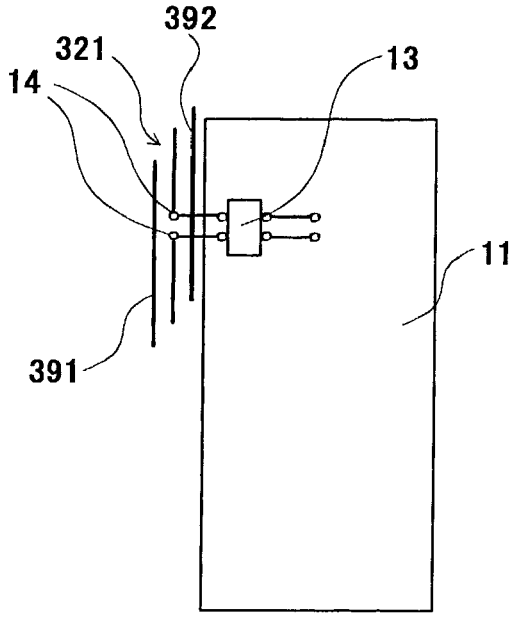
FIG. 71 is a schematic view showing a configuration of a built-in antenna for a radio communication terminal according to Embodiment 60 of the present invention.

Embodiment 60 is a mode in which two passive elements are provided for dipole antenna 321 in Embodiment 49. Embodiment 60 is the same as Embodiment 49 except the configurations of the dipole antenna and the first and second passive elements. In FIG. 71, the parts similar to those in the above-described embodiment are assigned the same reference numerals and detailed explanations thereof will be omitted.

FIG. 71 a schematic diagram showing a configuration of the built-in antenna for a radio communication terminal according to Embodiment 60 of the present invention. As shown in this figure, the built-in antenna for a radio communication terminal according to Embodiment 60 is constructed of base plate 11, balance-to-unbalance transformation circuit 13, power supply terminals 14, dipole antenna 321, first passive element 391 and second passive element 392. The built-in antenna for a radio communication terminal according to this embodiment is incorporated in the radio communication terminal.

The components of the built-in antenna for a radio communication terminal according to this embodiment will be explained with reference to FIG. 71 below.

Dipole antenna 321 is constructed of two bar-shaped antenna elements. The two antenna elements making up dipole antenna 321 are placed in such a way that their respective centerlines in the axial direction form a straight line.

Furthermore, dipole antenna 321 is mounted in such a way that the axial direction of the antenna element is perpendicular to the upper surface (horizontal plane) of the radio communication terminal. Since the radio communication terminal is used in a state shown in FIG. 57, dipole antenna 321 is provided in such a way that the axial direction of each antenna element is perpendicular to the horizontal plane during a conversation. Thus, dipole antenna 321 mainly receives vertically polarized waves parallel to the axial direction of this dipole antenna 321 in a free space. Furthermore, since the human body acts as a reflector during a conversation, dipole antenna 321 has directivity opposite to the direction of the human body.

First passive element 391 is bar-shaped. First passive element 391 is parallel to the axial direction of the antenna elements making up dipole antenna 321 and the plane (reference plane) including the antenna elements making up dipole antenna 321 and first passive element 391 intersects with the plane of base plate 11 at right angles. Since base plate 11 is provided in parallel to the main plane of package 330 shown in FIG. 56, the reference plane above also intersects with the main plane of package 330 at right angles. By placing dipole antenna 321 and first passive element 391 in this way, the plane (reference plane) formed by the antenna elements making up dipole antenna 321 and first passive element 391 also intersects with the main plane of package 330 shown in FIG. 56 at right angles.

Furthermore, second passive element 392 is also bar-shaped. Second passive element 392 is placed in such a way as to face the antenna elements making up dipole antenna 321. The distance between second passive element 392 and the antenna elements making up dipole antenna 321 is appropriately set in such a way as to change mutual impedance between second passive element 392 and dipole antenna 321 to widen the band of input impedance of the built-in antenna for a radio communication terminal according to this embodiment.

Next, the operation of the built-in antenna for a radio communication terminal in the above configuration will be explained. An unbalanced signal from the transmission/reception circuit above (not shown) is transformed to a balanced signal by balance-to-unbalance transformation circuit 13 and then sent to dipole antenna 321. Dipole antenna 321 supplied with power in this way mainly receives vertically polarized waves parallel to the axial direction of this dipole antenna 321.

A transmission signal sent from dipole antenna 321 has directivity along the reference plane and normal to the main plane of package 330 shown in FIG. 56 by changing the length of dipole antenna 321, length of first passive element 391 and distance between dipole antenna 321 and first passive element 391 as appropriate. The radio communication terminal is assumed to be used in a state shown in FIG. 57. In this case, since the main plane of package 330 faces the temporal region of the user's head, the transmission signal is transmitted in the direction opposite to the human body by adjusting the length of dipole antenna 321, length of first passive element 391 and distance between dipole antenna 321 and first passive element 391 as appropriate.

On the other hand, during reception, vertically polarized waves parallel to the axial direction of dipole antenna 321 are received. During a conversation, since directivity opposite to the human body is formed by adjusting the length of dipole antenna 321, length of first passive element 391 and distance between dipole antenna 321 and first passive element 391 as appropriate, of the vertically polarized waves above, the vertically polarized waves from the direction opposite to the human body are mainly received. Furthermore, since the human body acts as a reflector as described above, of the vertically polarized waves above, the vertically polarized waves opposite to the human body are mainly received.

The signals above (balanced signal) received by dipole antenna 321 are sent to the transmission/reception circuit above via balance-to-unbalance transformation circuit 13. Since balance-to-unbalance transformation circuit 13 above minimizes the current that flows into base plate 11, the antenna operation by base plate 11 is prevented. This suppresses deterioration of gain caused by influence from the human body to a minimum.

Thus, in addition to the effects similar to those of Embodiment 49, by providing second passive element 392 facing the antenna elements making up dipole antenna 321 and thereby changing mutual impedance between second passive element 392 and dipole antenna 321, this embodiment can widen the band for input impedance of the built-in antenna for a radio communication terminal.

(Embodiment 61)

Embodiment 61 is a mode in which the method of mounting dipole antenna 321, first passive element 391 and second passive element 392 in Embodiment 60 is changed. Embodiment 61 is the same as Embodiment 60 except the method of mounting the dipole antenna, first passive element and second passive element, and therefore detailed explanations thereof will be omitted. Differences of the built-in antenna for a radio communication terminal according to this embodiment from Embodiment 60 will be explained using FIG. 72. The parts similar to those in the Embodiment 60 are assigned the same reference numerals and detailed explanations thereof will be omitted.

Figure 72:
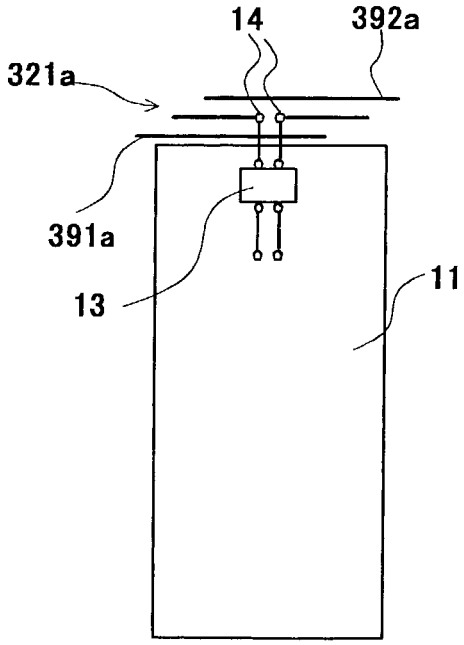
FIG. 72 is a schematic view showing a configuration of a built-in antenna for a radio communication terminal according to Embodiment 61 of the present invention.

FIG. 72 a schematic diagram showing a configuration of the built-in antenna for a radio communication terminal according to Embodiment 61 of the present invention. As shown in this figure, the built-in antenna for a radio communication terminal according to this embodiment is constructed of base plate 11, balance-to-unbalance transformation circuit 13, power supply terminals 14, dipole antenna 321*a*, first passive element 391*a* and second passive element 392*a*.

Dipole antenna 321*a* is mounted in such a way that the axial direction of the antenna elements is parallel to the upper surface (horizontal plane) of the radio communication terminal. Furthermore, first passive element 391*a* is parallel to the axial direction of antenna elements making up dipole antenna 321*a* and is placed in such a way that the plane (reference plane) formed by the antenna element making up dipole antenna 321*a* and this first passive element 391*a* is quasi-perpendicular to the plane of base plate 11. Second passive element 392*a* is placed so as to face the antenna element making up dipole antenna 321*a*. The distance between this second passive element 392*a* and the antenna elements making up dipole antenna 321*a* is appropriately set in such a way as to widen the band for input impedance of the built-in antenna for a radio communication terminal according to this embodiment by changing mutual impedance between second passive element 392*a* and dipole antenna 321*a*.

That is, this embodiment differs from Embodiment 60 in that the axial direction of dipole antenna 321*a* is parallel to the upper surface (horizontal plane) of the radio communication terminal.

Thus, this embodiment can suppress deterioration of gain due to the influences of the human body and receive horizontally polarized waves parallel to the axial direction of dipole antenna 321*a* during reception. On the other hand, a signal sent from the other end of communication is a mixture of vertically polarized waves and horizontally polarized waves due to various factors such as reflection. Thus, when there are more horizontally polarized waves, the axial direction of the antenna matches the polarization plane of the signal, making it possible to increase reception gain.

Furthermore, by providing second passive element 392*a* in such a way as to face the antenna element making up dipole antenna 321*a* and thereby changing mutual impedance between second passive element 392*a* and dipole antenna 321*a*, this embodiment can widen input impedance of the built-in antenna for a radio communication terminal according to this embodiment.

(Embodiment 62)

Embodiment 62 is a mode in which the configuration and method of mounting of dipole antenna 321, first passive element 391 and second passive element 392 in Embodiment 60 are changed. Embodiment 62 is the same as Embodiment 60 except the configuration and method of mounting of the dipole antenna, first passive element and second passive element, and therefore detailed explanations thereof will be omitted. Differences of the built-in antenna for a radio communication terminal according to this embodiment from Embodiment 60 will be explained using FIG. 73. The parts similar to those in the Embodiment 60 are assigned the same reference numerals and detailed explanations thereof will be omitted.

Figure 73:
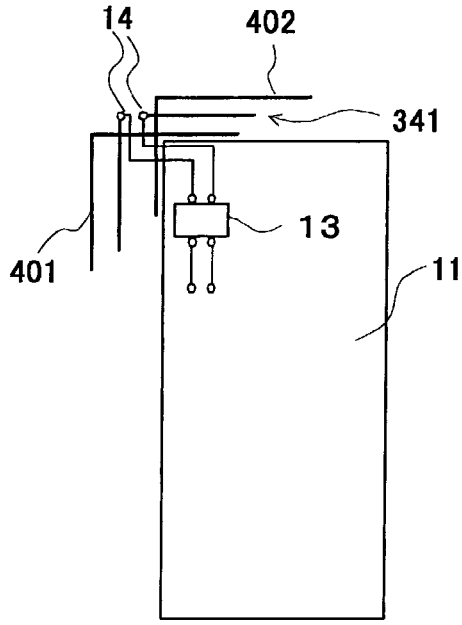
FIG. 73 is a schematic view showing a configuration of a built-in antenna for a radio communication terminal according to Embodiment 62 of the present invention.

FIG. 73 a schematic diagram showing a configuration of the built-in antenna for a radio communication terminal according to Embodiment 62 of the present invention. As shown in this figure, the built-in antenna for a radio communication terminal according to Embodiment 62 is constructed of base plate 11, balance-to-unbalance transformation circuit 13, power supply terminals 14, dipole antenna 341, first passive element 401 and second passive element 402. The two antenna elements making up dipole antenna 341 are placed in such a way as to be perpendicular to each other. First passive element 401 and second passive element 402 are each folded near the center and formed so that the folded rectilinear parts are quasi-perpendicular to each other.

Dipole antenna 341 is mounted in such a way that one antenna element is perpendicular to the upper surface (horizontal plane) of the radio communication terminal and the other antenna element is parallel to the upper surface (horizontal plane) of the radio communication terminal. Furthermore, first passive element 401 is attached in such a way that one folded rectilinear part is perpendicular to the upper surface (horizontal plane) of the radio communication terminal and the other folded rectilinear part is parallel to the upper surface (horizontal plane) of the radio communication terminal. Second passive element 402 is placed in such a way as to face the antenna elements making up dipole antenna 341. The distance between this second passive element 402 and the antenna elements making up dipole antenna 341 is appropriately set so as to widen the band for input impedance of the built-in antenna for a radio communication terminal according to this embodiment by changing mutual impedance between second passive element 402 and dipole antenna 341.

Then, the operation of the built-in antenna for a radio communication terminal in the above configuration will be explained. An unbalanced signal from the transmission/reception circuit provided for the radio communication terminal is transformed to a balanced signal by balance-to-unbalance transformation circuit 13 and then sent to dipole antenna 341. The antenna element making up dipole antenna 341 supplied with power in this way placed perpendicular to the upper surface (horizontal plane) of the radio communication terminal mainly sends vertically polarized waves parallel to the axial direction of this antenna element. On the other hand, the antenna element making up dipole antenna 341 placed in parallel to the upper surface (horizontal plane) of the radio communication terminal mainly sends horizontally polarized waves parallel to the axial direction of this antenna element.

A transmission signal sent from dipole antenna 341 has directivity along the reference plane and normal to the main plane of package 330 by adjusting factors such as the length of dipole antenna 341, length of first passive element 401 and distance between dipole antenna 341 and first passive element 401 as appropriate. The radio communication terminal is assumed to be used in a state shown in FIG. 57. In this case, since the main plane of package 330 faces the temporal region of the user's head, the transmission signal is transmitted in the direction opposite to the human body by adjusting factors such as the length of dipole antenna 341, length of first passive element 401 and distance between dipole antenna 341 and first passive element 401 as appropriate.

On the other hand, during reception, the antenna element placed perpendicular to the upper surface (horizontal plane) of the radio communication terminal that makes up dipole antenna 341 mainly receives vertically polarized waves parallel to the axial direction of this antenna element. On the other hand, the antenna element placed in parallel to the upper surface (horizontal plane) of the radio communication terminal that makes up dipole antenna 341 mainly receives horizontally polarized waves parallel to the axial direction of this antenna element. During a conversation, since directivity opposite to the human body is formed by adjusting factors such as the length of dipole antenna 341, length of first passive element 401 and distance between dipole antenna 341 and first passive element 401 as appropriate, of the vertically and horizontally polarized waves above, the polarized waves from the direction opposite to the human body are mainly received. Furthermore, since the human body acts as a reflector as described above, of the vertically and horizontally polarized waves above, the vertically and horizontally polarized waves opposite to the human body are mainly received.

Thus, this embodiment can suppress deterioration of gain due to influence of the human body and receive both vertically and horizontally polarized waves parallel to the axial direction of each antenna element of dipole antenna 341 during reception. On the other hand, a signal sent from the other end of communication is a mixture of vertically polarized waves and horizontally polarized waves due to various factors such as reflection. Thus, even if there are either more vertically polarized waves or more horizontally polarized waves, the axial direction of either antenna element of dipole antenna 341 matches the signal polarization plane of the signal sent from the other end of communication, and therefore the built-in antenna for a radio communication terminal according to this embodiment can increase the reception gain.

Furthermore, by providing second passive element 402 in such a way as to face the antenna elements making up dipole antenna 341, this embodiment changes mutual impedance between second passive element 402 and dipole antenna 341 and can thereby widen the band for input impedance of the built-in antenna for a radio communication terminal according to this embodiment.

(Embodiment 63)

Embodiment 63 is a mode in which the configuration and method of mounting of dipole antenna 321, first passive element 391 and second passive element 392 in Embodiment 60 are changed. Embodiment 63 is the same as Embodiment 60 except the configuration and method of mounting of the dipole antenna, first passive element and second passive element, and therefore detailed explanations thereof will be omitted. Differences of the built-in antenna for a radio communication terminal according to this embodiment from Embodiment 60 will be explained using FIG. 74. The parts similar to those in the Embodiment 60 are assigned the same reference numerals and detailed explanations thereof will be omitted.

Figure 74:
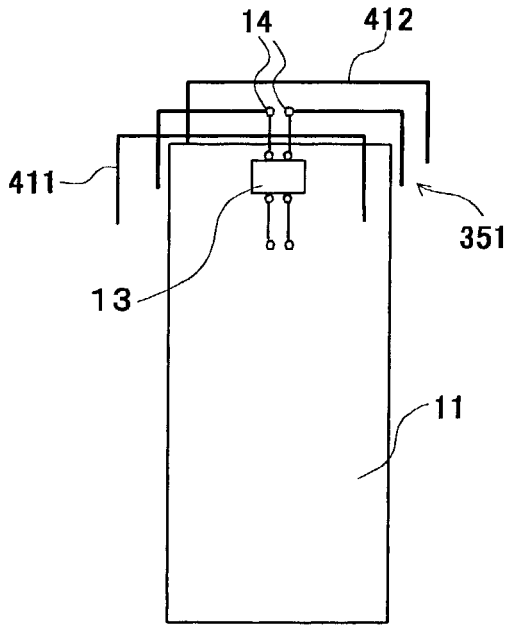
FIG. 74 is a schematic view showing a configuration of a built-in antenna for a radio communication terminal according to Embodiment 63 of the present invention.

FIG. 74 is a schematic diagram showing a configuration of the built-in antenna for a radio communication terminal according to Embodiment 63 of the present invention. As shown in this figure, the built-in antenna for a radio communication terminal according to Embodiment 63 is constructed of base plate 11, balance-to-unbalance transformation circuit 13, power supply terminals 14, dipole antenna 351, first passive element 411 and second passive element 412. The two antenna elements making up dipole antenna 351 are folded near the center and placed in such a way that the folded rectilinear parts are perpendicular to each other. First passive element 411 and second passive element 412 are each folded at a point at a certain distance from one end and formed so that the folded adjacent rectilinear parts are perpendicular to each other. Furthermore, first passive element 411 and second passive element 412 are also folded at a point at a certain distance from the other end and formed so that the folded adjacent rectilinear parts are perpendicular to each other. That is, first passive element 411 and second passive element 412 are folded in a horseshoe form. In this case, the folded rectilinear parts including both ends of first passive element 411 are parallel to each other. Furthermore, the folded rectilinear part (central part) not including both ends of first passive element 411 is formed in such a way as to be longer than the length of base plate 11 in the width direction. The same applies to second passive element 412 and the folded rectilinear parts including both ends of second passive element 412 are parallel to each other and the folded rectilinear part (central part) not including both ends of second passive element 412 is formed in such a way as to be longer than the length of base plate 11 in the width direction.

The antenna elements making up dipole antenna 351 in the above-described configuration are mounted in such a way that the folded rectilinear part including power supply terminals 14 is parallel to the upper surface (horizontal plane) of the radio communication terminal and the folded rectilinear part not including power supply terminals 14 is perpendicular to the upper surface (horizontal plane) of the radio communication terminal. Furthermore, first passive element 411 and second passive element 412 are mounted in such a way that the folded rectilinear part including one end is perpendicular to the upper surface (horizontal plane) of the radio communication terminal and the folded rectilinear part not including one end is parallel to the upper surface (horizontal plane) of the radio communication terminal. Furthermore, second passive element 412 is placed in such a way as to face the antenna elements making up dipole antenna 351. The distance between this second passive element 412 and the antenna elements making up dipole antenna 351 is appropriately set so as to widen the band of input impedance of the built-in antenna for a radio communication terminal according to this embodiment by changing mutual impedance between second passive element 412 and dipole antenna 351.

Then, the operation of the built-in antenna for a radio communication terminal in the above configuration will be explained. An unbalanced signal from the transmission/reception circuit above provided for the radio communication terminal is transformed to a balanced signal by balance-to-unbalance transformation circuit 13 and then sent to dipole antenna 351. The part of each antenna element making up dipole antenna 341 supplied with power in this way placed perpendicular to the upper surface (horizontal plane) of the radio communication terminal mainly sends vertically polarized waves parallel to the axial direction of this part. On the other hand, the part of each antenna element making up dipole antenna 351 placed in parallel to the upper surface (horizontal plane) of the radio communication terminal mainly sends horizontally polarized waves parallel to the axial direction of this part.

A transmission signal sent from dipole antenna 351 has directivity along the reference plane and normal to the main plane of package 330 by adjusting factors such as the length of dipole antenna 351, length of first passive element 411 and distance between dipole antenna 351 and first passive element 411 as appropriate. The radio communication terminal is assumed to be used in a state shown in FIG. 57. In this case, since the main plane of package 330 faces the temporal region of the user's head, the transmission signal is transmitted in the direction opposite to the human body by adjusting factors such as the length of dipole antenna 351, length of first passive element 411 and distance between dipole antenna 351 and first passive element 411 as appropriate.

Figure 75:
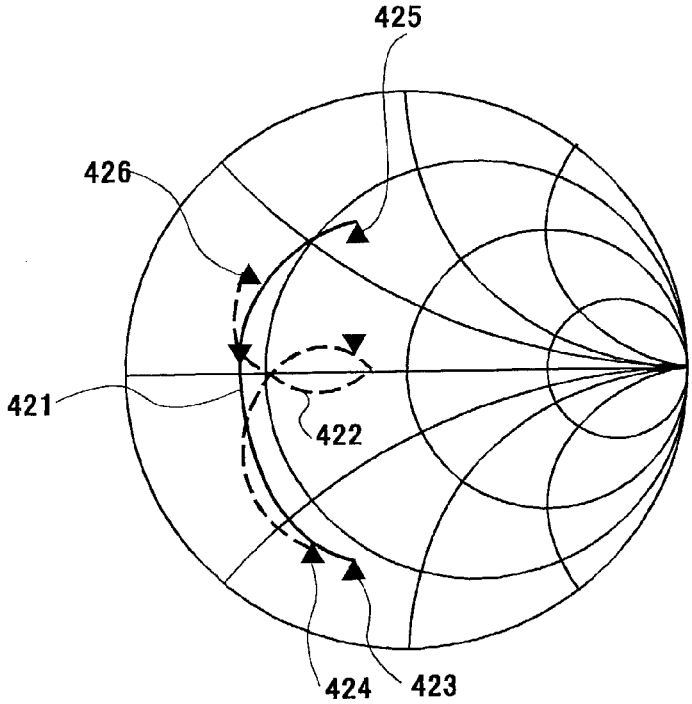
FIG. 75 is a Smith chart showing an impedance characteristic of the built-in antenna for a radio communication terminal according to Embodiment 63.

Here, the impedance characteristic of the built-in antenna for a radio communication terminal in the above-described configuration will be explained with reference to FIG. 75. FIG. 75 is a Smith chart showing the impedance characteristic of the built-in antenna for a radio communication terminal according to this embodiment. Reference numeral 421 in this figure is the impedance characteristic when it is assumed that the size of the base plate 11 is 30×117 mm, the length of the part of the antenna element making up dipole antenna 351 placed in parallel to the upper surface (horizontal plane) of the radio communication terminal is 34 mm and the length of the part of the antenna element making up dipole antenna 351 placed perpendicular to the upper surface (horizontal plane) of the radio communication terminal is 18 mm in the configuration of the built-in antenna for a radio communication terminal shown in FIG. 74 stripped of first passive element 411 and second passive element 412. Furthermore, reference numeral 422 is the impedance characteristic when it is assumed that the length of the part of second passive element 412 placed in parallel to the upper surface (horizontal plane) of the radio communication terminal is 34 mm and the length of the part placed perpendicular to the upper surface (horizontal plane) of the radio communication terminal is 18 mm and the distance between second passive element 412 and dipole antenna 351 is 2 mm in the configuration of the built-in antenna for a radio communication terminal shown in FIG. 74. Reference numerals 423 and 424 denote when the frequency is 1920 MHz and reference numerals 425 and 426 denote when the frequency is 2180 MHz.

As is apparent from this FIG. 75, it is possible to widen the band for the input impedance characteristic of the built-in antenna for a radio communication terminal by placing second passive element 412 opposite the antenna elements making up dipole antenna 351 at an appropriate distance.

Figure 76:
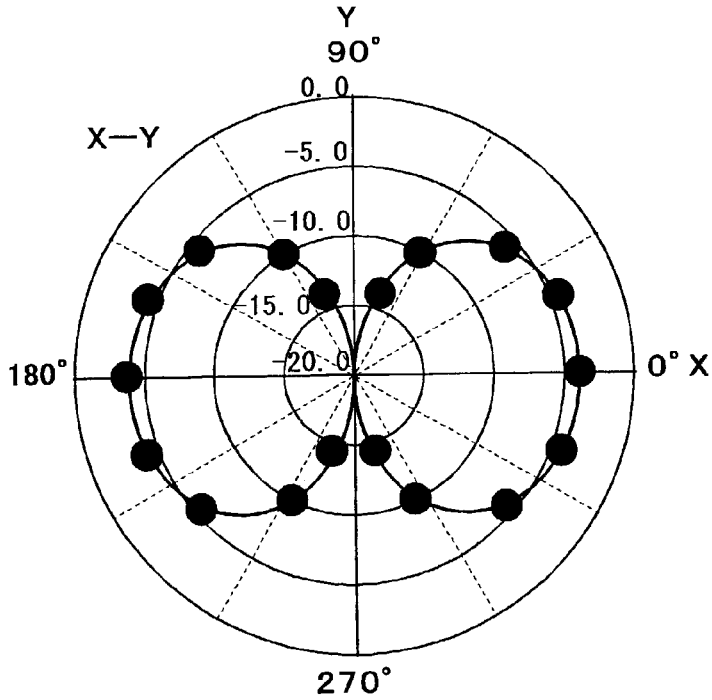
FIG. 76 illustrates measured values of a radiation characteristic of a horizontal plane in a free space of the built-in antenna for a radio communication terminal having a configuration of the built-in antenna for a radio communication terminal shown in FIG. 74 stripped of the first passive element.

Next, the radiation characteristic of the built-in antenna for a radio communication terminal according to the above embodiment in a free space will be explained with reference to FIG. 76 and FIG. 77. FIG. 76 illustrates actual measured values of the radiation characteristic of the built-in antenna for a radio communication terminal having a configuration of the built-in antenna for a radio communication terminal shown in FIG. 74 stripped of first passive element 411 in a free space. Here, as in the case where the impedance characteristic shown in FIG. 75 is measured, suppose the size of base plate 11 is 30×117 mm, the length of the part of each antenna element making up dipole antenna 351 placed in parallel to the upper surface (horizontal plane) of the radio communication terminal apparatus is 34 mm, the length of the part of each antenna element making up dipole antenna 351 placed perpendicular to the upper surface (horizontal plane) of the radio communication terminal apparatus is 18 mm and the distance between second passive element 412 and dipole antenna 351 is 2 mm.

As is apparent from FIG. 76, the built-in antenna for a radio communication terminal having the configuration of the built-in antenna for a radio communication terminal shown in FIG. 74 stripped of first passive element 411 is nondirective.

Figure 77:
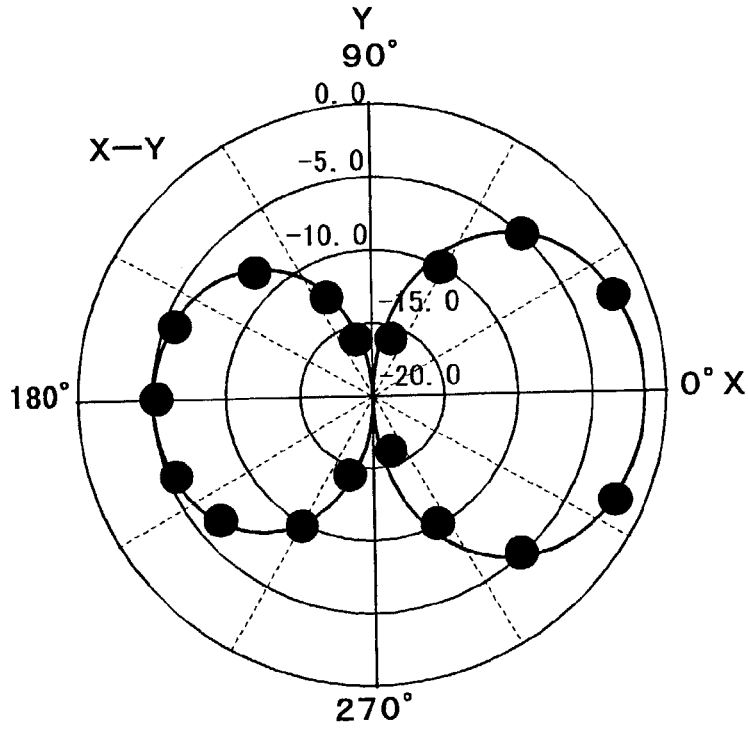
FIG. 77 illustrates measured values of a radiation characteristic of a horizontal plane in a free space of the built-in antenna for a radio communication terminal according to Embodiment 63.

FIG. 77 illustrates measured values of the radiation characteristic of the horizontal plane in a free space of the built-in antenna for a radio communication terminal according to this embodiment shown in FIG. 74. Here, suppose the length of the part of first passive element 411 placed in parallel to the upper surface (horizontal plane) of the radio communication terminal apparatus is 34 mm, the length of the part placed perpendicular to the upper surface (horizontal plane) of the radio communication terminal apparatus is 16.5 mm and the distance between first passive element 411 and dipole antenna 351 is 4 mm. The size of base plate 11, the length of the antenna elements making up dipole antenna 351 and the distance between second passive element 412 and dipole antenna 351 are the same as those when the impedance characteristic shown in FIG. 75 is measured.

As is apparent from FIG. 77, by adjusting factors such as the length of the antenna elements making up dipole antenna 351, length of first passive element 411 and distance between dipole antenna 351 and first passive element 411 as appropriate, the built-in antenna for a radio communication terminal according to this embodiment can form desired directivity.

Figure 78:
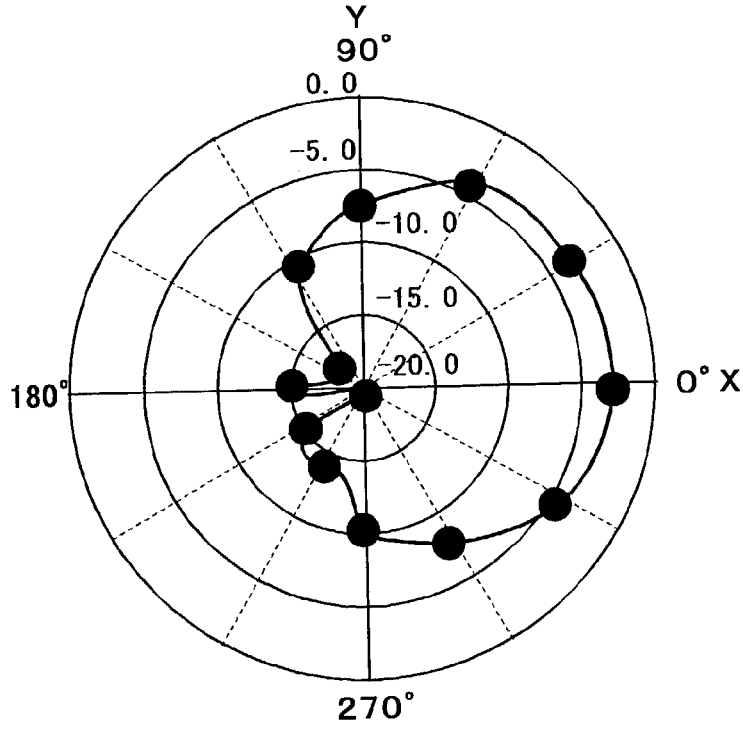
FIG. 78 illustrates measured values of a radiation characteristic during a conversation of the built-in antenna for a radio communication terminal according to Embodiment 63.

Then, the radiation characteristic of the built-in antenna for a radio communication terminal in the above configuration will be explained with reference to FIG. 78. FIG. 78 illustrates actual measured values of the radiation characteristic of the built-in antenna for a radio communication terminal according to this embodiment during a conversation. The sizes of the components as the measuring condition are the same as those when the radiation characteristic shown in FIG. 77 is measured. In FIG. 78, the direction at 180° viewed from the origin corresponds to the direction of the human body viewed from dipole antenna 351 in FIG. 74.

As is apparent from FIG. 78, by adjusting the length of dipole antenna 351, length of first passive element 411 and distance between dipole antenna 351 and first passive element 411 as appropriate, the built-in antenna for a radio communication terminal according to this embodiment has directivity opposite to the direction of the human body. This makes it possible to suppress deterioration of gain caused by influence from the human body during transmission and thereby achieve higher gain than the conventional example shown in FIG. 5B.

Thus, according to this embodiment, it is possible to suppress deterioration of gain caused by influence from the human body and receive both vertically polarized waves and horizontally polarized waves parallel to the axial direction of each part of each antenna element of dipole antenna 351 during reception. On the other hand, a signal sent from the other end of communication is a mixture of vertically polarized waves and horizontally polarized waves due to various factors such as reflection. Thus, even if there are either more vertically polarized waves or more horizontally polarized waves, the axial direction of either part of each antenna element of dipole antenna 351 matches the polarization plane of the signal sent from the other end of communication, and therefore the built-in antenna for a radio communication terminal according to this embodiment can increase reception gain.

Furthermore, according to this embodiment, it is possible to widen the band of input impedance of the built-in antenna for a radio communication terminal by placing second passive element 412 opposite to the antenna elements making up dipole antenna 351 and thereby changing mutual impedance between second passive element 412 and dipole antenna 351.

(Embodiment 64)

Embodiment 64 is a mode in which dipole antenna 321 according to Embodiment 60 is changed to a monopole antenna. The built-in antenna for a radio communication terminal according to this embodiment will be explained using FIG. 79. The same components as those in Embodiment 60 are assigned the same reference numerals and detailed explanations thereof will be omitted.

Figure 79:
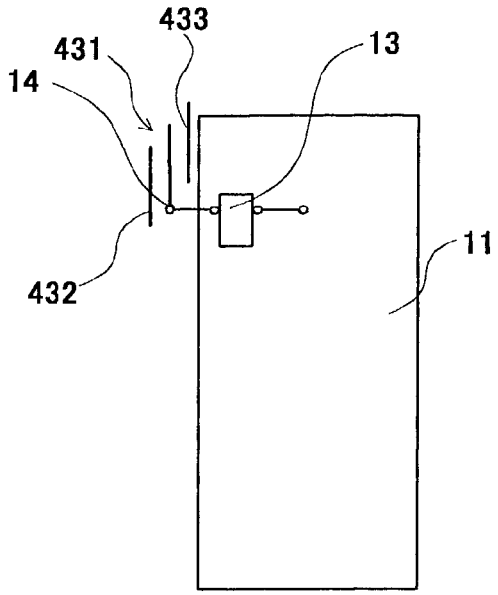
FIG. 79 is a schematic view showing a configuration of a built-in antenna for a radio communication terminal according to Embodiment 64 of the present invention.

FIG. 79 is a schematic diagram showing a configuration of the built-in antenna for a radio communication terminal according to Embodiment 64 of the present invention. As shown in this figure, the built-in antenna for a radio communication terminal according to this embodiment is constructed of base plate 11, balance-to-unbalance transformation circuit 13, power supply terminals 14, monopole antenna 431, first passive element 432 and second passive element 433.

Monopole antenna 431 is bar-shaped. Furthermore, monopole antenna 431 is mounted in such a way that the axial direction is perpendicular to the upper surface (horizontal plane) of the radio communication terminal. Since the radio communication terminal is used in a state shown in FIG. 57, monopole antenna 431 is provided in such a way that the axial direction is perpendicular to the horizontal plane during a conversation. Thus, monopole antenna 431 mainly receives vertically polarized waves parallel to the axial direction of this monopole antenna 431 in a free space. Furthermore, since the human body acts as a reflector during a conversation, monopole antenna 431 has directivity opposite to the direction of the human body.

First passive element 432 is bar-shaped. First passive element 432 is parallel to the axial direction of monopole antenna 431 and placed in such a way that the plane (reference plane) formed by the antenna element making up monopole antenna 431 and first passive element 432 intersects with the plane of base plate 11 at right angles. Since base plate 11 is provided in parallel to the main plane of package 330 shown in FIG. 56, the reference plane above also intersects with the main plane of package 330 at right angles. With monopole antenna 431 and first passive element 432 placed in this way, the plane (reference plane) formed by the antenna element making up monopole antenna 431 and first passive element 432 also intersects with the main plane of package 330 shown in FIG. 56 at right angles.

Furthermore, second passive element 433 is also bar-shaped. Second passive element 433 is placed in such a way as to face monopole antenna 431. The distance between second passive element 433 and monopole antenna 431 is appropriately set in such a way as to change mutual impedance between second passive element 433 and monopole antenna 431 to widen the band of input impedance of the built-in antenna for a radio communication terminal according to this embodiment.

Next, the operation of the built-in antenna for a radio communication terminal in the above configuration will be explained. An unbalanced signal from the transmission/reception circuit above (not shown) is transformed to a balanced signal by balance-to-unbalance transformation circuit 13 and then sent to monopole antenna 431. Monopole antenna 431 supplied with power in this way mainly sends vertically polarized waves parallel to the axial direction of monopole antenna 431.

A transmission signal sent from monopole antenna 431 has directivity along the reference plane and normal to the main plane of package 330 shown in FIG. 56 by changing factors such as the length of monopole antenna 431, length of first passive element 432 and distance between monopole antenna 431 and first passive element 432 as appropriate. The radio communication terminal is assumed to be used in a state shown in FIG. 57. In this case, since the main plane of package 330 faces the temporal region of the user's head, the transmission signal is transmitted in the direction opposite to the human body by adjusting factors such as the length of monopole antenna 431, length of first passive element 432 and distance between monopole antenna 431 and first passive element 432 as appropriate.

On the other hand, during reception, monopole antenna 431 receives vertically polarized waves parallel to the axial direction of monopole antenna 431. During a conversation, since directivity opposite to the human body is formed by adjusting factors such as the length of monopole antenna 431, length of first passive element 432 and distance between monopole antenna 431 and first passive element 432 as appropriate, of the vertically polarized waves above, the vertically polarized waves from the direction opposite to the human body are mainly received. Furthermore, since the human body acts as a reflector as described above, of the vertically polarized waves above, the vertically polarized waves opposite to the human body are mainly received.

The signals above (balanced signal) received by monopole antenna 431 are sent to the transmission/reception circuit above via balance-to-unbalance transformation circuit 13. Since balance-to-unbalance transformation circuit 13 above minimizes the current that flows into base plate 11, the antenna operation by base plate 11 is prevented. This suppresses deterioration of gain caused by influence from the human body to a minimum.

Thus, this embodiment can achieve similar effects as those of Embodiment 60. Furthermore, by changing the dipole antenna to a monopole antenna, this embodiment can reduce the size of the antenna.

Following Embodiment 65 to Embodiment 72 are embodiments in which a diversity antenna is implemented using the built-in antenna for a radio communication terminal in Embodiment 60 to Embodiment 64.

(Embodiment 65)

Embodiment 65 is a mode in which a diversity antenna is implemented using the built-in antenna for a radio communication terminal according to Embodiments 60. The diversity antenna for a radio communication terminal according to this embodiment will be explained using FIG. 80. The same components as those in Embodiment 60 are assigned the same reference numerals and detailed explanations thereof will be omitted.

Figure 80:
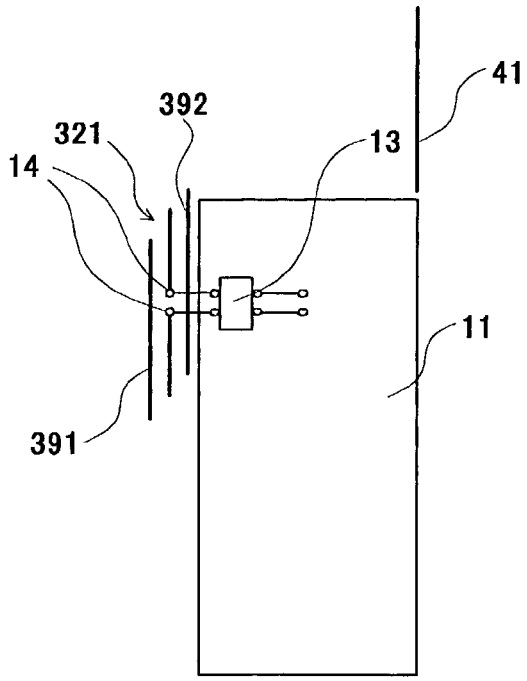
FIG. 80 is a schematic view showing a configuration of a diversity antenna for a radio communication terminal according to Embodiment 65 of the present invention.

FIG. 80 is a schematic diagram showing a configuration of the diversity antenna for a radio communication terminal according to Embodiment 65 of the present invention. As shown in this figure, the diversity antenna for a radio communication terminal according to this embodiment is further provided with monopole antenna 41 in addition to the configuration of the built-in antenna for a radio communication terminal according to Embodiment 60.

Here, suppose one antenna making up the diversity antenna is dipole antenna 321 and used for reception only. Also suppose the other antenna making up the diversity antenna is monopole antenna 41 and used for both transmission and reception.

In the diversity antenna for a radio communication terminal in the above configuration, only monopole antenna 41 operates during transmission and both dipole antenna 321 and monopole antenna 41 operate during reception to carry out diversity reception.

Thus, this embodiment implements a dipole antenna by adding monopole antenna 41 to the built-in antenna for a radio communication terminal according to Embodiment 60, and can thereby provide a diversity antenna for a radio communication terminal capable of suppressing deterioration of gain due to influences from the human body and with a wideband impedance characteristic.

(Embodiment 66)

Embodiment 66 is a mode in which the configuration of monopole antenna 41 in Embodiment 65 is changed. The diversity antenna for a radio communication terminal according to this embodiment will be explained using FIG. 81. The components similar to those in Embodiment 65 are assigned the same reference numerals and detailed explanations thereof will be omitted.

Figure 81:
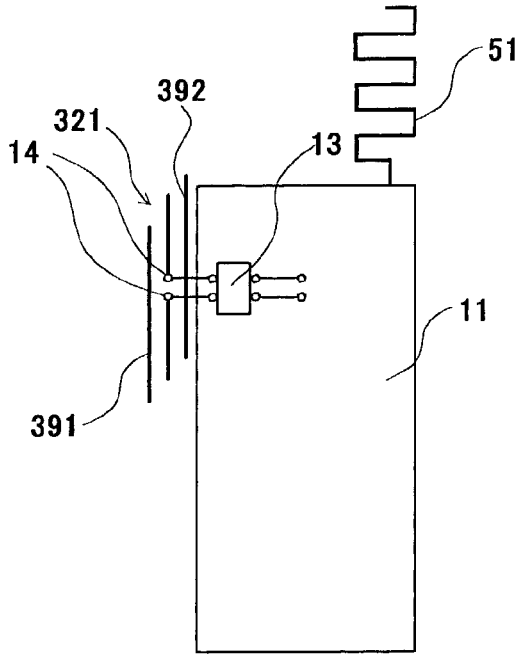
FIG. 81 is a schematic view showing a configuration of a diversity antenna for a radio communication terminal according to Embodiment 66 of the present invention.

FIG. 81 is a schematic diagram showing a configuration of the diversity antenna for a radio communication terminal according to Embodiment 66 of the present invention. As shown in this figure, the diversity antenna for a radio communication terminal according to this embodiment is constructed of base plate 11, dipole antenna 321, first passive element 391, second passive element 392, balance-to-unbalance transformation circuit 13, power supply terminals 14 and monopole antenna 51. Monopole antenna 51 is constructed of a rectangular-wave-shaped antenna element.

In the diversity antenna for a radio communication terminal in the above configuration, only monopole antenna 51 operates during transmission and both dipole antenna 321 and monopole antenna 51 operate during reception to carry out diversity reception.

Thus, this embodiment implements a diversity antenna by adding monopole antenna 51 to the built-in antenna for a radio communication terminal according to Embodiment 60, and can there by provide a diversity antenna for a radio communication terminal capable of suppressing deterioration of gain due to influences from the human body and with a wideband impedance characteristic.

(Embodiment 67)

Embodiment 67 is a mode in which the configuration of monopole antenna 41 in Embodiment 65 is changed. The diversity antenna for a radio communication terminal according to this embodiment will be explained using FIG. 82. The components similar to those in Embodiment 65 are assigned the same reference numerals and detailed explanations thereof will be omitted.

Figure 82:
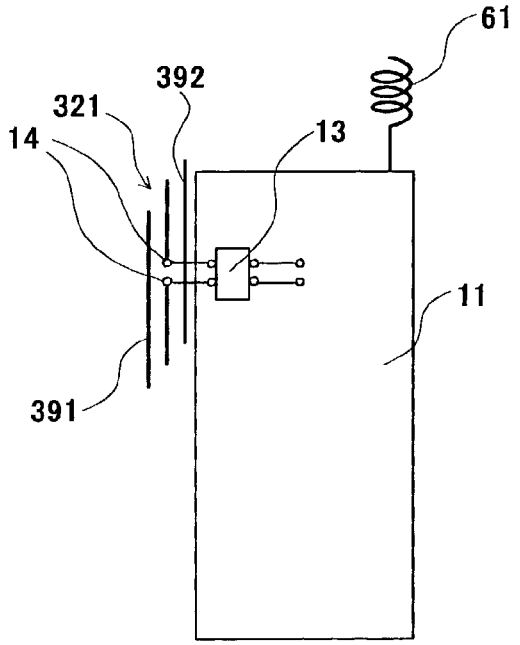
FIG. 82 is a schematic view showing a configuration of a diversity antenna for a radio communication terminal according to Embodiment 67 of the present invention.

FIG. 82 is a schematic diagram showing a configuration of the diversity antenna for a radio communication terminal according to Embodiment 67 of the present invention. As shown in this figure, the diversity antenna for a radio communication terminal according to Embodiment 67 is constructed of base plate 11, dipole antenna 321, first passive element 391, second passive element 392, balance-to-unbalance transformation circuit 13, power supply terminals 14 and monopole antenna 61. Monopole antenna 61 is constructed of a spiral-shaped antenna element.

In the diversity antenna for a radio communication terminal in the above configuration, only monopole antenna 61 operates during transmission and both dipole antenna 321 and monopole antenna 61 operate during reception to carry out diversity reception.

Thus, this embodiment implements a diversity antenna by adding monopole antenna 61 to the built-in antenna for a radio communication terminal according to Embodiment 60, and can thereby provide a diversity antenna for a radio communication terminal capable of suppressing deterioration of gain due to influences from the human body and with a wideband impedance characteristic.

(Embodiment 68)

Embodiment 68 is a mode in which a diversity antenna is implemented using the built-in antenna for a radio communication terminal in Embodiment 60. The diversity antenna for a radio communication terminal according to this embodiment will be explained using FIG. 83. The components similar to those in Embodiment 60 are assigned the same reference numerals and detailed explanations thereof will be omitted.

Figure 83:
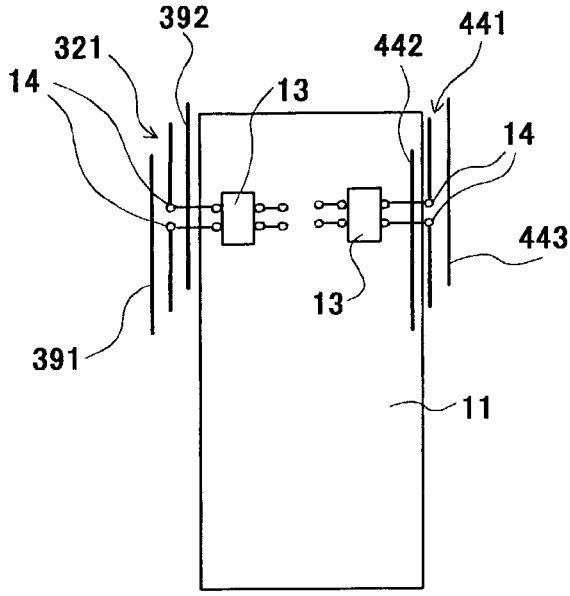
FIG. 83 is a schematic view showing a configuration of a diversity antenna for a radio communication terminal according to Embodiment 68 of the present invention.

FIG. 83 is a schematic diagram showing a configuration of the diversity antenna for a radio communication terminal according to Embodiment 68 of the present invention. As shown in this figure, this embodiment has the configuration of the built-in antenna for a radio communication terminal according to Embodiment 60 with another set of dipole antenna 441, first passive element 442 and second passive element 443 added to one side of base plate 11.

Dipole antenna 441 has the same configuration as that of dipole antenna 321 in Embodiment 60.

First passive element 442 is bar-shaped, parallel to the axial direction of the antenna elements making up dipole antenna 441 and placed in such a way that the plane (reference plane) formed by the antenna elements making up dipole antenna 441 and this first passive element 442 intersects with the plane of base plate 11 at right angles. Since base plate 11 is provided in parallel to the main plane of package 330 shown in FIG. 56, the reference plane above also intersects with the main plane of package 330 at right angles. By placing dipole antenna 441 and first passive element 442 in this way, the plane (reference plane) formed by the antenna elements making up dipole antenna 441 and first passive element 442 also intersects with the main plane of package 330 shown in FIG. 56 at right angles.

Furthermore, second passive element 443 is also bar-shaped. Second passive element 443 is placed in such a way as to face the antenna elements making up dipole antenna 441. The distance between this second passive element 443 and the antenna elements making up dipole antenna 441 is appropriately set in such a way as to change mutual impedance between second passive element 443 and dipole antenna 441 to widen the band of input impedance of the built-in antenna for a radio communication terminal according to this embodiment.

A transmission signal sent from dipole antenna 441 in the above-described configuration has directivity along the reference plane and normal to the main plane of package 330 shown in FIG. 56 by changing factors such as the length of dipole antenna 441, length of first passive element 442 and distance between dipole antenna 441 and first passive element 442 as appropriate. The radio communication terminal is assumed to be used in a state shown in FIG. 57. In this case, since the main plane of package 330 faces the temporal region of the user's head, the transmission signal is transmitted in the direction opposite to the human body by adjusting factors such as the length of dipole antenna 441, length of first passive element 442 and distance between dipole antenna 441 and first passive element 442 as appropriate.

On the other hand, during reception, vertically polarized waves parallel to the axial direction of dipole antenna 441 are received. During a conversation, since directivity opposite to the human body is formed by adjusting factors such as the length of dipole antenna 441, length of first passive element 442 and distance between dipole antenna 441 and first passive element 442 as appropriate, of the vertically polarized waves above, the vertically polarized waves from the direction opposite to the human body are mainly received. Furthermore, since the human body acts as a reflector as described above, of the vertically polarized waves above, the vertically polarized waves opposite to the human body are mainly received.

Here, suppose one antenna making up the diversity antenna is dipole antenna 321 and used for reception only. Also suppose the other antenna making up the diversity antenna is dipole antenna 441 and used for both transmission and reception.

In the diversity antenna for a radio communication terminal in the above configuration, only dipole antenna 441 operates during transmission and both dipole antenna 321 and dipole antenna 441 operate during reception to carry out diversity reception.

Thus, according to this embodiment, dipole antenna 321 in Embodiment 60 and dipole antenna 441 constructed in the same way as dipole antenna 321 are used as the diversity antenna, and it is therefore possible to provide a diversity antenna for a radio communication terminal capable of suppressing deterioration of gain due to influences from the human body and having a wideband input impedance characteristic.

(Embodiment 69)

Embodiment 69 is a mode in which the method of mounting dipole antenna 441, first passive element 442 and second passive element 443 in Embodiment 68 is changed. Since Embodiment 69 is the same as Embodiment 68 except for the method of mounting the dipole antenna, first passive element and second passive element, detailed explanations thereof will be omitted. Differences of the built-in antenna for a radio communication terminal according to this embodiment from Embodiment 68 will be explained below using FIG. 84. The parts similar to those in Embodiment 68 are assigned the same reference numerals and detailed explanations thereof will be omitted.

Figure 84:
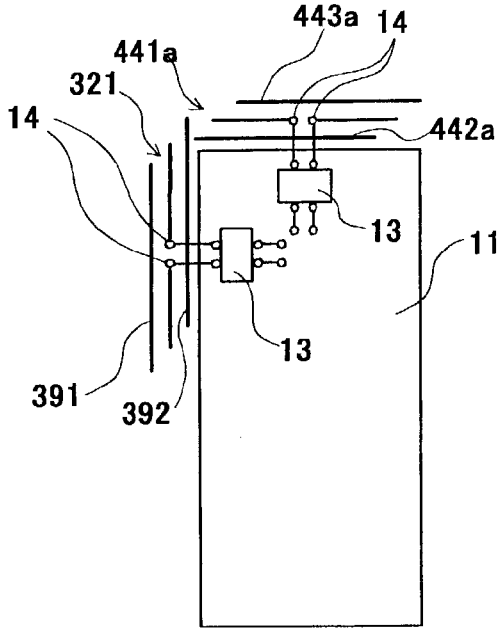
FIG. 84 is a schematic view showing a configuration of a diversity antenna for a radio communication terminal according to Embodiment 69 of the present invention.

FIG. 84 is a schematic diagram showing a configuration of the diversity antenna for a radio communication terminal according to Embodiment 69 of the present invention. As shown in this figure, additional dipole antenna 441*a* is mounted in such a way that the axial direction thereof is parallel to the upper surface (horizontal plane) of the radio communication terminal. Furthermore, additional first passive element 442*a* and second passive element 443*a* are also mounted in such a way that the axial direction thereof is parallel to the upper surface (horizontal plane) of the radio communication terminal. That is, this embodiment is different from Embodiment 68 in that the axial direction of dipole antenna 441*a*, the axial direction of first passive element 442*a* and the axial direction of second passive element 443*a* are parallel to the upper surface (horizontal plane) of the radio communication terminal. As a result, dipole antenna 441*a* is provided in such a way that the axial direction thereof is parallel to the horizontal plane during a conversation.

In the diversity antenna for a radio communication terminal in the above configuration, only dipole antenna 441*a* operates during transmission and both dipole antenna 321 and dipole antenna 441*a* operate during reception to carry out diversity reception.

Thus, using dipole antenna 321 in Embodiment 60 and dipole antenna 441*a* constructed in the same as dipole antenna 321 as the diversity antenna, this embodiment can provide a diversity antenna for a radio communication terminal capable of suppressing deterioration of gain due to influences from the human body and having a wideband impedance characteristic. Furthermore, even if there are either more vertically polarized waves or more horizontally polarized waves, this embodiment can increase the reception gain.

(Embodiment 70)

Figure 85:
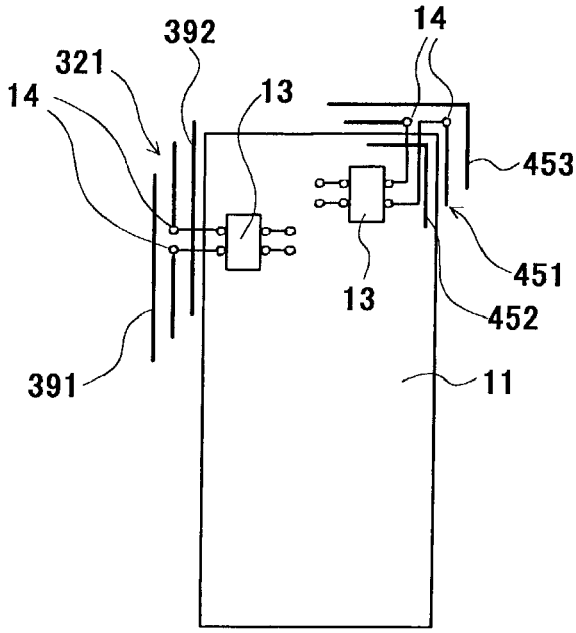
FIG. 85 is a schematic view showing a configuration of a diversity antenna for a radio communication terminal according to Embodiment 70 of the present invention.

As shown in FIG. 85, Embodiment 70 is a mode in which dipole antenna 441 used for transmission and reception in Embodiment 68 is changed to dipole antenna 451 constructed in the same way as dipole antenna 341 in Embodiment 62, first passive element 442 is changed to first passive element 452 constructed in the same way as first passive element 401 and second passive element 443 is changed to second passive element 453 constructed in the same way as second passive element 402. Embodiment 70 is the same as Embodiment 68 except for the configuration and method of mounting of dipole antenna 451, first passive element 452 and second passive element 453. The same parts in FIG. 85 as those in Embodiment 68 are assigned the same reference numerals and detailed explanations thereof will be omitted.

FIG. 85 is a schematic diagram showing a configuration of the diversity antenna for a radio communication terminal according to Embodiment 70 of the present invention. As shown in this figure, dipole antenna 451 is mounted in such a way that the axial direction of one antenna element is perpendicular to the upper surface (horizontal plane) of the radio communication terminal and the axial direction of the other antenna element is parallel to the upper surface (horizontal plane) of the radio communication terminal.

In the diversity antenna for a radio communication terminal in the above configuration, only dipole antenna 451 operates during transmission and both dipole antenna 321 and dipole antenna 451 operate during reception to carry out diversity reception.

Thus, dipole antenna 451 can suppress deterioration of gain and at the same time mainly receive vertically polarized waves and horizontally polarized waves parallel to the axial direction of each antenna element. Furthermore, dipole antenna 321 can not only suppress deterioration of gain but also mainly receive vertically polarized waves parallel to the axial direction of the antenna element. On the other hand, the signal sent from the other end of communication is often a mixture of vertically polarized waves and horizontally polarized waves due to various factors such as reflection. Thus, even if there are either more vertically polarized waves or more horizontally polarized waves, the axial direction of either antenna element of dipole antennas 321 and 451 matches the plane of polarization of the signal sent from the other end of communication, and therefore the built-in antenna for a radio communication terminal according to this embodiment can increase the reception gain.

Thus, this embodiment uses dipole antenna 321 in Embodiment 60, and dipole antenna 451 constructed in the same as dipole antenna 341 in Embodiment 60 as the diversity antenna, and can thereby provide a diversity antenna for a radio communication terminal capable of suppressing deterioration of gain due to influences from the human body and with a wideband impedance characteristic. Furthermore, even if there are either more vertically polarized waves or more horizontally polarized waves, this embodiment can increase the reception gain.

(Embodiment 71)

Figure 86:
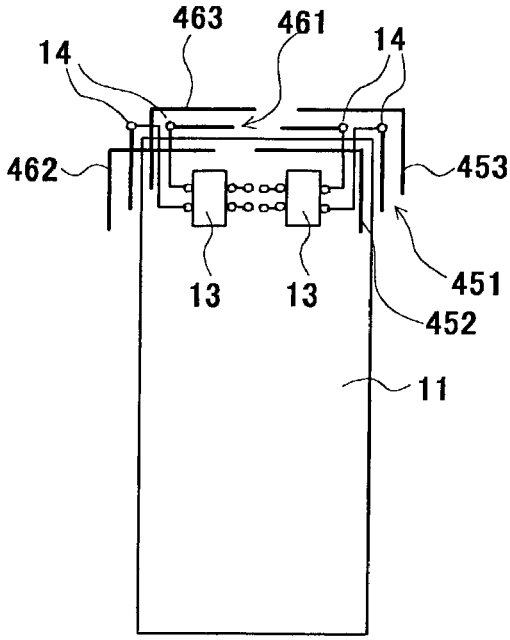
FIG. 86 is a schematic view showing a configuration of a diversity antenna for a radio communication terminal according to Embodiment 71 of the present invention.

As shown in FIG. 86, Embodiment 71 is a mode in which dipole antenna 321 used only for reception in Embodiment 70 is changed to dipole antenna 461 constructed in the same as dipole antenna 341 in Embodiment 62, first passive element 391 is changed to first passive element 462 constructed in the same way as first passive element 401 in Embodiment 62 and second passive element 392 is changed to second passive element 463 constructed in the same way as second passive element 402 in Embodiment 62. Embodiment 71 is the same as Embodiment 70 except for the configuration and method of mounting of dipole antenna 451, first passive element 462 and second passive element 463. The same parts in FIG. 86 as those in Embodiment 70 are assigned the same reference numerals and detailed explanations thereof will be omitted.

FIG. 86 is a schematic diagram showing a configuration of the diversity antenna for a radio communication terminal according to Embodiment 71 of the present invention. As shown in this figure, dipole antenna 451 and dipole antenna 461 are mounted in such a way that the axial direction of one antenna element is perpendicular to the upper surface (horizontal plane) of the radio communication terminal and the axial direction of the other antenna element is parallel to the upper surface (horizontal plane) of the radio communication terminal.

In the diversity antenna for a radio communication terminal in the above configuration, only dipole antenna 451 operates during transmission and both dipole antenna 451 and dipole antenna 461 operate during reception to carry out diversity reception.

Thus, dipole antenna 461 can suppress deterioration of gain and at the same time mainly receive vertically polarized waves and horizontally polarized waves parallel to the axial direction of the respective antenna elements. Furthermore, dipole antenna 461 can not only suppress deterioration of gain but also mainly receive vertically polarized waves and horizontally polarized waves parallel to the axial direction of the respective antenna elements. On the other hand, the signal sent from the other end of communication is often a mixture of vertically polarized waves and horizontally polarized waves due to various factors such as reflection. Thus, even if there are either more vertically polarized waves or more horizontally polarized waves, the axial direction of either antenna element of dipole antennas 451 and 461 matches the plane of polarization of the signal sent from the other end of communication, and the built-in antenna for a radio communication terminal according to this embodiment can thereby increase the reception gain.

Thus, this embodiment uses dipole antenna 451 and dipole antenna 461 constructed in the same way as dipole antenna 341 in Embodiment 62 as the diversity antenna, and can thereby provide a diversity antenna for a radio communication terminal capable of suppressing deterioration of gain due to influences from the human body and with a wideband impedance characteristic. Furthermore, even if there are either more vertically polarized waves or more horizontally polarized waves, this embodiment can increase the reception gain.

(Embodiment 72)

Figure 87:
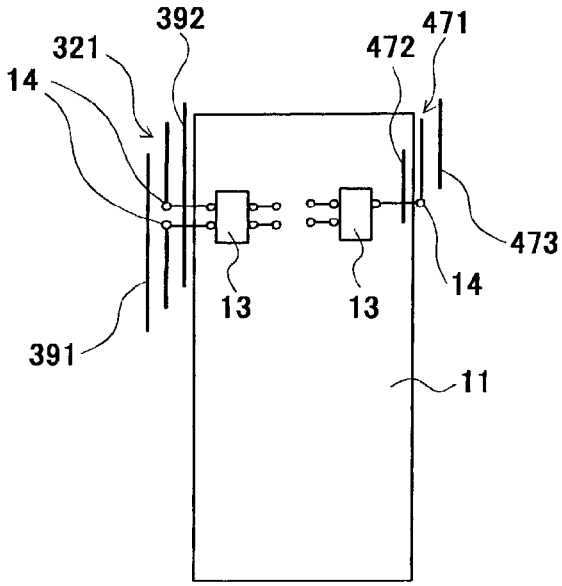
FIG. 87 is a schematic view showing a configuration of a diversity antenna for a radio communication terminal according to Embodiment 72 of the present invention.

As shown in FIG. 87, Embodiment 72 is a mode in which dipole antenna 441 used for transmission and reception in Embodiment 68 is changed to monopole antenna 471 constructed in the same as monopole antenna 431 in Embodiment 64, first passive element 442 is changed to first passive element 472 constructed in the same way as first passive element 432 in Embodiment 64 and second passive element 443 is changed to second passive element 473 constructed in the same way as second passive element 433 in Embodiment 64. Embodiment 72 is the same as Embodiment 68 except for the configuration and method of mounting monopole antenna 471, first passive element 472 and second passive element 473. The same parts in FIG. 87 as those in Embodiment 68 are assigned the same reference numerals and detailed explanations thereof will be omitted.

FIG. 87 is a schematic diagram showing a configuration of the diversity antenna for a radio communication terminal according to Embodiment 72 of the present invention. As shown in this figure, monopole antenna 471, first passive element 472 and second passive element 473 are mounted in such a way that the axial direction of each element is perpendicular to the upper surface (horizontal plane) of the radio communication terminal.

In the diversity antenna for a radio communication terminal in the above configuration, only monopole antenna 471 operates during transmission and both dipole antenna 321 and monopole antenna 471 operate during reception to carry out diversity reception.

Thus, monopole antenna 471 can suppress deterioration of gain and at the same time mainly receive vertically polarized waves parallel to the axial direction of the antenna elements. Furthermore, dipole antenna 321 can not only suppress deterioration of gain but also mainly receive vertically polarized waves parallel to the axial direction of the antenna elements. On the other hand, the signal sent from the other end of communication is often a mixture of vertically polarized waves and horizontally polarized waves due to various factors such as reflection. Thus, when there are more horizontally polarized waves, the axial direction of the antenna matches the plane of polarization of the signal, and therefore it is possible to increase the reception gain.

Thus, this embodiment uses dipole antenna 321 in Embodiment 60 and monopole antenna 471 constructed in the same way as monopole antenna 431 in Embodiment 64, and can thereby provide a diversity antenna for a radio communication terminal capable of suppressing deterioration of gain due to influences from the human body and with a wideband input reflection characteristic.

(Embodiment 73)

Embodiment 73 is a mode in which the configurations of the dipole antenna in Embodiment 60 to Embodiment 72 and the first and second passive elements accompanying this dipole antenna are changed.

FIG. 83 is a schematic diagram showing a configuration of the built-in antenna for a radio communication terminal according to Embodiment 73 of the present invention. As shown in this figure, the antenna elements making up dipole antenna 481 are rectangular-wave-shaped. First passive element 482 and second passive element 483 are also rectangular-wave-shaped.

Dipole antenna 481 and first passive element 482 and second passive element 483 accompanying this dipole antenna 481 in the above configurations are applicable as the dipole antenna and first passive element and second passive element accompanying this dipole antenna in each embodiment of the present Specification. For example, applying dipole antenna 481 and first passive element 482 and second passive element 483 accompanying this dipole antenna 481 in the above configurations to the built-in antenna for a radio communication terminal according to Embodiment 60 shown in FIG. 71 means that dipole antenna 481 is used instead of dipole antenna 321 shown in FIG. 71, first passive element 482 is used instead of first passive element 391 shown in FIG. 71 and second passive element 483 is used instead of second passive element 392 shown in FIG. 71.

Thus, by using rectangular-wave-shaped dipole antenna 481 and first passive element 482 and second passive element 483 accompanying this dipole antenna 481, this embodiment can reduce the size of the apparatus.

(Embodiment 74)

Embodiment 74 is a mode in which the configurations of monopole antenna 431, first passive element 432 and second passive element 433 in Embodiment 64 are changed.

Figure 89:
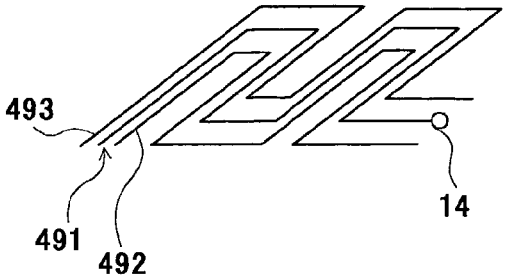
FIG. 89 is a schematic view showing a configuration of main components of a built-in antenna for a radio communication terminal according to Embodiment 74 of the present invention.

FIG. 89 is a schematic diagram showing a configuration of main components of the built-in antenna for a radio communication terminal according to Embodiment 74 of the present invention. As shown in this figure, the antenna element making up monopole antenna 491 is rectangular-wave-shaped. Furthermore, first passive element 492 and second passive element 493 are also rectangular-wave-shaped. That is, this embodiment is different from Embodiment 64 in that monopole antenna 491, first passive element 492 and second passive element 493 are rectangular-wave-shaped.

Thus, by using rectangular-wave-shaped monopole antenna 491, first passive element 492 and second passive element 493, this embodiment can reduce the size of the apparatus.

(Embodiment 75)

Embodiment 75 is a mode in which the configuration of the dipole antenna in Embodiment 60 to Embodiment 72 is changed.

Figure 90:
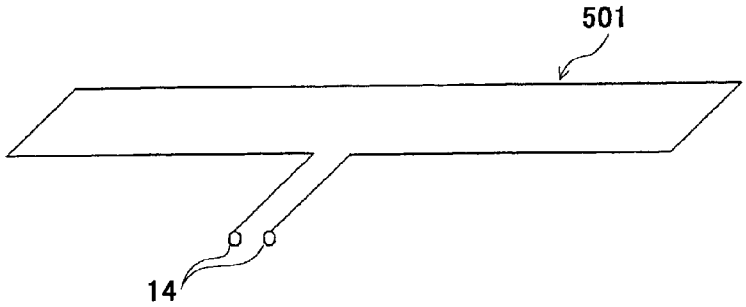
FIG. 90 is a schematic view showing a configuration of a folded-dipole antenna according to Embodiment 75 of the present invention.

FIG. 90 is a schematic diagram showing a configuration of folded-dipole antenna 501 in Embodiment 75 of the present invention. As shown in this figure, folded-dipole antenna 501 according to Embodiment 75 is formed in such a way that two bar-shaped antenna elements are placed in parallel and the ends of these two antenna elements placed in parallel are shorted.

Folded-dipole antenna 501 in the above configuration is applicable as a dipole antenna in each embodiment of the present Specification.

Thus, applying folded-dipole antenna 501 as the dipole antenna in each embodiment of the present Specification makes it possible to achieve effects similar to those in each embodiment of the present Specification, step up impedance and perform impedance matching easily.

(Embodiment 76)

Figure 91:
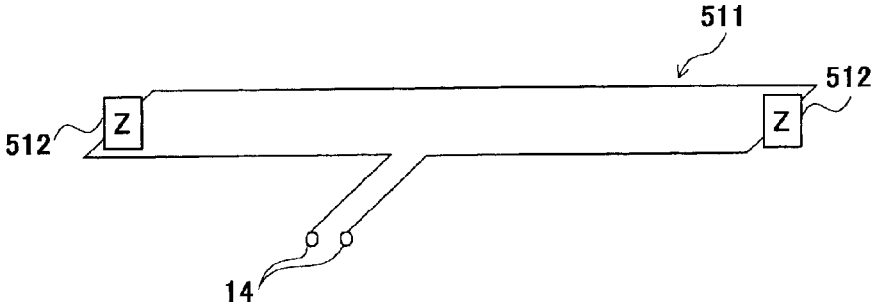
FIG. 91 is a schematic view showing a configuration of a folded-dipole antenna according to Embodiment 76 of the present invention.

Embodiment 76 is a mode in which the configuration of folded-dipole antenna 501 in Embodiment 75 is changed. Embodiment 76 is the same as Embodiment 75 except for the configuration of the folded-dipole antenna. In FIG. 91, the same components as those in Embodiment 75 are assigned the same reference numerals and detailed explanations thereof will be omitted.

FIG. 91 is a schematic diagram showing a configuration of folded-dipole antenna 511 in Embodiment 76 of the present invention. As shown in this figure, folded-dipole antenna 511 according to Embodiment 76 is formed in such a way that two bar-shaped antenna elements are placed in parallel and impedance elements 512 are attached to the ends of these two antenna elements placed in parallel.

Folded-dipole antenna 511 in the above configuration is applicable as a dipole antenna in each embodiment of the present Specification.

Thus, applying folded-dipole antenna 511 as the dipole antenna in each embodiment of the present Specification makes it possible to achieve effects similar to those in each embodiment of the present Specification, step up impedance and perform impedance matching easily. Furthermore, using folded-dipole antenna 511 in the above configuration as the dipole antenna makes it possible to widen the band and further reduce the size of the antenna.

(Embodiment 77)

Figure 88:
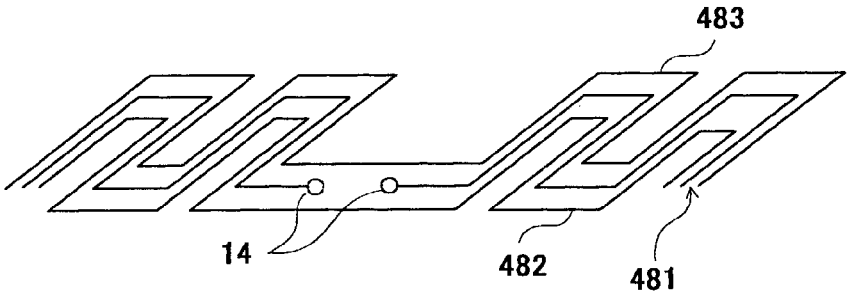
FIG. 88 is a schematic view showing a configuration of main components of a built-in antenna for a radio communication terminal according to Embodiment 73 of the present invention.

Embodiment 77 is a mode in which, of dipole antenna 481, first passive element 482 and second passive element 483 shown in FIG. 88, dipole antenna 481 is changed to folded-dipole antenna 101 shown in FIG. 18.

Figure 92:
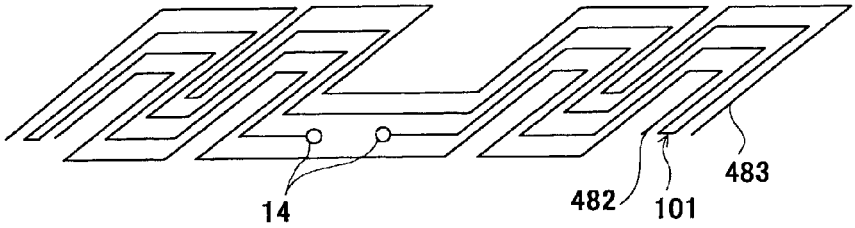
FIG. 92 is a schematic view showing a configuration of main components of a built-in antenna for a radio communication terminal according to Embodiment 77 of the present invention.

FIG. 92 is a schematic diagram showing a configuration of main components of the built-in antenna for a radio communication terminal according to Embodiment 77 of the present invention. As shown in this figure, first passive element 482 and second passive element 483 are placed in such a way as to face folded-dipole antenna 101.

Folded-dipole antenna 101 and first passive element 482 and second passive element 483 accompanying this folded-dipole antenna 101 in the above configurations are applicable as the dipole antenna and first passive element and second passive element accompanying this dipole antenna in each embodiment of the present Specification.

Thus, by using folded-dipole antenna 101 and first passive element 482 and second passive element 483 accompanying this folded-dipole antenna 101 as the dipole antenna and first passive element and second passive element accompanying this dipole antenna, this embodiment can achieve effects similar to those in each embodiment of the present Specification, step up impedance and perform impedance matching easily.

(Embodiment 78)

Embodiment 78 is a mode in which, of dipole antenna 481, first passive element 482 and second passive element 483 shown in FIG. 88, dipole antenna 481 is changed to folded-dipole antenna 111 shown in FIG. 19.

Figure 93:
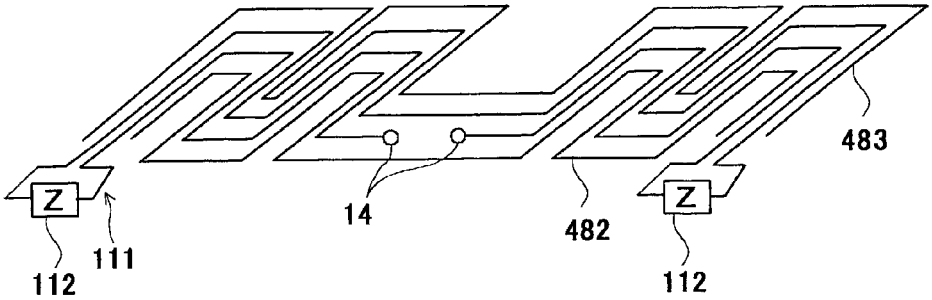
FIG. 93 is a schematic view showing a configuration of main components of a built-in antenna for a radio communication terminal according to Embodiment 78 of the present invention.

FIG. 93 is a schematic diagram showing a configuration of main components of the built-in antenna for a radio communication terminal according to Embodiment 78 of the present invention. As shown in this figure, first passive element 482 and second passive element 483 are placed in such a way as to face folded-dipole antenna 101.

Folded-dipole antenna 111 and first passive element 482 and second passive element 483 accompanying this dipole antenna 111 in the above configurations are applicable as the dipole antenna and first passive element and second passive element accompanying this dipole antenna in each embodiment of the present Specification.

Thus, by using folded-dipole antenna 111 and first passive element 482 and second passive element 483 accompanying this folded-dipole antenna 111 as the dipole antenna and first passive element and second passive element accompanying this dipole antenna in each embodiment of the present Specification, this embodiment can achieve effects similar to those in each embodiment of the present Specification, step up impedance and perform impedance matching easily.

(Embodiment 79)

Figure 94:
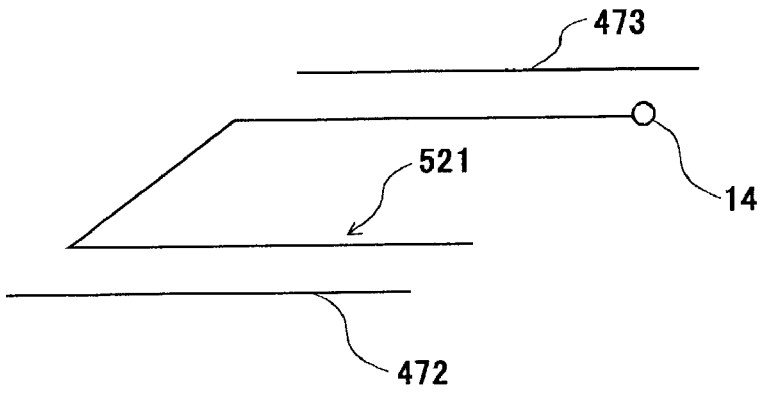
FIG. 94 is a schematic view showing a configuration of main components of a built-in antenna for a radio communication terminal according to Embodiment 79 of the present invention.

Embodiment 79 is a mode in which the configuration of monopole antenna 471 in Embodiment 72 is changed. Embodiment 79 is the same as Embodiment 75 except the configuration of the monopole antenna. In FIG. 94, the parts similar to those in Embodiment 75 are assigned the same reference numerals and explanations thereof will be omitted.

FIG. 94 is a schematic diagram showing a configuration of main components of the built-in antenna for a radio communication terminal according to Embodiment 79 of the present invention. As shown in this figure, folded-monopole antenna 521 is horseshoe-shaped. That is, this embodiment is different from Embodiment 72 in that monopole antenna 471 is replaced by monopole antenna 521.

Thus, by using folded-monopole antenna 521 as the monopole antenna, this embodiment can achieve effects similar to those in Embodiment 72, step up impedance and perform impedance matching easily.

(Embodiment 80)

Figure 95:
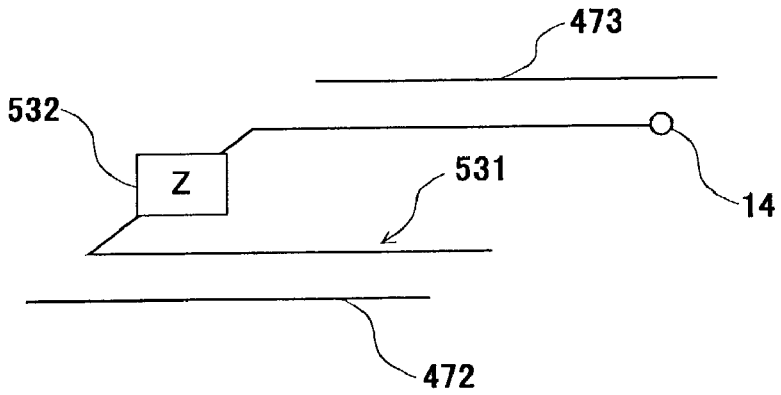
FIG. 95 is a schematic view showing a configuration of main components of a built-in antenna for a radio communication terminal according to Embodiment 80 of the present invention.

Embodiment 80 is a mode in which the configuration of monopole antenna 521 in Embodiment 79 is changed. Embodiment 80 is the same as Embodiment 79 except for the configuration of the monopole antenna. In FIG. 95, the parts similar to those in Embodiment 79 are assigned the same reference numerals and explanations thereof will be omitted.

FIG. 95 is a schematic diagram showing a configuration of main components of the built-in antenna for a radio communication terminal according to Embodiment 80 of the present invention. As shown in this figure, folded-monopole antenna 531 is formed in such a way that two bar-shaped antenna elements are placed in parallel and impedance element 532 is attached to the ends of these two antenna elements placed in parallel. Thus, by using folded-monopole antenna 531 provided with impedance element 532, this embodiment can step up impedance and perform impedance matching easily.

(Embodiment 81)

Figure 96:
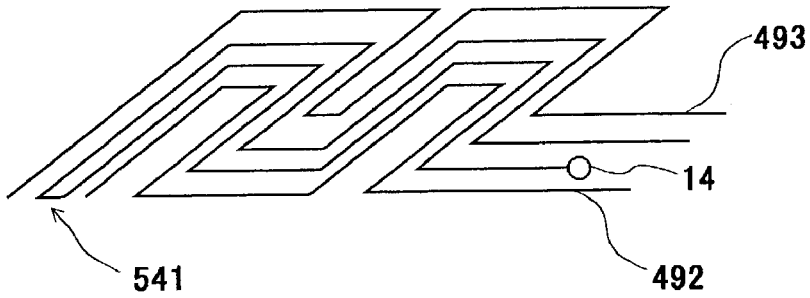
FIG. 96 is a schematic view showing a configuration of main components of a built-in antenna for a radio communication terminal according to Embodiment 81 of the present invention.

Embodiment 81 is a mode in which the configuration of monopole antenna 491 shown in FIG. 89 is changed. Embodiment 81 is the same as Embodiment 74 except the configuration of the monopole antenna. In FIG. 96, the same components as those in Embodiment 74 are assigned the same reference numerals and explanations thereof will be omitted.

FIG. 96 is a schematic diagram showing a configuration of main components of the built-in antenna for a radio communication terminal according to Embodiment 81 of the present invention. As shown in this figure, monopole antenna 541 is formed in such a way that two rectangular-wave-shaped antenna elements are placed in parallel and the ends of these two rectangular-wave-shaped antenna elements placed in parallel are shorted.

Thus, by using rectangular-wave-shaped folded-monopole antenna as the monopole antenna, this embodiment can step up impedance and perform impedance matching easily. This embodiment can also reduce the size of the apparatus.

(Embodiment 82)

Figure 97:
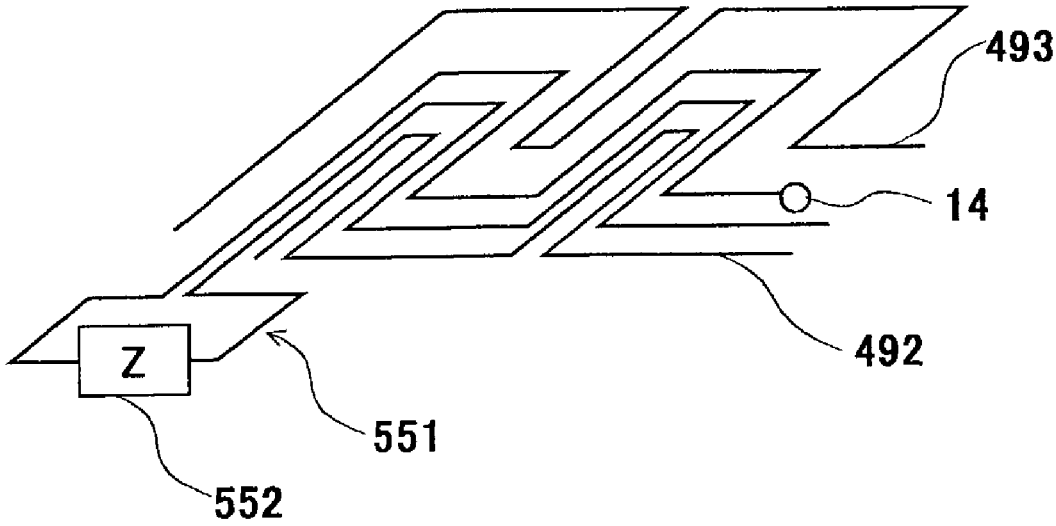
FIG. 97 is a schematic view showing a configuration of main components of a built-in antenna for a radio communication terminal according to Embodiment 82 of the present invention.

Embodiment 82 is a mode in which the configuration of monopole antenna 541 shown in FIG. 96 is changed. Embodiment 82 is the same as Embodiment 81 except the configuration of the monopole antenna. In FIG. 97, the same components as those in Embodiment 81 are assigned the same reference numerals and explanations thereof will be omitted.

FIG. 97 is a schematic diagram showing a configuration of main components of the built-in antenna for a radio communication terminal according to Embodiment 82 of the present invention. As shown in this figure, monopole antenna 551 in Embodiment 82 is formed in such a way that two rectangular-wave-shaped antenna elements are placed in parallel and impedance element 552 is attached to the ends of these two rectangular-wave-shaped antenna elements placed in parallel.

Thus, by using a rectangular-wave-shaped folded-monopole antenna as monopole antenna 551 and attaching impedance element 552 thereto, this embodiment can step up impedance and perform impedance matching easily. This embodiment can also reduce the size of the apparatus.

By the way, Embodiment 49 to Embodiment 59 above have described the case where each antenna element of the dipole antenna is bar-shaped, but the present invention is not limited to this and one or both of the antenna elements can also be rectangular-wave-shaped.

Furthermore, Embodiment 49 to Embodiment 59 above have described the case where the first passive element is bar-shaped, but the present invention is not limited to this and the first passive element can also be rectangular-wave-shaped or spiral-shaped.

Furthermore, the built-in antenna for a radio communication terminal or diversity antenna for a radio communication terminal according to each of the above-described embodiments can be mounted in a communication terminal apparatus or base station apparatus.

This application is based on the Japanese Patent Application No. 2000-056476 filed on Mar. 1, 2000, the Japanese Patent Application No. 2000-118692 filed on Apr. 19, 2000 and the Japanese Patent Application No. 2000-262549 filed on Aug. 31, 2000, entire content of which is expressly incorporated by reference herein.

INDUSTRIAL APPLICABILITY

The present invention is applicable to a built-in antenna used for a radio communication terminal.

What is claimed is:

1. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

said dipole antenna comprises a bar-shaped antenna element and a rectangular-wave-shaped antenna element, said bar-shaped antenna element is provided outside said package in such a way that the axial direction thereof is parallel to the longitudinal direction of said tabular plane of said grounded conductor, and said rectangular-wave-shaped antenna element is provided inside said package in such a way that the longitudinal direction thereof is parallel to the longitudinal direction of said tabular plane of said grounded conductor.

2. The built-in antenna for a radio communication terminal according to claim 1, wherein said dipole antenna comprises a rectangular-wave-shaped antenna element instead of said bar-shaped antenna element.

3. A diversity antenna constructed using two built-in antennas for a radio communication terminal according to claim 2.

4. A diversity antenna, comprising:

the built-in antenna for a radio communication terminal according to claim 2; and a dipole antenna having two rectangular-wave-shaped antenna elements, wherein diversity transmission/reception is carried out using said built-in antenna for a radio communication terminal and said dipole antenna.

5. The diversity antenna according to claim 4, wherein said dipole antenna comprises two rectangular-wave-shaped antenna elements, and said two rectangular-wave-shaped antenna elements are provided inside said package in such a way that the longitudinal direction thereof is parallel to the longitudinal direction of said tabular plane of said grounded conductor.

6. The diversity antenna according to claim 4, wherein said dipole antenna comprises two rectangular-wave-shaped antenna elements, and said two rectangular-wave-shaped antenna elements are provided in such a way that the longitudinal direction thereof is perpendicular to the longitudinal direction of said tabular plane of said grounded conductor.

7. The diversity antenna according to claim 4, wherein said dipole antenna comprises two rectangular-wave-shaped antenna elements, the first antenna element of said two rectangular-wave-shaped antenna elements is provided in such a way that the longitudinal direction thereof is parallel to the longitudinal direction of said tabular plane of said grounded conductor, and the second antenna element is provided in such a way that the longitudinal direction thereof is perpendicular to the longitudinal direction of said tabular plane of said grounded conductor.

8. A diversity antenna constructed using two built-in antennas for a radio communication terminal according to claim 1.

9. A diversity antenna, comprising:

the built-in antenna for a radio communication terminal according to claim 1; and a dipole antenna having two rectangular-wave-shaped antenna elements, wherein diversity transmission/reception is carried out using said built-in antenna for a radio communication terminal and said dipole antenna.

10. The diversity antenna according to claim 9, wherein said dipole antenna comprises two rectangular-wave-shaped antenna elements, and said two rectangular-wave-shaped antenna elements are provided inside said package in such a way that the longitudinal direction thereof is parallel to the longitudinal direction of said tabular plane of said grounded conductor.

11. The diversity antenna according to claim 9, wherein said dipole antenna comprises two rectangular-wave-shaped antenna elements, and said two rectangular-wave-shaped antenna elements are provided in such a way that the longitudinal direction thereof is perpendicular to the longitudinal direction of said tabular plane of said grounded conductor.

12. The diversity antenna according to claim 9, wherein said dipole antenna comprises two rectangular-wave-shaped antenna elements, the first antenna element of said two rectangular-wave-shaped antenna elements is provided in such a way that the longitudinal direction thereof is parallel to the longitudinal direction of said tabular plane of said grounded conductor, and the second antenna element is provided in such a way that the longitudinal direction thereof is perpendicular to the longitudinal direction of said tabular plane of said grounded conductor.

13. The built-in antenna for a radio communication terminal according to claim 1, wherein said antenna element is provided with an inductance element between the power supply end and the other end thereof.

14. The built-in antenna for a radio communication terminal according to claim 1, wherein said rectangular-wave-shaped antenna element is a folded-dipole antenna provided with a capacitance element.

15. The built-in antenna for a radio communication terminal according to claim 1, wherein said dipole antenna is constructed of a spiral-shaped antenna element and said antenna element is provided with an inductance element between the power supply end and the other end thereof.

16. The built-in antenna for a radio communication terminal according to claim 1, wherein said dipole antenna is a spiral-shaped folded-dipole antenna provided with a capacitance element.

17. The built-in antenna for a radio communication terminal according to claim 1, wherein said dipole antenna comprises another rectangular-wave-shaped antenna element placed in parallel to said rectangular-wave-shaped antenna element.

18. The built-in antenna for a radio communication terminal according to claim 1, wherein said dipole antenna is constructed of a spiral-shaped antenna element and another spiral-shaped antenna element placed in parallel to said spiral-shaped antenna element.

19. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

said dipole antenna comprises a bar-shaped antenna element and a rectangular-wave-shaped antenna element, said bar-shaped antenna element is provided outside said package in such a way that the axial direction thereof is parallel to the longitudinal direction of said tabular plane of said grounded conductor, and said rectangular-wave-shaped antenna element is provided inside said package in such a way that the longitudinal direction thereof is perpendicular to the longitudinal direction of said tabular plane of said grounded conductor.

20. The built-in antenna for a radio communication terminal according to claim 19, wherein said dipole antenna comprises a rectangular-wave-shaped antenna element instead of said bar-shaped antenna element.

21. A diversity antenna constructed using two built-in antennas for a radio communication terminal according to claim 20.

22. A diversity antenna, comprising:

the built-in antenna for a radio communication terminal according to claim 20; and a dipole antenna having two rectangular-wave-shaped antenna elements, wherein diversity transmission/reception is carried out using said built-in antenna for a radio communication terminal and said dipole antenna.

23. The diversity antenna according to claim 22, wherein said dipole antenna comprises two rectangular-wave-shaped antenna elements, and said two rectangular-wave-shaped antenna elements are provided inside said package in such a way that the longitudinal direction thereof is parallel to the longitudinal direction of said tabular plane of said grounded conductor.

24. The diversity antenna according to claim 22, wherein said dipole antenna comprises two rectangular-wave-shaped antenna elements, and said two rectangular-wave-shaped antenna elements are provided in such a way that the longitudinal direction thereof is perpendicular to the longitudinal direction of said tabular plane of said grounded conductor.

25. The diversity antenna according to claim 22, wherein said dipole antenna comprises two rectangular-wave-shaped antenna elements, the first antenna element of said two rectangular-wave-shaped antenna elements is provided in such a way that the longitudinal direction thereof is parallel to the longitudinal direction of said tabular plane of said grounded conductor, and the second antenna element is provided in such a way that the longitudinal direction thereof is perpendicular to the longitudinal direction of said tabular plane of said grounded conductor.

26. A diversity antenna constructed using two built-in antennas for a radio communication terminal according to claim 19.

27. A diversity antenna, comprising:

the built-in antenna for a radio communication terminal according to claim 19; and a dipole antenna having two rectangular-wave-shaped antenna elements, wherein diversity transmission/reception is carried out using said built-in antenna for a radio communication terminal and said dipole antenna.

28. The diversity antenna according to claim 27, wherein said dipole antenna comprises two rectangular-wave-shaped antenna elements, and said two rectangular-wave-shaped antenna elements are provided inside said package in such a way that the longitudinal direction thereof is parallel to the longitudinal direction of said tabular plane of said grounded conductor.

29. The diversity antenna according to claim 27, wherein said dipole antenna comprises two rectangular-wave-shaped antenna elements, and said two rectangular-wave-shaped antenna elements are provided in such a way that the longitudinal direction thereof is perpendicular to the longitudinal direction of said tabular plane of said grounded conductor.

30. The diversity antenna according to claim 27, wherein said dipole antenna comprises two rectangular-wave-shaped antenna elements, the first antenna element of said two rectangular-wave-shaped antenna elements is provided in such a way that the longitudinal direction thereof is parallel to the longitudinal direction of said tabular plane of said grounded conductor, and the second antenna element is provided in such a way that the longitudinal direction thereof is perpendicular to the longitudinal direction of said tabular plane of said grounded conductor.

the second antenna element is provided in such a way that the longitudinal direction thereof is perpendicular to the longitudinal direction of said tabular plane of said grounded conductor.

31. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

the power supply end of the antenna element making up said dipole antenna is rectangular-wave-shaped and the other end is bar-shaped, said antenna element is folded in such a way that the longitudinal direction of said rectangular-wave-shaped part and the axial direction of said bar-shaped part intersect at right angles, said rectangular-wave-shaped part is provided in such a way that the longitudinal direction thereof is perpendicular to the longitudinal direction of said grounded conductor, and said bar-shaped part is provided outside said package and said rectangular-wave-shaped part is provided inside said package.

32. The built-in antenna for a radio communication terminal according to claim 31, wherein said dipole antenna comprises a rectangular-wave-shaped part instead of said bar-shaped part of said antenna element.

33. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

said dipole antenna comprises a bar-shaped antenna element and a rectangular-wave-shaped antenna element, said bar-shaped antenna element is provided inside said package in such a way that the axial direction thereof is perpendicular to the longitudinal direction of said tabular plane of said grounded conductor, and said rectangular-wave-shaped antenna element is provided inside said package in such a way that the longitudinal direction thereof is parallel to the longitudinal direction of said tabular plane of said grounded conductor.

34. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

said dipole antenna comprises a bar-shaped antenna element and a rectangular-wave-shaped antenna element, said bar-shaped antenna element is provided inside said package in such a way that the axial direction thereof is parallel to the longitudinal direction of said tabular plane of said grounded conductor, and said rectangular-wave-shaped antenna element is provided inside said package in such a way that the longitudinal direction thereof is perpendicular to the longitudinal direction of said tabular plane of said grounded conductor.

35. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

the power supply end of the antenna element making up said dipole antenna is bar-shaped and the other end is rectangular-wave shaped, said antenna element is folded in such a way that the longitudinal direction of said rectangular-wave-shaped part is perpendicular to the axial direction of said bar-shaped part, said rectangular-wave-shaped part is provided in such a way that the longitudinal direction thereof is parallel to the longitudinal direction of said grounded conductor, and said bar-shaped part and said rectangular-wave-shaped part are provided inside said package.

36. A built-in antenna for a radio communication terminal, comprising:

a grounded conductor, incorporated in a package of the radio communication terminal, that forms a tabular plane;

a dipole antenna provided with an antenna element connected to said grounded conductor; and balance-to-unbalance transforming means for matching impedance between said dipole antenna and said grounded conductor and transforming an unbalanced signal to a balanced signal or vice versa, wherein:

the power supply end of the antenna element making up said dipole antenna is rectangular-wave-shaped and the other end is bar-shaped, said antenna element is folded in such a way that the longitudinal direction of said rectangular-wave-shaped part is perpendicular to the axial direction of said bar-shaped part, said rectangular-wave-shaped part is provided in such a way that the longitudinal direction thereof is perpendicular to the longitudinal direction of said grounded conductor, and said bar-shaped part and said rectangular-wave-shaped part are provided inside said package.

37. A built-in antenna for a radio communication terminal, comprising:

a grounded conductor, incorporated in a package of the radio communication terminal, that forms a tabular plane;

a dipole antenna provided with an antenna element connected to said grounded conductor;

balance-to-unbalance transforming means for matching impedance between said dipole antenna and said grounded conductor and transforming an unbalanced signal to a balanced signal or vice versa; and a first bar-shaped passive element, wherein:

said dipole antenna is constructed of two bar-shaped antenna elements placed on a straight line, said first passive element is provided in such a way that the axial direction thereof is parallel to the axial direction of said bar-shaped antenna element making up said dipole antenna and a reference plane formed by said first passive element and said bar-shaped antenna element making up said dipole antenna is perpendicular to the main plane of said package, and directivity is formed in the direction along said reference plane and normal to the main plane of said package.

38. The built-in antenna for a radio communication terminal according to claim 37, wherein the main plane of said package is rectangular-wave-shaped and said first passive element is provided along the longitudinal direction of the main plane of said package.

39. The built-in antenna for a radio communication terminal according to claim 37, wherein the main plane of said package is rectangular-wave-shaped and said first passive element is provided along the width direction of the main plane of said package.

40. The built-in antenna for a radio communication terminal according to claim 37, wherein the main plane of said package is rectangular-wave-shaped, said first passive element is folded along said reference plane, one folded rectilinear part is provided along the longitudinal direction of the main plane of said package, and the other folded rectilinear part is provided along the width direction of the main plane of said package.

41. A diversity antenna comprising two built-in antennas for a radio communication terminal according to claim 4, wherein diversity transmission/reception is carried out using said two built-in antennas for a radio communication terminal.

42. The built-in antenna for a radio communication terminal according to claim 37, wherein the main plane of said package is rectangular-wave-shaped, said first passive element is folded in the form of a horseshoe along said reference plane, the folded rectilinear part including the edge is provided along the longitudinal direction of the main plane of said package, and the folded rectilinear part not including the edge is provided along the width direction of the main plane of said package.

43. A diversity antenna, comprising:

the built-in antenna for a radio communication terminal according to claim 37; and a bar-shaped monopole antenna, herein diversity transmission/reception is carried out using said built-in antenna for a radio communication terminal and said monopole antenna.

44. A diversity antenna, comprising:

the built-in antenna for a radio communication terminal according to claim 37; and a rectangular-wave-shaped monopole antenna, wherein diversity transmission/reception is carried out using said built-in antenna for a radio communication terminal and said monopole antenna.

45. A diversity antenna, comprising:

the built-in antenna for a radio communication terminal according to claim 37; and a spiral-shaped monopole antenna, wherein diversity transmission/reception is carried out using said built-in antenna for a radio communication terminal and said monopole antenna.

46. A diversity antenna comprising two built-in antennas for a radio communication terminal according to claim 37, wherein diversity transmission/reception is carried out using said two built-in antennas for a radio communication terminal.

47. A diversity antenna for carrying out diversity transmission/reception using the built-in antenna for a radio communication terminal according to claim 37 and the built-in antenna for a radio communication terminal according to claim 28.

48. A diversity antenna for carrying out diversity transmission/reception using the built-in antenna for a radio communication terminal according to claim 37 and the built-in antenna for a radio communication terminal according to claim 40.

49. The built-in antenna for a radio communication terminal according to claim 37, further comprising a second bar-shaped passive element, wherein said second bar-shaped passive element is provided in such a way that the axial direction thereof is parallel to the axial direction of said bar-shaped antenna element making up said dipole antenna.

50. The built-in antenna for a radio communication terminal according to claim 49, wherein the main plane of said package is rectangular-wave-shaped, said first passive element is provided along the longitudinal direction of the main plane of said package, and said second passive element is provided along the longitudinal direction of the main plane of said package.

51. The built-in-antenna for a radio communication terminal according to claim 50, wherein said dipole antenna is a folded-dipole antenna.

52. The built-in antenna for a radio communication terminal according to claim 51, wherein said dipole antenna is provided with impedance converting means.

53. A diversity antenna comprising the built-in antenna for a radio communication terminal according to claim 50 and a bar-shaped monopole antenna, wherein diversity transmission/reception is carried out using said built-in antenna for a radio communication terminal and said monopole antenna.

54. A diversity antenna comprising the built-in antenna for a radio communication terminal according to claim 50 and a rectangular-wave-shaped monopole antenna, wherein diversity transmission/reception is carried out using said built-in antenna for a radio communication terminal and said monopole antenna.

55. A diversity antenna comprising the built-in antenna for a radio communication terminal according to claim 50 and a spiral-shaped monopole antenna, wherein diversity transmission/reception is carried out using said-built-in antenna for a radio communication terminal and said monopole antenna.

56. A diversity antenna comprising the two built-in antennas for a radio communication terminal according to claim 50, wherein diversity transmission/reception is carried out using said two built-in antennas for a radio communication terminal.

57. The built-in antenna for a radio communication terminal according to claim 49, wherein the main plane of said package is rectangular-wave-shaped, said first passive element is provided along the width direction of the main plane of said package, and said second passive element is provided along the width direction of the main plane of said package.

58. The built-in antenna for a radio communication terminal according to claim 57, wherein said dipole antenna is a folded-dipole antenna.

59. The built-in antenna for a radio communication terminal according to claim 58, wherein said dipole antenna is provided with impedance converting means.

60. The built-in antenna for a radio communication terminal according to claim 49, wherein the main plane of said package is rectangular-wave-shaped, said first passive element is folded along said reference plane, one folded rectilinear part is provided along the longitudinal direction of the main plane of said package, the other folded rectilinear part is provided along the width direction of the main plane of said package, said second passive element is folded along said reference plane, one folded rectilinear part is provided along the longitudinal direction of the main plane of said package, and the other folded rectilinear part is provided along the width direction of the main plane of said package.

61. A diversity antenna comprising the two built-in antennas for a radio communication terminal according to claim 60, wherein diversity transmission/reception is carried out using said two built-in antennas for a radio communication terminal.

62. The built-in antenna for a radio communication terminal according to claim 60, wherein said dipole antenna is a folded-dipole antenna.

63. The built-in antenna for a radio communication terminal according to claim 62, wherein said dipole antenna is provided with impedance converting means.

64. The built-in antenna for a radio communication terminal according to claim 49, wherein the main plane of said package is rectangular-wave-shaped, said first passive element is folded in the form of a horseshoe along said reference plane, the folded rectilinear part including the edge is provided along the longitudinal direction of the main plane of said package, the folded rectilinear part not including the edge is provided along the width direction of the main plane of said package, said second passive element is folded in the form of a horseshoe along said reference plane, the folded rectilinear part including the edge is provided along the longitudinal direction of the main plane of said package, and the folded rectilinear part not including the edge is provided along the width direction of the main plane of said package.

65. The built-in antenna for a radio communication terminal according to claim 64, wherein said dipole antenna is a folded-dipole antenna.

66. The built-in antenna for a radio communication terminal according to claim 65, wherein said dipole antenna is provided with impedance converting means.

67. A built-in antenna for a radio communication terminal, comprising:

a grounded conductor, incorporated in a package of the radio communication terminal, that forms a tabular plane;

a dipole antenna provided with an antenna element connected to said grounded conductor;

balance-to-unbalance transforming means for matching impedance between said dipole antenna and said grounded conductor and transforming an unbalanced signal to a balanced signal or vice versa; and a first rectangular-wave-shaped passive element, wherein:

said dipole antenna is constructed of two rectangular-wave-shaped antenna elements placed in such a way that the respective centerlines in the longitudinal direction form a straight line, said first passive element is provided in such a way that the longitudinal direction thereof is parallel to the longitudinal direction of said rectangular-wave-shaped antenna element making up said dipole antenna and a reference plane formed by said first passive element and said rectangular-wave-shaped antenna element making up said dipole antenna is perpendicular to the main plane of said package, and directivity is formed in the direction along said reference plane and normal to the main plane of said package.

68. The built-in antenna for a radio communication terminal according to claim 67, further comprising a second rectangular-wave-shaped passive element, wherein said second passive element is provided in such a way that the longitudinal direction thereof is parallel to the longitudinal direction of said rectangular-wave-shaped antenna element making up said dipole antenna.

69. The built-in antenna for a radio communication terminal according to claim 68, wherein the main plane of said package is rectangular-wave-shaped, said first passive element is provided along the longitudinal direction of the main plane of said package, and said second passive element is provided along the longitudinal direction of the main plane of said package.

70. The built-in antenna for a radio communication terminal according to claim 69, wherein said dipole antenna is a folded-dipole antenna.

71. The built-in antenna for a radio communication terminal according to claim 70, wherein said dipole antenna is provided with impedance converting means.

72. A diversity antenna comprising the built-in antenna for a radio communication terminal according to claim 69 and a bar-shaped monopole antenna, wherein diversity transmission/reception is carried out using said built-in antenna for a radio communication terminal and said monopole antenna.

73. A diversity antenna comprising the built-in antenna for a radio communication terminal according to claim 69 and a rectangular-wave-shaped monopole antenna, wherein diversity transmission/reception is carried out using said built-in antenna for a radio communication terminal and said monopole antenna.

74. A diversity antenna comprising the built-in antenna for a radio communication terminal according to claim 69 and a spiral-shaped monopole antenna, wherein diversity transmission/reception is carried out using said built-in antenna for a radio communication terminal and said monopole antenna.

75. A diversity antenna comprising the two built-in antennas for a radio communication terminal according to claim 69, wherein diversity transmission/reception is carried out using said two built-in antennas for a radio communication terminal.

76. The built-in antenna for a radio communication terminal according to claim 68, wherein the main plane of said package is rectangular-wave-shaped, said first passive element is provided along the width direction of the main plane of said package, and said second passive element is provided along the width direction of the main plane of said package.

77. The built-in antenna for a radio communication terminal according to claim 76, wherein said dipole antenna is a folded-dipole antenna.

78. The built-in antenna for a radio communication terminal according to claim 77, wherein said dipole antenna is provided with impedance converting means.

79. The built-in antenna for a radio communication terminal according to claim 68, wherein the main plane of said package is rectangular-wave-shaped, said first passive element is folded along said reference plane, one folded rectilinear part is provided along the longitudinal direction of the main plane of said package, the other folded rectilinear part is provided along the width direction of the main plane of said package, said second passive element is folded along said reference plane, one folded rectilinear part is provided along the longitudinal direction of the main plane of said package, and the other folded rectilinear part is provided along the width direction of the main plane of said package.

80. The built-in antenna for a radio communication terminal according to claim 79, wherein said dipole antenna is a folded-dipole antenna.

81. The built-in antenna for a radio communication terminal according to claim 80, wherein said dipole antenna is provided with impedance converting means.

82. A diversity antenna comprising the two built-in antennas for a radio communication terminal according to claim 79, wherein diversity transmission/reception is carried out using said two built-in antennas for a radio communication terminal.

83. The built-in antenna for a radio communication terminal according to claim 68, wherein the main plane of said package is rectangular-wave-shaped, said first passive element is folded in the form of a horseshoe along said reference plane, the folded rectilinear part including the edge is provided along the longitudinal direction of the main plane of said package, the folded rectilinear part not including the edge is provided along the width direction of the main plane of said package, said second passive element is folded in the form of a horseshoe along said reference plane, the folded rectilinear part including the edge is provided along the longitudinal direction of the main plane of said package, and the folded rectilinear part not including the edge is provided along the width direction of the main plane of said package.

84. The built-in antenna for a radio communication terminal according to claim 83, wherein said dipole antenna is a folded-dipole antenna.

85. The built-in antenna for a radio communication terminal according to claim 84, wherein said dipole antenna is provided with impedance converting means.

86. The built-in antenna for a radio communication terminal according to claim 67, wherein the main plane of said package is rectangular-wave-shaped and said first passive element is provided along the longitudinal direction of the main plane of said package.

87. The built-in antenna for a radio communication terminal according to claim 67, wherein the main plane of said package is rectangular-wave-shaped and said first passive element is provided along the width direction of the main plane of said package.

88. The built-in antenna for a radio communication terminal according to claim 67, wherein the main plane of said package is rectangular-wave-shaped, said first passive element is folded along said reference plane, one folded rectilinear part is provided along the longitudinal direction of the main plane of said package, and the other folded rectilinear part is provided along the width direction of the main plane of said package.

89. A diversity antenna comprising two built-in antennas for a radio communication terminal according to claim 88, wherein diversity transmission/reception is carried out using said two built-in antennas for a radio communication terminal.

90. The built-in antenna for a radio communication terminal according to claim 67, wherein the main plane of said package is rectangular-wave-shaped, said first passive element is folded in the form of a horseshoe along said reference plane, the folded rectilinear part including the edge is provided along the longitudinal direction of the main plane of said package, and the folded rectilinear part not including the edge is provided along the width direction of the main plane of said package.

91. A diversity antenna, comprising:

the built-in antenna for a radio communication terminal according to claim 67; and a bar-shaped monopole antenna, wherein diversity transmission/reception is carried out using said built-in antenna for a radio communication terminal and said monopole antenna.

92. A diversity antenna, comprising:

the built-in antenna for a radio communication terminal according to claim 67; and a rectangular-wave-shaped monopole antenna, wherein diversity transmission/reception is carried out using said built-in antenna for a radio communication terminal and said monopole antenna.

93. A diversity antenna, comprising:

the built-in antenna for a radio communication terminal according to claim 67; and a spiral-shaped monopole antenna, wherein diversity transmission/reception is carried out using said built-in antenna for a radio communication terminal and said monopole antenna.

94. A built-in antenna for a radio communication terminal, comprising:

a grounded conductor, incorporated in a package of the radio communication terminal, that forms a tabular plane;

a monopole antenna provided with an antenna element connected to said grounded conductor;

balance-to-unbalance transforming means for matching impedance between said monopole antenna and said grounded conductor and transforming an unbalanced signal to a balanced signal or vice versa; and a bar-shaped first passive element, wherein:

said monopole antenna comprises a bar-shaped antenna element, said first passive element is provided in such a way that the axial direction thereof is parallel to the axial direction of said bar-shaped antenna element making up said monopole antenna and a reference plane formed by said first passive element and rectangular-wave-shaped antenna element making up said monopole antenna is perpendicular to the main plane of said package, and directivity is formed in the direction along said reference plane and normal to the main plane of said package.

95. The built-in antenna for a radio communication terminal according to claim 94, further comprising a bar-shaped second passive element, wherein said second passive element is provided in parallel to the axial direction of said bar-shaped antenna element making up said monopole antenna.

96. The built-in antenna for a radio communication terminal according to claim 95, wherein the main plane of said package is rectangular-wave-shaped, said first passive element is provided along the longitudinal direction of the main plane of said package, and said bar-shaped antenna element making up said monopole antenna is perpendicular to the main plane of said package, and directivity is formed in the direction along said reference plane and normal to the main plane of said package.

97. A communication terminal apparatus comprising the diversity antenna for a radio communication terminal according to claim 96 or claim 69.

98. A base station apparatus comprising the diversity antenna for a radio communication terminal according to claim 96 or claim 69.

99. The built-in antenna for a radio communication terminal according to claim 95, wherein said monopole antenna is a folded-monopole antenna.

100. The built-in antenna for a radio communication terminal according to claim 99, wherein said monopole antenna is provided with impedance converting means.

101. A communication terminal apparatus comprising the built-in antenna for a radio communication terminal according to claim 94.

102. A base station apparatus comprising the built-in antenna for a radio communication terminal according to claim 94.

103. A built-in antenna for a radio communication terminal, comprising:

a grounded conductor, incorporated in a package of the radio communication terminal, that forms a tabular plane;

a monopole antenna provided with an antenna element connected to said grounded conductor;

balance-to-unbalance transforming means for matching impedance between said monopole antenna and said grounded conductor and transforming an unbalanced signal to a balanced signal or vice versa; and a rectangular-wave-shaped first passive element, wherein:

said monopole antenna comprises a rectangular-wave-shaped antenna element, said first passive element is provided in such a way that the longitudinal direction thereof is parallel to the longitudinal direction of said rectangular-wave-shaped antenna element making up said monopole antenna and a reference plane formed by said first passive element and said said second passive element is provided along the longitudinal direction of the main plane of said package.

104. The built-in antenna for a radio communication terminal according to claim 103, further comprising a rectangular-wave-shaped second passive element, wherein said second passive element is provided in parallel to the longitudinal direction of said rectangular-wave-shaped antenna element making up said monopole antenna.

105. The built-in antenna for a radio communication terminal according to claim 104, wherein the main plane of said package is rectangular-wave-shaped, said first passive element is provided along the longitudinal direction of the main plane of said package, and said second passive element is provided along the longitudinal direction of the main plane of said package.

106. A communication terminal apparatus comprising the diversity antenna for a radio communication terminal according to claim 50 or claim 105.

107. A communication terminal apparatus comprising the diversity antenna for a radio communication terminal according to claim 69 or claim 105.

108. A base station apparatus comprising the diversity antenna for a radio communication terminal according to claim 50 or claim 105.

109. A base station apparatus comprising the diversity antenna for a radio communication terminal according to claim 69 or claim 105.

110. The built-in antenna for a radio communication terminal according to claim 104, wherein said monopole antenna is a folded-monopole antenna.

111. The built-in antenna for a radio communication terminal according to claim 110, wherein said monopole antenna is provided with impedance converting means.

* * * * *